US006008767A

United States Patent [19]

Taniguchi et al.

[11] Patent Number: 6,008,767

[45] Date of Patent: *Dec. 28, 1999

[54] GLASS ANTENNA HAVING A SHAPE TO PROVIDE MAXIMUM RECEPTION SENSITIVITY WHILE NOT BLOCKING A DRIVER'S SIGHT

[75] Inventors: Tatsuaki Taniguchi; Kazuo Shigeta, both of Hiroshima-ken; Kenji Kubota, Kure, all of Japan

[73] Assignee: Mazda Motor Corporation, Hiroshima, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/697,497

[22] Filed: Aug. 26, 1996

[30] Foreign Application Priority Data

| | | | |
|---|---|---|---|
| Aug. 28, 1995 | [JP] | Japan | 7-218888 |
| Mar. 13, 1996 | [JP] | Japan | 8-056500 |

[51] Int. Cl.[6] ..... H01Q 1/32

[52] U.S. Cl. ..... 343/713; 343/711

[58] Field of Search ..... 343/713, 711, 343/712; H01Q 1/32

[56] References Cited

U.S. PATENT DOCUMENTS

| | | | |
|---|---|---|---|
| 4,940,991 | 7/1990 | Sheriff | 343/795 |
| 5,353,039 | 10/1994 | Tsukada et al. | 343/713 |
| 5,659,324 | 8/1997 | Taniguchi et al. | 343/704 |
| 5,663,737 | 9/1997 | Kakizawa | 343/713 |

FOREIGN PATENT DOCUMENTS

| | | |
|---|---|---|
| 43 07 232 | 10/1993 | Germany . |
| 20272804 | 11/1990 | Japan . |
| 5-82113 | 4/1993 | Japan . |
| 5-152817 | 6/1993 | Japan . |
| 1 417 715 | 11/1972 | United Kingdom . |

*Primary Examiner*—Hoanganh Le

[57] ABSTRACT

A glass antenna having a high reception sensitivity while not blocking a driver's sight. On a window glass, a longitudinal length y of a pattern of the glass antenna is set so as to satisfy $y \leqq \lambda/4 \cdot \alpha$ ($\lambda$: reception frequency wavelength; $\alpha$: glass reduction ratio), and a transversal length x of the pattern is set so as to satisfy $60\ \text{cm} - y \geqq x$.

23 Claims, 68 Drawing Sheets

AVERAGE VALUES WITHIN
EVALUATION FREQUENCY RANGE (dB)

| | Pw − AV |
|---|---|
| x60y5 = X | − 14.9 |
| x50y5 = IX | − 13.3 |
| x40y5 = VIII | − 13.2 |
| x30y5 = VII | − 13.0 |
| x25y5 = VI | − 13.3 |
| x15y5 = V | − 14.2 |
| x10y5 = IV | − 15.9 |
| x5y5 = III | − 18.1 |
| x2y5 = II | − 19.3 |
| x0.5y5 = I | − 20.5 |

AVERAGE VALUES WITHIN
EVALUATION FREQUENCY RANGE (dB)

| | Pw − AV |
|---|---|
| x60y10 = X | − 13.6 |
| x50y10 = IX | − 12.0 |
| x40y10 = VIII | − 11.5 |
| x30y10 = VII | − 11.4 |
| x25y10 = VI | − 11.2 |
| x15y10 = V | − 11.8 |
| x10y10 = IV | − 13.0 |
| x5y10 = III | − 14.5 |
| x2y10 = II | − 15.7 |
| x0.5y10 = I | − 17.2 |

AVERAGE VALUES WITHIN
EVALUATION FREQUENCY RANGE (dB)

| | Pw − AV |
|---|---|
| x60y15 = X | − 13.3 |
| x50y15 = IX | − 11.6 |
| x40y15 = VIII | − 10.4 |
| x30y15 = VII | − 10.4 |
| x25y15 = VI | − 10.2 |
| x15y15 = V | − 10.5 |
| x10y15 = IV | − 11.2 |
| x5y15 = III | − 12.2 |
| x2y15 = II | − 13.0 |
| x0.5y15 = I | − 14.2 |

AVERAGE VALUES WITHIN
EVALUATION FREQUENCY RANGE (dB)

| | Pw − AV |
|---|---|
| x60y20 = X | − 13.5 |
| x50y20 = IX | − 12.0 |
| x40y20 = VIII | − 10.1 |
| x35y20 = VII | − 9.7 |
| x25y20 = VI | − 9.5 |
| x15y20 = V | − 9.7 |
| x10y20 = IV | − 10.1 |
| x5y20 = III | − 10.6 |
| x2y20 = II | − 11.2 |
| x0.5y20 = I | − 12.0 |

AVERAGE VALUES WITHIN
EVALUATION FREQUENCY RANGE (dB)

| | Pw − AV |
|---|---|
| x50y25 = X | − 12.7 |
| x40y25 = IX | − 10.9 |
| x35y25 = VIII | − 9.8 |
| x30y25 = VII | − 9.3 |
| x25y25 = VI | − 9.1 |
| x15y25 = V | − 9.2 |
| x10y25 = IV | − 9.4 |
| x5y25 = III | − 9.7 |
| x2y25 = II | − 10.0 |
| x0.5y25 = I | − 10.7 |

AVERAGE VALUES WITHIN
EVALUATION FREQUENCY RANGE (dB)

| | Pw − AV |
|---|---|
| x50y30 = X | − 12.9 |
| x40y30 = IX | − 12.0 |
| x35y30 = VIII | − 10.8 |
| x30y30 = VII | − 9.2 |
| x25y30 = VI | − 9.1 |
| x20y30 = V | − 9.1 |
| x15y30 = IV | − 9.2 |
| x10y30 = III | − 9.1 |
| x5y30 = II | − 9.3 |
| x0.5y30 = I | − 10.2 |

AVERAGE VALUES WITHIN
EVALUATION FREQUENCY RANGE (dB)

| | Pw − AV |
|---|---|
| x40y35 = IX | − 12.5 |
| x35y35 = VIII | − 11.9 |
| x30y35 = VII | − 9.5 |
| x25y35 = VI | − 9.6 |
| x20y35 = V | − 9.3 |
| x15y35 = IV | − 9..3 |
| x10y35 = III | − 9.1 |
| x5y35 = II | − 9.2 |
| x0.5y35 = I | − 10.1 |

FIG. 29

AVERAGE VALUES WITHIN
EVALUATION FREQUENCY RANGE (dB)

| | Pw − AV |
|---|---|
| x40y40 = X | − 12.5 |
| x35y40 = IX | − 12.6 |
| x30y40 = VIII | − 10.7 |
| x25y40 = VII | − 10.7 |
| x20y40 = VI | − 10.0 |
| x15y40 = V | − 9.6 |
| x10y40 = IV | − 9.2 |
| x5y40 = III | − 9.3 |
| x2y40 = II | − 9.8 |
| x0.5y40 = I | − 10.5 |

AVERAGE VALUES WITHIN
EVALUATION FREQUENCY RANGE (dB)

| | Pw − AV |
|---|---|
| y3x40 = VIII | − 17.7 |
| y3x35 = VII | − 17.4 |
| y3x30 = VI | − 16.9 |
| y3x25 = V | − 17.7 |
| y3x20 = IV | − 16.2 |
| y3x15 = III | − 14.7 |
| y3x10 = II | − 17.8 |
| y3x5 = I | − 18.8 |

AVERAGE VALUES WITHIN
EVALUATION FREQUENCY RANGE (dB)

| | Pw − AV |
|---|---|
| y5x40 = VIII | − 17.2 |
| y5x35 = VII | − 17.6 |
| y5x30 = VI | − 17.1 |
| y5x25 = V | − 17.2 |
| y5x20 = IV | − 16.3 |
| y5x15 = III | − 15.0 |
| y5x10 = II | − 16.4 |
| y5x5 = I | − 18.0 |

FIG. 56

AVERAGE VALUES WITHIN
EVALUATION FREQUENCY RANGE (dB)

| | Pw − AV |
|---|---|
| y10x40 = VIII | − 16.9 |
| y10x35 = VII | − 17.1 |
| y10x30 = VI | − 17.4 |
| y10x25 = V | − 16.7 |
| y10x20 = IV | − 16.0 |
| y10x15 = III | − 15.5 |
| y10x10 = II | − 15.8 |
| y10x5 = I | − 15.5 |

AVERAGE VALUES WITHIN EVALUATION FREQUENCY RANGE (dB)

| | Pw − AV |
|---|---|
| C-SHAPE FRAME ANTENNA (22cm × 9cm) | − 13.7 |
| RECTANGULARA FRAME ANTENNA (GROUND WIRE : 30cm) | − 21.4 |
| CIRCULARA FRAME ANTENNA (GROUND WIRE : 15cm) | − 24.7 |
| | |

AVERAGE VALUES WITHIN EVALUATION FREQUENCY RANGE (dB)

| | Pw − AV |
|---|---|
| C-SHAPE FRAME ANTENNA (22cm × 9cm) | − 15.1 |
| RECTANGULARA FRAME ANTENNA (GROUND WIRE : 30cm) | − 12.6 |
| CIRCULARA FRAME ANTENNA (GROUND WIRE : 15cm) | − 19.8 |
| | |

AVERAGE VALUES WITHIN
EVALUATION FREQUENCY RANGE (dB)

| | Pw − AV |
|---|---|
| C-SHAPE FRAME ANTENNA (22cm × 9cm) | − 16.2 |
| RECTANGULARA FRAME ANTENNA (GROUND WIRE : 30cm) | − 16.0 |
| CIRCULARA FRAME ANTENNA (GROUND WIRE : 15cm) | − 17.3 |
| | |

WITH GROUND PLATE

WITHOUT GROUND

AVERAGE VALUES WITHIN
EVALUATION FREQUENCY RANGE (dB)

| | Pw – AV |
|---|---|
| T-SHAPE FRAME ANTENNA (GROUND WIRE : 90cm) | – 15.1 |
| GROUND PLATE | – 13.3 |
| | |

AVERAGE VALUES WITHIN
EVALUATION FREQUENCY RANGE (dB)

| | Pw – AV |
|---|---|
| T-SHAPE FRAME ANTENNA (GROUND WIRE : 53.5cm) | – 13.3 |
| GROUND PLATE | – 12.3 |
| | |

AVERAGE VALUES WITHIN
EVALUATION FREQUENCY RANGE (dB)

| | Pw – AV |
|---|---|
| T-SHAPE FRAME ANTENNA (GROUND WIRE : 30cm) | – 14.2 |
| GROUND PLATE | – 12.3 |
| | |

AVERAGE VALUES WITHIN
EVALUATION FREQUENCY RANGE (dB)

| | Pw – AV |
|---|---|
| T-SHAPE FRAME ANTENNA (GROUND WIRE : 20cm) | – 18.1 |
| GROUND PLATE | – 17.4 |
| | |

AVERAGE VALUES WITHIN
EVALUATION FREQUENCY RANGE (dB)

| | Pw – AV |
|---|---|
| RECTANGULAR FRAME ANTENNA (GROUND WIRE : 30cm) | – 12.5 |
| GROUND PLATE | – 12.1 |
| | |

FIG. 96

AVERAGE VALUES WITHIN
EVALUATION FREQUENCY RANGE (dB)

| | Pw – AV |
|---|---|
| RECTANGULAR FRAME ANTENNA (GROUND WIRE : 10cm) | – 15.1 |
| GROUND PLATE | – 15.2 |
| | |

WITHOUT GROUND

10cm

60cm

70cm

WITH GROUND PLATE

DIRECTLY GROUNDED TO VEHICLE BODY

AVERAGE VALUES WITHIN
EVALUATION FREQUENCY RANGE (dB)

| | Pw – AV |
|---|---|
| GROUND WIRE : 90cm | – 16.2 |
| DIRECTLY GROUNDED | – 15.9 |

GLASS ANTENNA HAVING A SHAPE TO PROVIDE MAXIMUM RECEPTION SENSITIVITY WHILE NOT BLOCKING A DRIVER'S SIGHT

BACKGROUND OF THE INVENTION

This invention relates to an antenna such as a glass antenna placed on a glass window pane of a vehicle and the like and a method for setting the antenna on a window glass, and more particularly to improvement of antenna shape.

Vehicular window panes limit drivers' sight. To ensure visibility, various legal regulations are made on vehicular antennas provided on the window panes. Accordingly, the glass antennas must be designed within predetermined limitations regulations on size, width and length.

The above limitations on the shape of the glass antennas by the regulations have serious influence on performance of glass antennas which are already disadvantageous in comparison with rod antennas in point of sensitivity.

Known conventional glass antennas, such as a vehicular antenna device disclosed in Japanese Patent Publication No. 3-74845 and a loop-shaped glass antenna disclosed in Japanese Patent Application Laid-Open No. 3-1703, are not made with consciousness of the regulations, but are well-designed in antenna shape. Further, an antenna according to an article "Disc Shaped Mono-Pole Antenna with Wide Range and Directivity-less Reception Performance" (by Michiaki Ito and Hajime Seki) is known.

The vehicular antenna device in Japanese Patent Publication No. 3-74845 is made based on the relation between the antenna and a metal pillar. That is, the length of the pillar is set to $\lambda/2$ ($\lambda$: wavelength of received wave) or shorter, while the length of the antenna is $\lambda/4$ or shorter. Since this prior art is made on the relation between the antenna and the pillar, and the antenna is basically a mono-pole type antenna, it includes no reference regarding a widthwise direction. Therefore, in consideration of present vehicle size, this antenna device is applicable to the FM band at most.

The glass antenna in Japanese Patent Application Laid-Open No. 3-1703 has a 200 to 1500 mm loop shape, a conductive wire is provided to connect the antenna at a feeding point in approximately parallel to a longitudinal central line of the vehicle. This prior art is made on the point of the total length of the loop antenna, however, the relation between a longitudinal length and a transversal length of the antenna is not considered. Accordingly, to clear the regulations and attain high reception performance, trials and errors with various lengths in the lengthwise and widthwise directions must be repeated within a range of 200 to 1500 mm.

The disk mono-pole type antenna as shown in the above article has a wide range performance with a round disk shape. However, this shape obstructs a driver's sight if the antenna is applied as a vehicular glass antenna. If the size of this antenna is reduced to ensure the driver's sight, a desired performance may not be attained.

SUMMARY OF THE INVENTION

The present invention has been made in consideration of the above situation, and has its object to provide a glass antenna which ensures a driver's sight and high performance, and a method for designing the glass antenna.

According to the present invention, the foregoing object is attained by providing a glass antenna having an antenna pattern, placed on a window glass, said antenna pattern comprising:

a length y, being a maximum longitudinal length of said antenna pattern of said glass antenna, measured from a feeding unit substantially functioning as a feeding point, set so as to satisfy $$y \leqq \lambda/4 \cdot \alpha$$

with a reception frequency wavelength as $\lambda$ and a glass reduction ratio as $\alpha$; and a length x, being a maximum transversal length of said antenna pattern of said glass antenna, set so as to satisfy $$\beta - y \geqq x$$

with a predetermined length constant as $\beta$.

Also the foregoing object is attained by providing a method of designing a glass antenna on a window glass, comprising the steps of:

determining a length y, being a maximum longitudinal length of a antenna pattern of said glass antenna, measured from a feeding unit substantially functioning as a feeding point, set so as to satisfy $$y \leqq \lambda/4 \cdot \alpha$$

with a reception frequency wavelength as $\lambda$ and a glass reduction ratio as $\alpha$; and adjusting a frequency range by controlling a length x, being a maximum transversal length of said antenna pattern of said glass antenna, so as to determine a reception frequency band by the length y of said pattern.

According to the present invention as described above, the relation between the transversal length x and the longitudinal length y is adjusted such that one of them increases as the other decreases, with a length $\beta$ as an upper bound.

In the glass antenna or glass-antenna setting method, the easy adjustment of the lengths x and y can clear the conditions of glass antennas such as good visibility, and further maintain high performance reception characteristic.

According to a preferred aspect of the present invention, the upper bound $\beta$ is approximately 60 cm.

According to a preferred aspect of the present invention, when the lengths x and y are set so as to satisfy $8 \leqq y \leqq 40$ cm and $x \leqq 30$ cm, a glass antenna which has a size not to limit a driver's sight and has a practical sensitivity can be set without a great difficulty.

According to a preferred aspect of the present invention, the window glass is a vehicular front window glass, and said antenna pattern of said antenna has a shape in which the length x is within 6.6 cm at positions lower than a position a predetermined distance lower from an upper end of an area which does not intercept a driver's sight. Thus, a glass antenna which ensures a driver's sight can be obtained.

According to a preferred aspect of the present invention, the window glass is a vehicular front window glass, and said antenna pattern of said glass antenna has a shape having a portion where the length x is within 6.6 cm at a position upper than a position a predetermined distance upper from a lower end of an area which does not intercept a driver's sight. Thus, a glass antenna which ensures a driver's sight can be obtained.

According to a preferred aspect of the present invention, the predetermined distance is about 10 cm.

According to a preferred aspect of the present invention, said antenna pattern of said glass antenna is a rectangular shape where said lengths x and y are in a relation of $x<y$, and the feeding point of said glass antenna is placed at an upper end or a lower end of the rectangular shape. This arrangement of the feeding unit improves a reception sensitivity.

According to a preferred aspect of the present invention, a reception frequency band is UHF by setting the lengths x and y so as to satisfy 5 cm≦x≦40 cm and 3 cm≦y≦10 cm.

According to a preferred aspect of the present invention, said antenna pattern of said glass antenna is larger than an internal mirror of the vehicle. In a case where a mirror is to be attached to the window glass, attachment of the mirror can be easily made.

According to a preferred aspect of the present invention, said glass antenna is a grounded antenna, and a ground member connecting with said glass antenna is capacitively coupled with a metal part of a vehicle body. After shipment from a factory, the ground characteristic, ensured by this alternating-current coupling, enables ordinary users who cannot attain ground precision to attach said antenna.

According to a preferred aspect of the present invention, said ground member has a magnetized portion which attracts the metal part of the vehicle body, thus obtaining a predetermined gap between said ground member and the metal part of the vehicle body.

According to a preferred aspect of the present invention, said glass antenna is stuck on a surface of the glass window with an adhesive layer provided on a surface of said glass antenna.

According to a preferred aspect of the present invention, the feeding unit is provided at an end portion of the antenna pattern. This feeding position ensures high reception performance.

The present invention can be applied to antennas of other materials, as well as a glass antenna. According to the antenna of the present invention, the size of the antenna pattern can be changed based on the material of a base. If a material with a high reduction ratio is selected as the base, for example, the size of the antenna pattern can be reduced, thus the antenna can be minimized.

According to a preferred aspect of the present invention, a capacitive-coupling type antenna can be set on a rear window glass by using a vertical conductor provided within a defogger. Further, an antenna for another frequency band (e.g., for VICS (Vehicle Information and Communication system)) can be set.

According to a preferred aspect of the present invention, said feeding unit is placed on an upper portion or a lower portion of the window glass, and the lengths x and y are respectively set so as to satisfy 7 cm≦x≦30 cm and 7 cm≦y≦10 cm. This setting is especially desirable for TV radio wave reception.

According to a preferred aspect of the present invention, said feeding unit is placed on an upper portion or a lower portion of the window glass, and the lengths x and y are respectively set so as to satisfy $$x \geqq 30 \text{ cm and}$$

$$7 \text{ cm} \leqq y \leqq 10 \text{ cm.}$$

This arrangement is especially desirable for VICS radio wave reception.

According to a preferred aspect of the present invention, said antenna pattern is placed on a vehicular window glass, within a predetermined distance from an upper end of an area which does not intercept a driver's sight. This enables TV or VICS radio wave reception without obstructing a driver's sight.

According to a preferred aspect of the present invention, said antenna pattern includes a plurality of independent antenna wires constituting a diversity system.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 29 is a table showing average reception sensitivities obtained within an evaluation frequency range when y is 40 cm;

FIG. 56 is a table showing average UHF reception characteristics (average reception sensitivities in an evaluation frequency range) in the antenna system in FIG. 1 when y is 10 cm;

FIG. 96 is a table showing averaged reception characteristics of the rectangular antenna according to the first embodiment (reception band: 470–770 MHz; ground length=10 cm);

DETAILED DESCRIPTION OF THE PREFERRED EMBODIMENTS

Preferred embodiments of the present invention will now be described in detail in accordance with the accompanying drawings as examples where an antenna according to the present invention is provided on a glass, especially on a vehicular window glass. In the following embodiments, the glass antenna is applied to a front window glass (first embodiment), a rear window glass (second embodiment) and a side window glass (third embodiment).

The glass antenna attains objects characteristic of setting positions in the respective embodiments (i.e., in the first embodiment, to ensure front sight; in the second embodiment, to eliminate influence by a defogger etc.). Further, modifications of the embodiments (i.e., a grounded antenna using a ground plate and a grounded antenna using a ground wire) will be described.

[First Embodiment]

Figure 1:
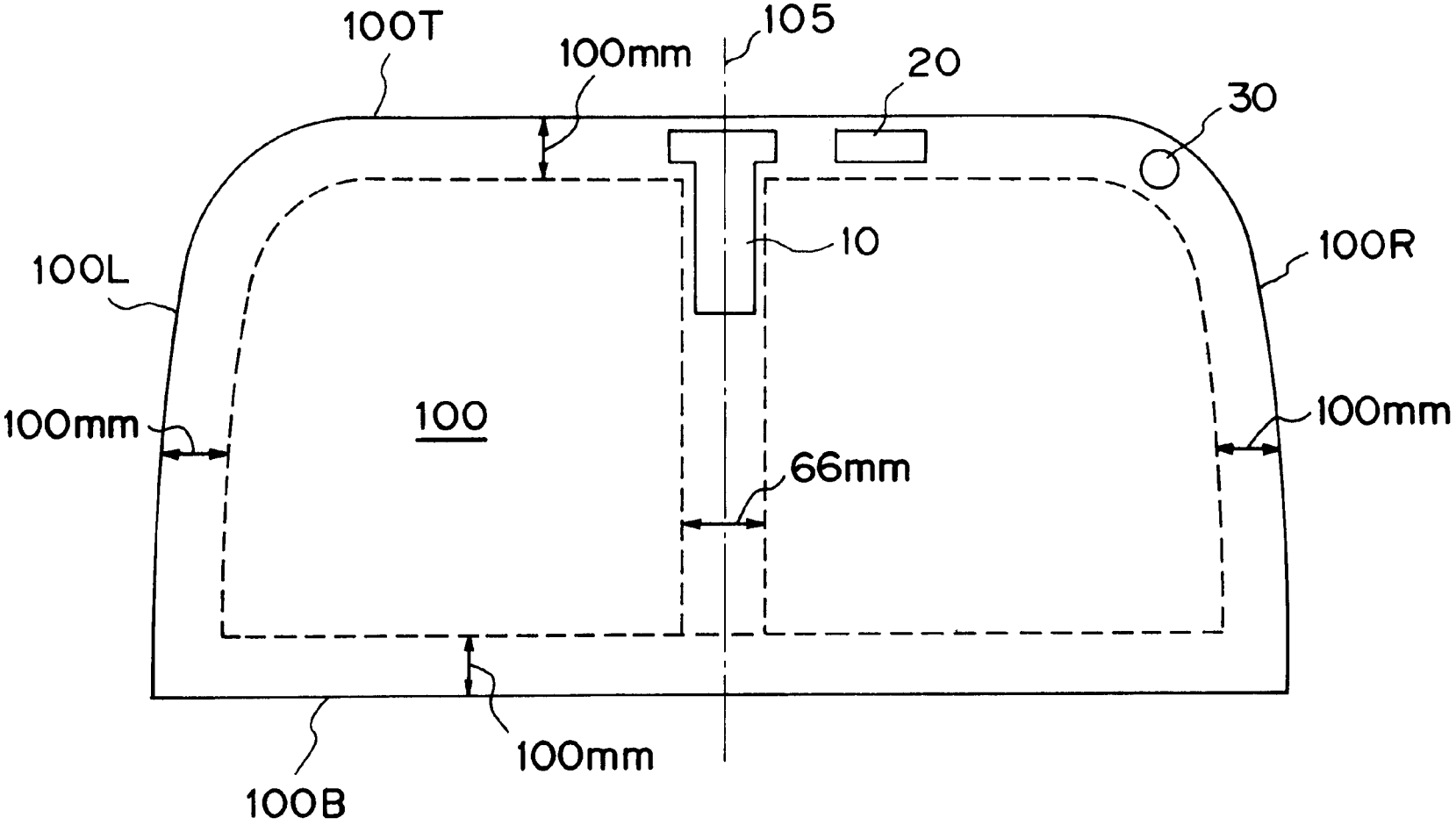
FIG. 1 is a schematic diagram of a vehicular front window glass to which an antenna system according to a first embodiment of the present invention is applied.

FIG. 1 shows a front glass window 100 to which a glass antenna system according to a first embodiment is applied, as a front overview of a vehicle body. In this figure, the right side of the front glass window 100 corresponds to the left side of the vehicle, and the left side of the front glass window 100, the right side of the vehicle.

Figure 4:
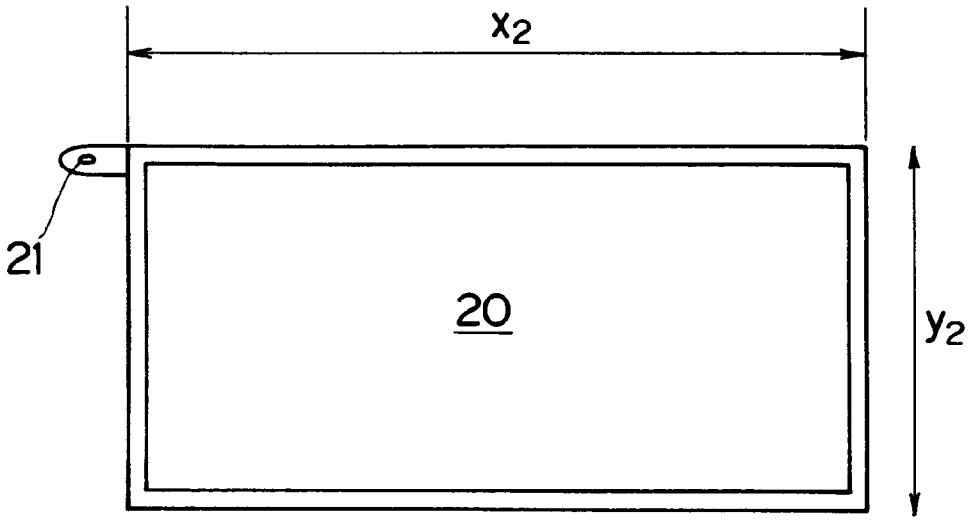
FIG. 4 is a schematic diagram showing a structure of an antenna 20 of the antenna system in FIG. 1.
Figure 5:
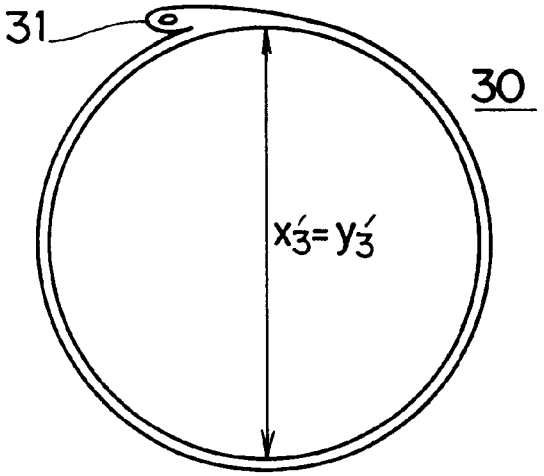
FIG. 5 is a schematic diagram showing a structure of an antenna 30 of the antenna system in FIG. 1.

The window glass 100 is provided with three antennas 10, 20 and 30, on the inner surface. The antenna 10 is mainly for receiving radio waves in the FM and TV broadcast bands. The antenna 10 is a T-shape loop antenna having a width (transversal length, i.e., length in a vehicular widthwise direction) $x_1$ (e.g. 10 cm), and a height (longitudinal length, i.e., length in a window height direction) $y_1$ (e.g. 20 cm) longer than the length $x_1$. The antenna 20 is a rectangular loop antenna long sideways, having a width (transversal length) $x_2$ longer than a height (longitudinal length) $y_2$, as shown in FIG. 4. The antenna 30 placed at the rightmost position on the window glass 100 is a circular loop antenna as shown in FIG. 5. The antennas 10, 20 and 30 constitute a diversity antenna system.

The transversal length x and the longitudinal length y of these antennas are in the following relation:

$$y \leq \frac{\lambda}{4} \cdot \alpha \quad (1)$$

$$60\ \text{cm} - y \geq x \quad (2)$$

λ: reception frequency wavelength

α: glass reduction ratio The meaning of expression (2) (i.e., the sum of the x and y does not exceeds 60 cm) will be described later. An appropriate reception sensitivity can be obtained by setting the size of the antennas in accordance with expressions (1) and (2).

Referring to FIG. 1, opaque objects may be set on the window glass 100 within a peripheral band area delimited by the alternate long and short dashed line and a central band area surrounded by the broken lines, without violating the regulations in Japan. Accordingly, the antenna can be placed or set in these areas with no problem.

Although window glass is basically transparent, the regulations are concerned with areas that are actually transparent. Specifically, on the vehicle body to which the front window glass 100 is attached, a ceramic coating layer and a mole surround the window glass 100. The ceramic coat member and the mole are opaque, and intercept or block driver's sight. Accordingly, the regulations are concerned only with peripheral areas where opaque obstacles are not provided. Positions where these opaque members end around the peripheral area on the window glass 100 will be called as "reference base" lines, for convenience. Thus, the window glass 100 has four peripheral areas which are transparent: the area which is lower than the reference base line 100T, the area which is upper than the reference base line 100B, the area which is at left side than the reference base line 100R, and the area which is right side than the reference base line 100L. These transparent peripheral areas on the glass window 100 do not obstruct the driver's sight. Accordingly, in FIG. 1, as these areas having a 10 cm width from the reference base lines 100T, 100B, 100R and 100L toward the center of the window glass 100 are not regulated against attachments, there is no legal control on width of the glass antennas within this band-shaped area.

Next, the shapes of the antennas 10, 20 and 30 will be more concretely described below. First, the shape of the antenna 10 will be described.

The T-shape antenna 10 is longer in length than in width. Upon placing this antenna on the front glass window 100, not to obstruct the driver's sight (driver's seat is at the left side position in the U.S.A and European countries while it is at the right side position in Japan), the antenna 10 is placed within a central band area, having a width symmetrically 66 mm from a center line 105 of the front window glass 100.

The antennas 20 and 30 are shorter than 10 cm in length, thus can be placed at an upper (or lower) position on the window glass 100 with no problem, and the width of the antennas 20 and 30 can be determined in accordance with a target frequency band and reception sensitivity regardless of the regulations. Note that if the length of the antennas 20 and 30 along the center line 105 exceeds 10 cm from the above reference base line 100T or 100B, the antennas 20 and 30 are placed within the central band area having the 66 mm width on the center line 105. That is, in this case, a part of the antennas 20 and 30 that exceeds 10 cm in length from the reference base line 100T or 100B is preferably set within 66 mm in width.

The antenna 20 (FIG. 4) is designed such that the height $y_2$ is within 100 mm so as not to obstruct the driver's sight, within a range satisfying the above expressions (1) and (2), e.g., $x_2$=15 cm and $y_2$=65 mm.

Similarly, the antenna 30 (FIG. 5) is designed such that a diameter $x_3$=$y_3$ is within 100 mm (e.g., 80 mm) so as to be placed within the 100 mm band area.

The antenna 10 (FIG. 3) is designed such that a length $L_y$ in the height $y_1$ is within 100 mm and a length $L_x$ in the width $x_1$ is within 66 mm (e.g., 66 mm).

Thus the antennas 10, 20 and 30 can be placed on the front window glass 100 without obstructing the driver's sight.

Note that the antenna 10 comprises of a combination of regular rectangular shapes, and the antenna 20, also a regular rectangular shape. The antenna 30 has a perfect round shape.

The antenna 10 is placed on approximately the center of the window glass 100. At this position, usually (e.g., in Japan) an automobile inspection sticker is stuck onto the window glass 100. The size of the automobile inspection sticker is normally 70 mm×70 mm. Assuming that the inner size of the upper rectangular part of the antenna loop is $x_1' \times L_y'$, the automobile inspection sticker can be placed within the loop of the antenna 10 by setting the size of the upper rectangular part so as to satisfy:

$$x_1' > 70 \text{ mm} \quad (3)$$

$$L_y' > 70 \text{ mm} \quad (4)$$

Drivers are obliged to change the automobile inspection sticker periodically. If expressions (3) and (4) are satisfied, a conductive wire of the antenna 10 is not at a position overlapped with the position of the automobile inspection sticker. This prevents inadvertent removal of the conductive wire when the automobile inspection sticker is changed by the user.

In Japan, a periodic service sticker is also stuck within the right half area of the window glass 100. The periodic service sticker has a round shape. As shown in FIG. 5, assuming that the inner size of the antenna loop is $x_3'=y_3'$, and the size of the sticker is S, the relation between the inner size and the seal size is as follows:

$$x_3'=y_3'>S$$

Then inadvertent removal of a conductive wire of the antenna 30 upon changing the periodic service sticker can be prevented.

Figure 2:
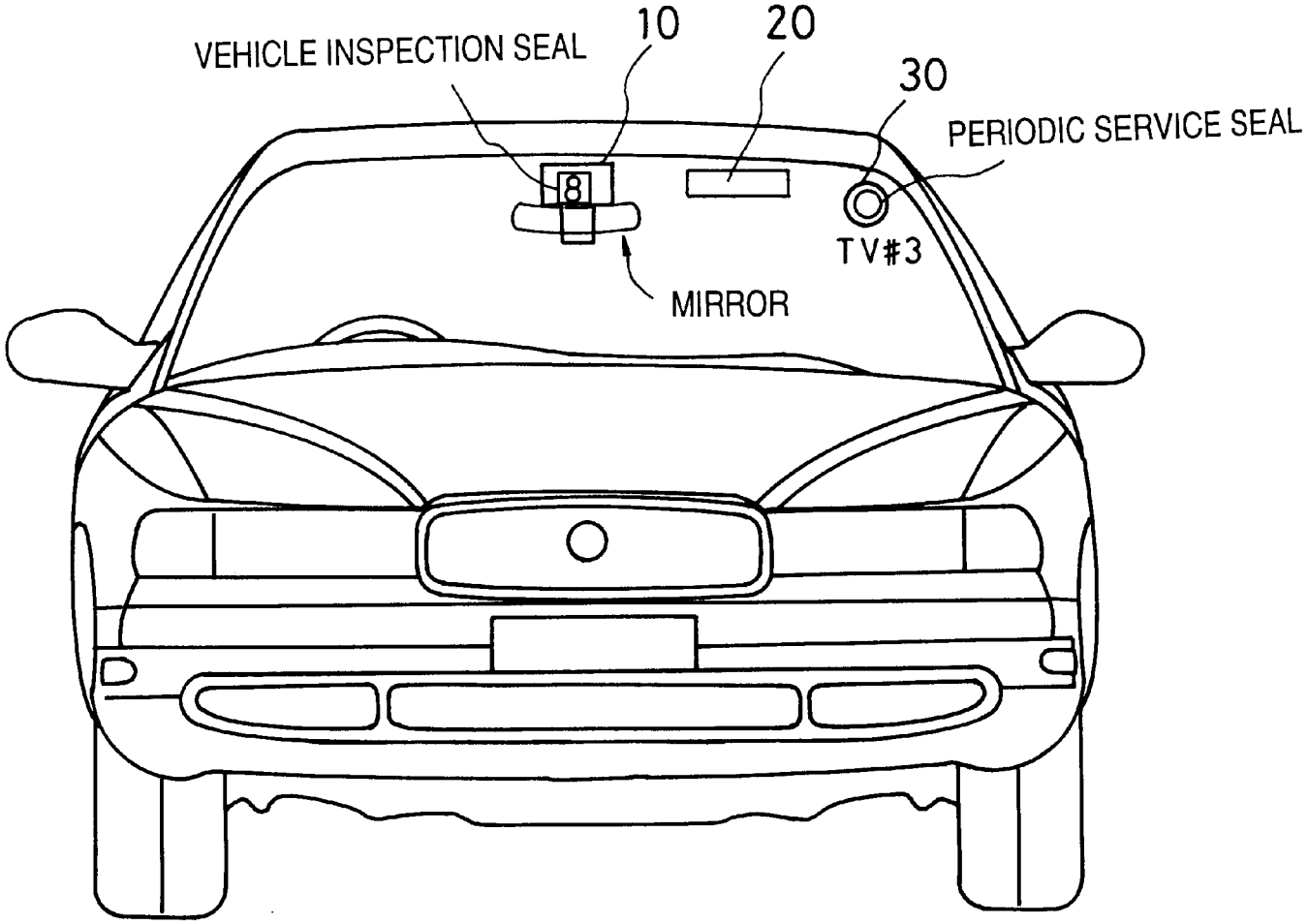
FIG. 2 is a front overview of a vehicle to which an antenna 10 of the antenna system in FIG. 1 is attached.

FIG. 2 shows antenna patterns set on the front window glass, on which the automobile inspection sticker and the periodic service sticker are stuck.

<Attachment of Antenna>

The glass antennas of the first embodiment are to be provided on the front window glass, therefore, it is desirable that the antennas can be easily attached there. For this purpose, the antennas 10, 20 and 30 should have adhesive material on the backs, and they should be removed from protective sheets and stuck onto the window glass.

Figure 3:
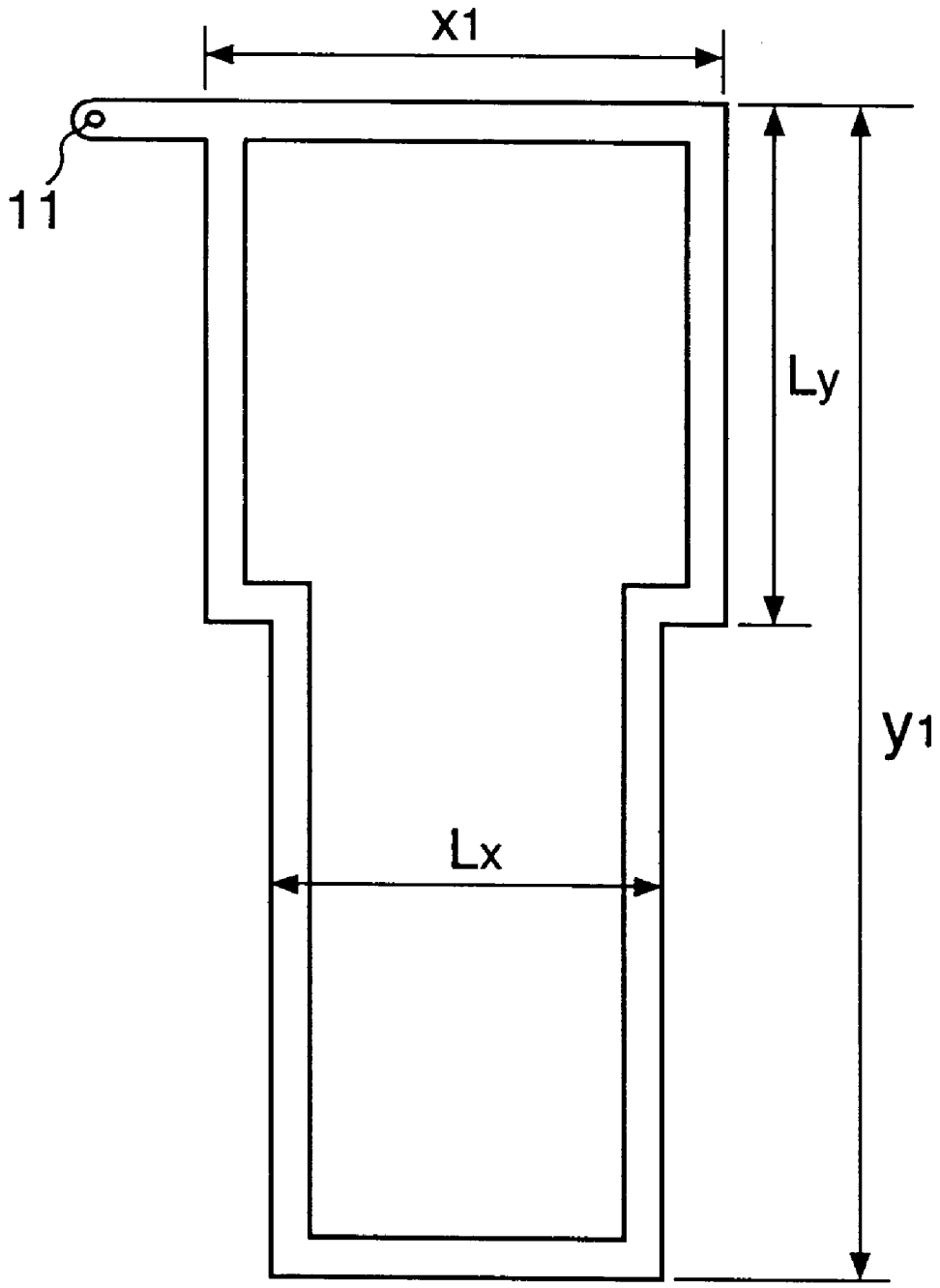
FIG. 3 is a schematic diagram showing a structure of the antenna 10 of the antenna system in FIG. 1.

The attachment of the three antennas in FIGS. 3 to 5 can be made by various methods. If the antenna shapes and the attachment positions are fixed, a thin-plate type conductive wire is attached to the window glass at a window glass factory by a well-known method. In this case, the conductive wire for feeding electric current can be arranged at the best position not to obstruct the driver's sight. Further, a ground wire can be connected to the vehicle body with the minimum ground resistance.

Generally, whether or not the antenna is placed on the front window glass depends on the driver's preference. The first embodiment employs a method which enables a driver to easily attach the conductive wire onto the front window glass shipped from the factory. For this purpose, it is desirable to provide a sheet, on which an adhesive layer is applied, on the conductive wire.

Figure 6:
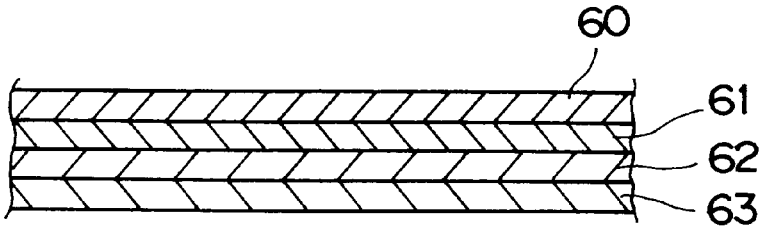
FIG. 6 is a cross-sectional view showing a structure of an antenna product before the antennas in FIG. 1 are attached.

FIG. 6 shows a cross-sectional view of the antenna of this type. That is, as shown in FIG. 6, the antennas 10, 20 and 30 have a protective film 60, an adhesive layer 62 and a paper base layer 63. The adhesive layer 62 is formed on the paper base layer 63. A bonding-agent layer is formed between the adhesive layer 62 and the conductive wire layer 61, and the bonding-agent layer combines the adhesive layer 62 and the conductive wire layer 61. The protective film 60 is formed on the conductive wire layer 61. The protective film 60 is formed only on the surface of the conductive wire, thus prevents oxidation of the conductive wire and protects the conductive wire from damages. When the user pulls the paper base layer 63, the paper base layer 63 is separated from the adhesive layer 62, then the adhesive layer 62 is exposed. The user can attach the antenna having the exposed adhesive layer 62 at a desired position on the window glass. The antenna is preferably attached onto the inner surface of the window glass in consideration of durability.

<Setting method>

Figure 7:
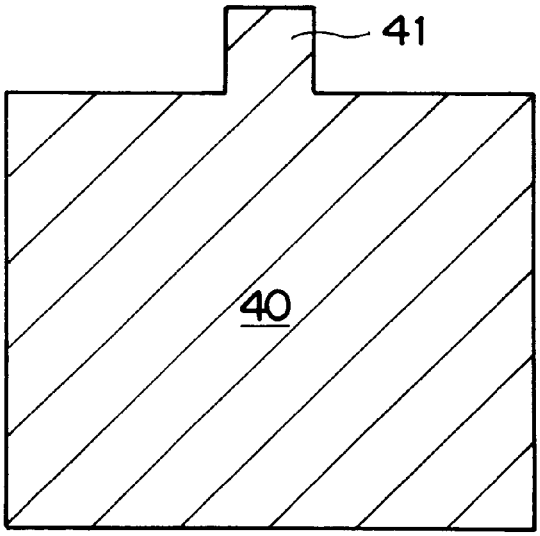
FIG. 7 is a schematic diagram showing an ground plate for the antennas in FIG. 1.
Figure 8:
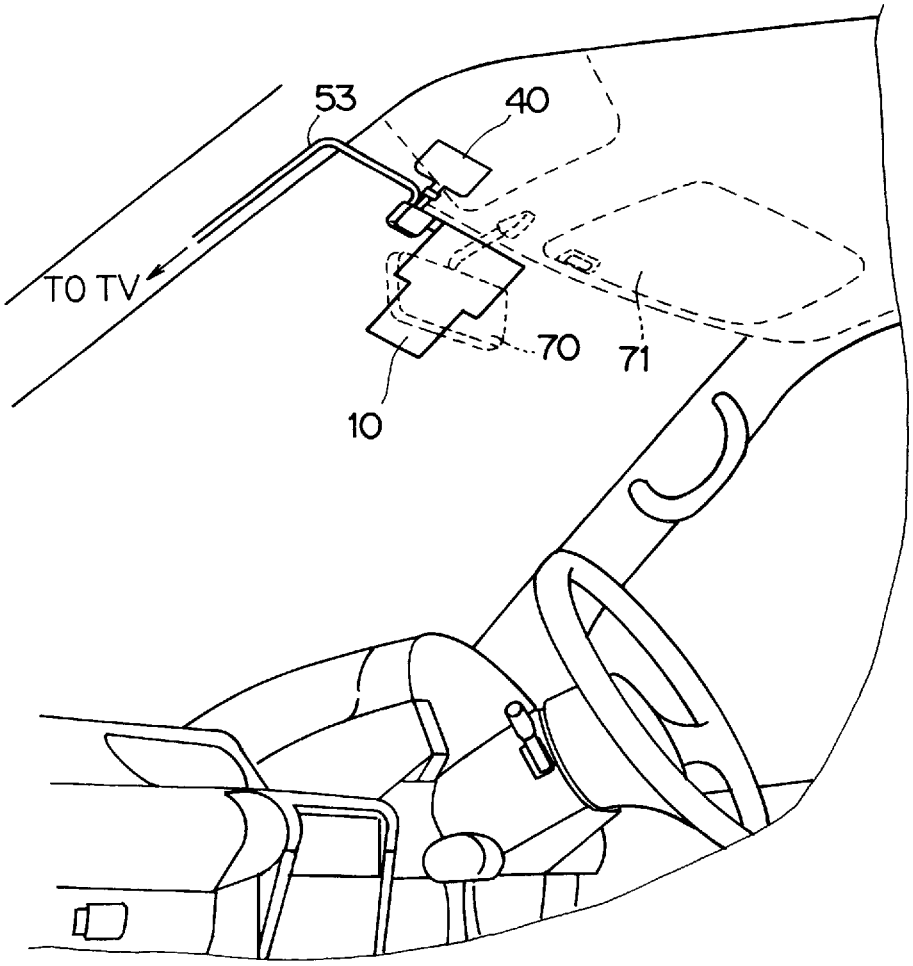
FIG. 8 is a perspective view from the inside of the vehicle showing the antenna system in FIG. 1 attached to the front window glass.

The glass antennas of the first embodiment all require a ground. The problem upon attachment of the antenna by the ordinary user is how to attach the ground, since a steel plate constituting a vehicle body is normally protected with electrically nonconductive coating. The first embodiment proposes to utilize a small gap between a steel plate of the roof panel and a roof trim and insert a ground plate 40 as shown in FIG. 7 into the gap. The ground plate 40 is inserted between the roof steel plate and the roof trim, as shown in FIG. 8. The ground plate 40 is connected to the antenna 10 via an adapter 50.

Figure 9:
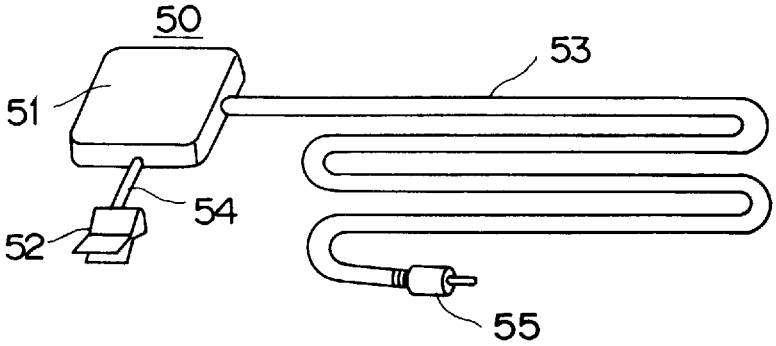
FIG. 9 is a perspective view showing a construction of an adapter for connecting the antenna to the ground plate.

FIG. 9 shows a construction of the adapter 50. The adapter 50 comprises a case 51, a low-impedance wire 54, a conductive clip 52 provided at the end of the wire 54, a shield wire 53 and a coaxial connector 55. Connecting pieces 11, 21 and 31 of the antennas 10, 20 and 30, respectively are connected to the adapter 50. A core of the connector 55 is connected to a tuner of the antenna or the like. The shield of the shield wire 53, the wire 54 and the clip 52 are electrically connected (dc-connected). The clip 52 is connected to a tongue 41 of the ground plate 40.

Figure 10:
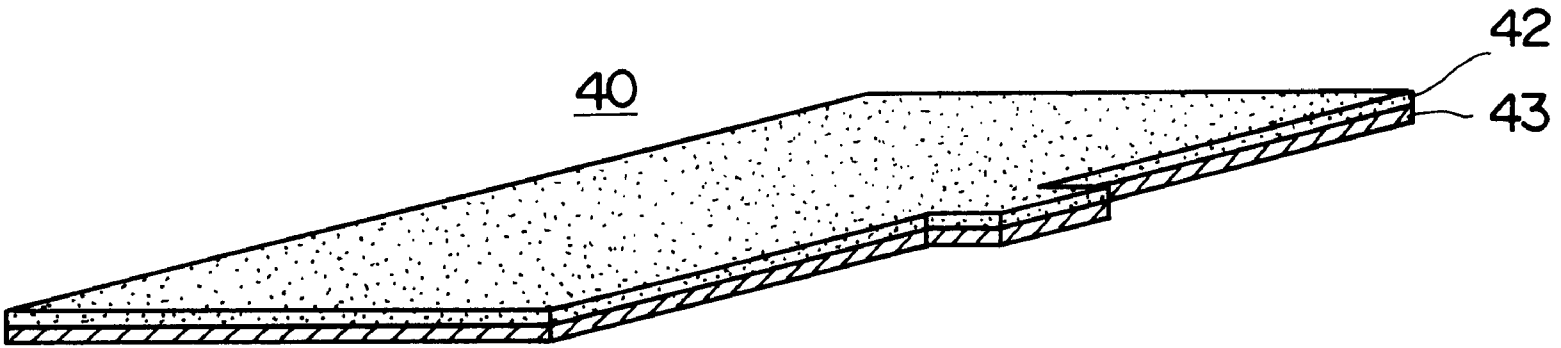
FIG. 10 is a perspective view showing a structure of the ground plate.
Figure 11:
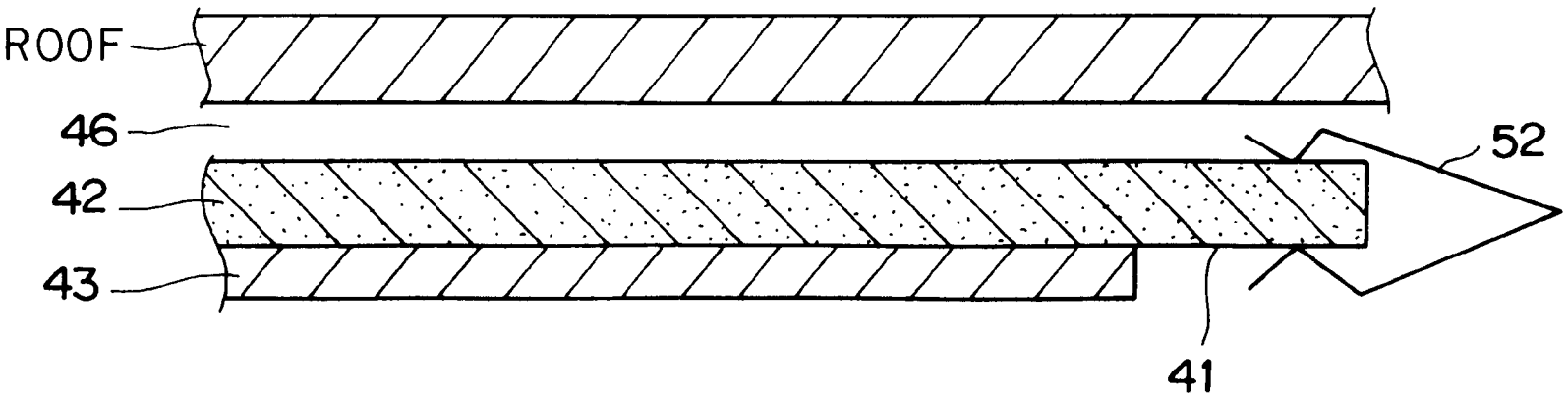
FIGS. 11 and 12 are partial cross-sectional views showing capacity coupling of the ground plate with the vehicle body.
Figure 12:
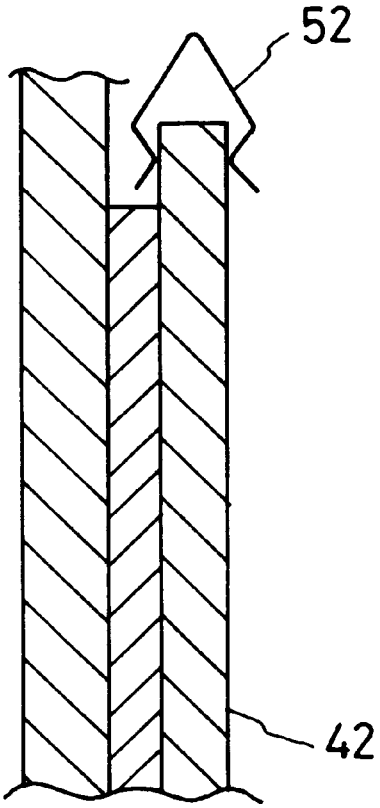

FIG. 10 shows a structure of the ground plate 40. The ground plate 40 comprises a magnet layer 43 and a conductive metal layer 42. As the ground plate 40 is inserted between the roof trim and the roof panel as shown in FIG. 8 and the clip 52 is connected to the tongue 41, the ground plate 40 comes into contact with the metal roof panel in the relation as shown in FIG. 11. There is a gap 46 (air layer or coating layer) between the metal layer 42 of the ground panel 40 and the metal roof, the ground plate 40 and the vehicle body are capacitively coupled. The present embodiment sets the area of the ground plate 40 such that the capacitance due to capacity coupling is 10 pF to obtain a practical sensitivity of the antenna in the FM radio wave band. Further, as shown in FIG. 12, the ground plate 40 can be directly attached to the roof via a magnet.

Figure 13:
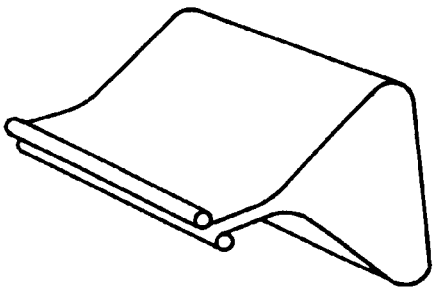
FIG. 13 is a perspective view showing another example of a metal part for grounding.

Note that the insertion of the ground plate into a gap between the roof panel and the roof trim is impossible in some types of vehicles. In such case, a ground wire of the adapter can be directly connected to the vehicle body, which is advantageous in cost. FIG. 13 shows a clip for the direct connection. By using the clip in FIG. 13, the ground wire can be coupled with a flange of the vehicle body, thus obtaining a capacitance, 10 pF.

<Relation between width x and height y>

FIGS. 14, 16, 18, 20, 22, 24, 26 and 28 are graphs respectively showing reception sensitivities with respect to a reception radio wave in the FM radio and UHF TV broadcast bands when the height y of the antenna 10 is set to a fixed value while the width x is changed. FIGS. 15, 17, 19, 21, 23, 25, 27 and 29 are tables showing average reception sensitivities obtained from the above graphs.

Figures 14, 15:
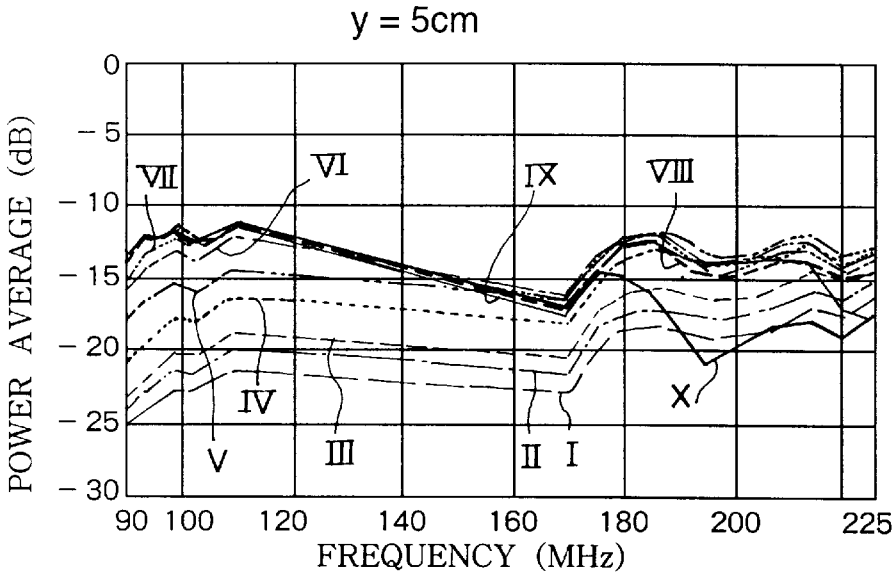
FIG. 14 is a graph showing reception sensitivities with respect to various x (width) values when y (height) is 5 cm.
FIG. 15 is a table showing average reception sensitivities obtained within an evaluation frequency range when y is 5 cm.

FIG. 14, for example, shows reception sensitivity by a curve I when the height y is 5 cm and the width x is 0.5 cm; reception sensitivity by a curve II when the width x is 2 cm;

reception sensitivity by a curve III when the width x is 5 cm; reception sensitivity by a curve IV when the width x is 10 cm; reception sensitivity by a curve V when the width x is 15 cm; reception sensitivity by a curve VI when the width x is 25 cm; reception sensitivity by a curve VII when the width x is 30 cm; reception sensitivity by a curve VIII when the width x is 40 cm; reception sensitivity by a curve IX when the width x is 50 cm; and reception sensitivity by a curve X when the width x is 60 cm. FIG. 15 shows average reception sensitivities obtained by averaging the test reception sensitivities of the antenna 10 in FIG. 14 within an evaluation frequency range.

Figures 16, 17:
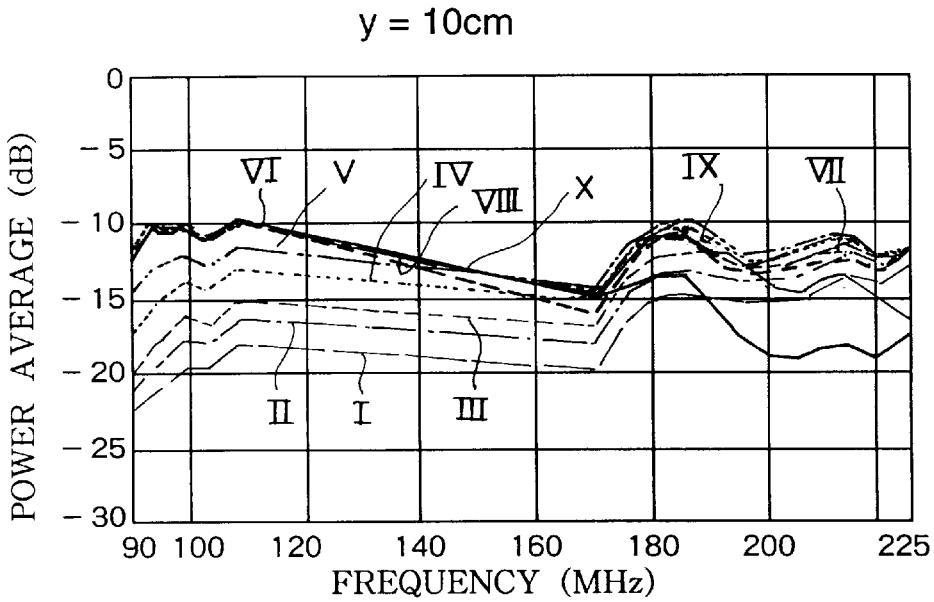
FIG. 16 is a graph showing reception sensitivities with respect to various x values when y is 10 cm.
FIG. 17 is a table showing average reception sensitivities obtained within an evaluation frequency range when y is 10 cm.
Figures 18, 19:
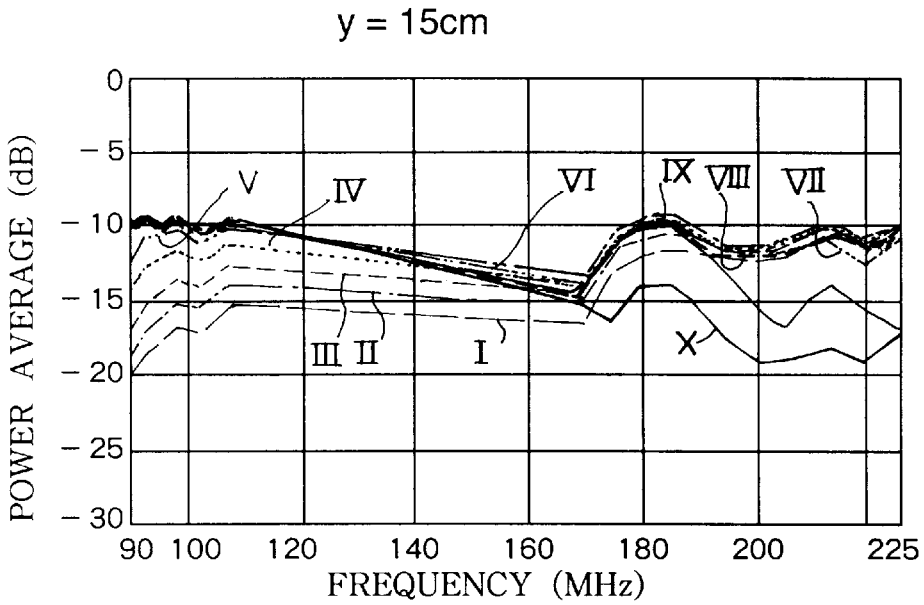
FIG. 18 is a graph showing reception sensitivities with respect to various x values when y is 15 cm.
FIG. 19 is a table showing average reception sensitivities obtained within an evaluation frequency range when y is 15 cm.
Figures 20, 21:
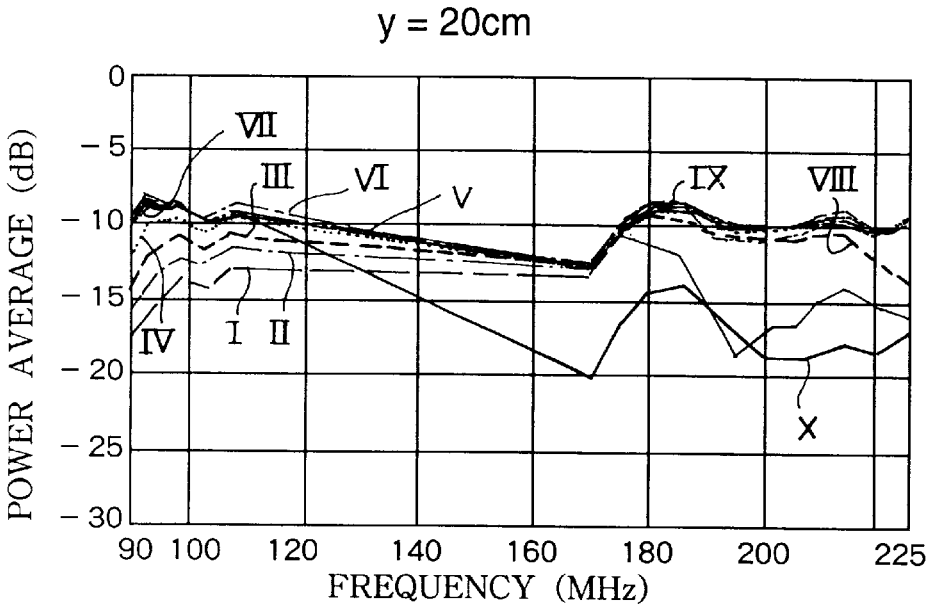
FIG. 20 is a graph showing reception sensitivities with respect to various x values when y is 20 cm.
FIG. 21 is a table showing average reception sensitivities obtained within an evaluation frequency range when y is 20 cm.
Figure 22:
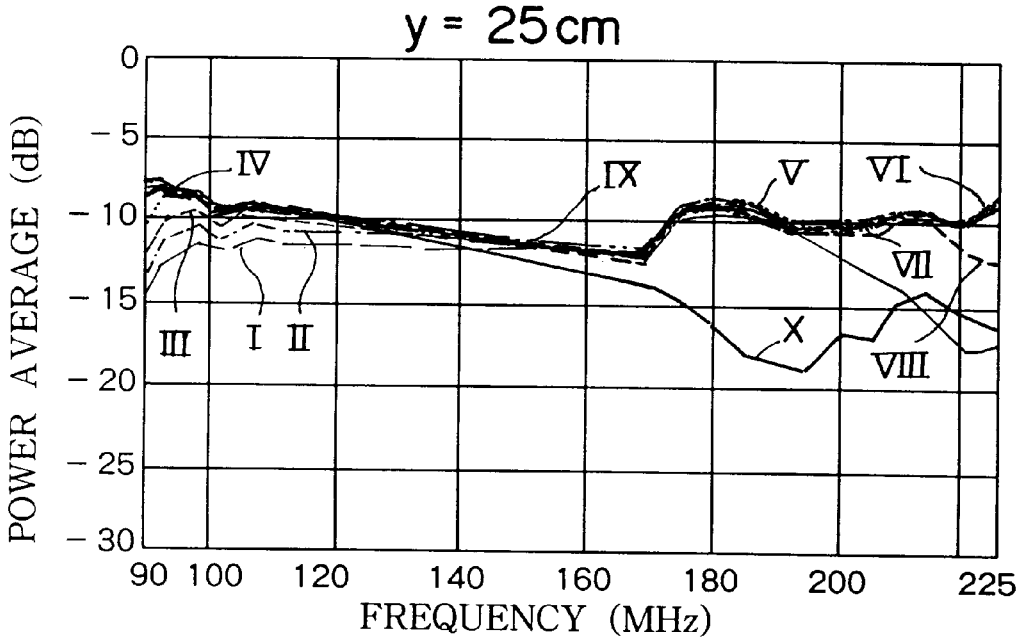
FIG. 22 is a graph showing reception sensitivities with respect to various x values when y is 25 cm.
Figures 23, 24:
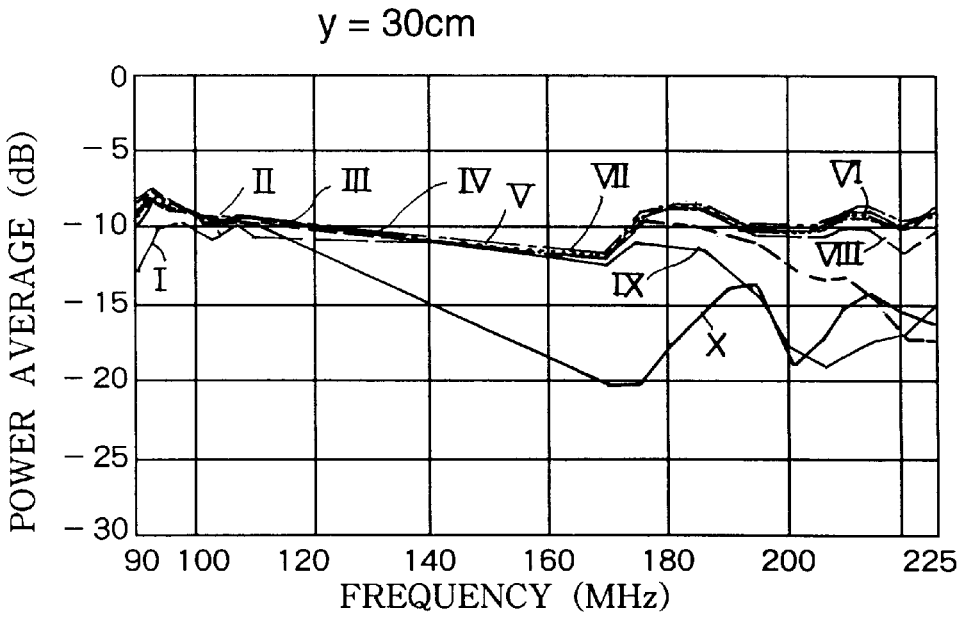
FIG. 23 is a table showing average reception sensitivities obtained within an evaluation frequency range when y is 25 cm.
FIG. 24 is a graph showing reception sensitivities with respect to various x values when y is 30 cm.
Figures 25, 26:
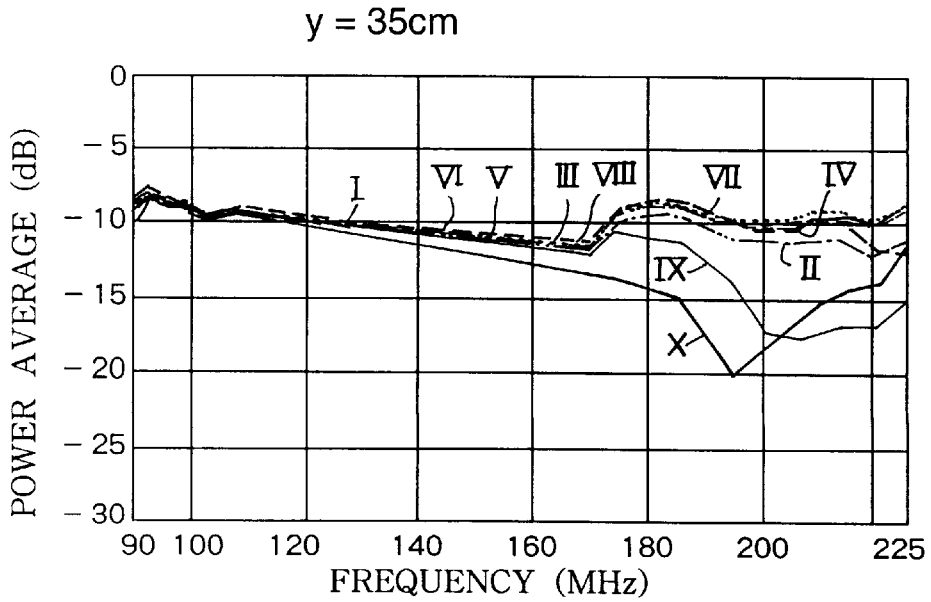
FIG. 25 is a table showing average reception sensitivities obtained within an evaluation frequency range when y is 30 cm.
FIG. 26 is a graph showing reception sensitivities with respect to various x values when y is 35 cm.
Figures 27, 28:
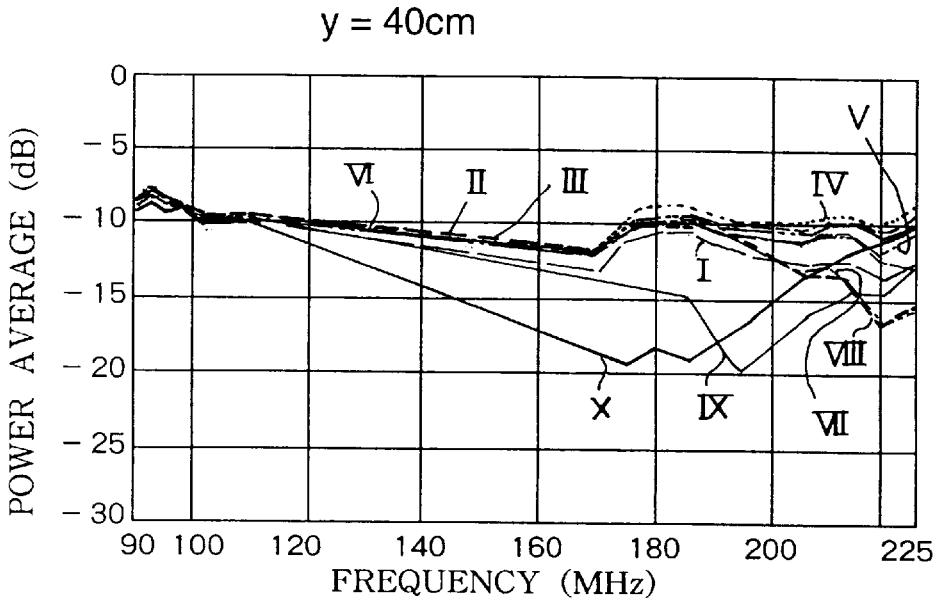
FIG. 27 is a table showing average reception sensitivities obtained within an evaluation frequency range when y is 35 cm.
FIG. 28 is a graph showing reception sensitivities with respect to various x values when y is 40 cm.

The table of average reception sensitivities of FIG. 17 corresponds to the graph of FIG. 16 (y=10 cm); the table of average reception sensitivities of FIG. 19, the graph of FIG. 18 (y=15 cm); the table of average reception sensitivities of FIG. 21, the graph of FIG. 20 (y=20 cm); the table of average reception sensitivities of FIG. 23, the graph of FIG. 22 (y=25 cm); the table of average reception sensitivities of FIG. 25, the graph of FIG. 24 (y=30 cm); the table of average reception sensitivities of FIG. 27, the graph of FIG. 26 (y=35 cm); and the table of average reception sensitivities of FIG. 29, the graph of FIG. 28 (y=40 cm).

These figures indicate that the antenna 10 (and 20 and 30) can obtain practical sensitivities when the height y is within about 40 cm:

$$y \leq \frac{\lambda}{4} \cdot \alpha \quad (\lambda\text{: reception radio wavelength})$$

Further, FIGS. 14 to 29 show a tendency that when x≈y holds, an obtained reception sensitivity is low, on the other hand, when x>y or x<y holds, a relatively high reception sensitivity can be obtained. That is, when the longitudinal length (height) y stands within a range $(0 \ldots \lambda/4)\cdot\alpha$, and it is relatively shorter than the transversal length (width)x (y<x), an excellent reception sensitivity can be obtained in a high frequency area. Further, the high reception sensitivity characteristic can be obtained with respect to the width x in a wide range. On the other hand, when the height y stands within a range $(0 \ldots \lambda/4)\cdot\alpha$, and it is relatively longer than the width x (y>x), an excellent reception sensitivity can be obtained in a low frequency area. Also, the high reception sensitivity characteristic can be obtained with respect to the width x in a wide range.

Further, an ideal reception sensitivity can be obtained mainly in the TV UHF band if the height y and the width x are set within the following ranges:

$$8\text{ cm} \leqq y \leqq 40\text{ cm}$$

$$x \leqq 30\text{ cm}$$

The band where the excellent reception sensitivity can be ensured changes as the width x changes. It is apparent that if the sum of the height y and the width x exceeds 60 cm, the reception sensitivity is degraded.

Note that in consideration of the legal regulations as shown in FIG. 1, it is more preferable to set the x and y values within the following ranges:

$$7\text{ cm} \leqq x \leqq 30\text{ cm}$$

$$7\text{ cm} \leqq y \leqq 10\text{ cm}$$

Figure 51:
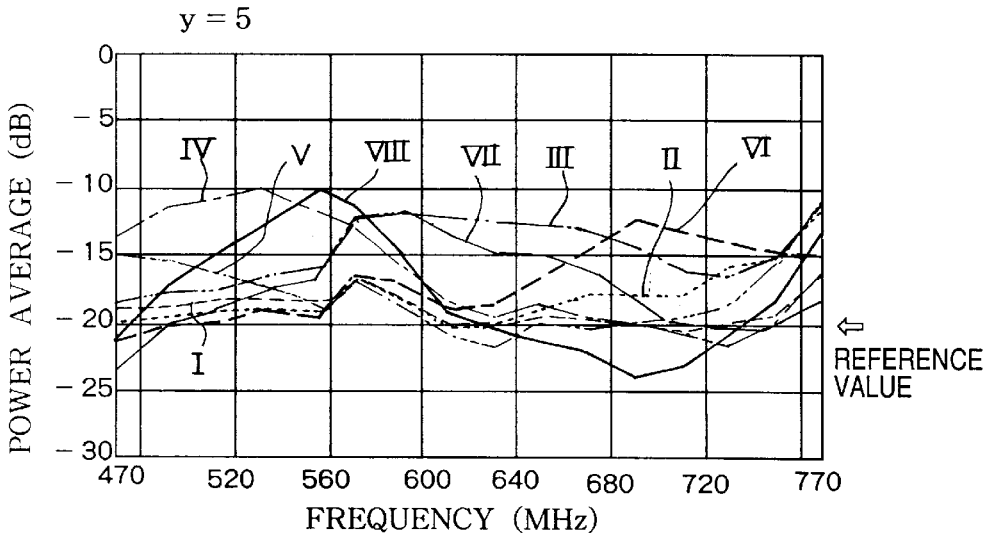
FIG. 51 is a graph showing UHF reception characteristics in the antenna system in FIG. 1 with respect to various x values when y is 3 cm.
Figures 52, 53:
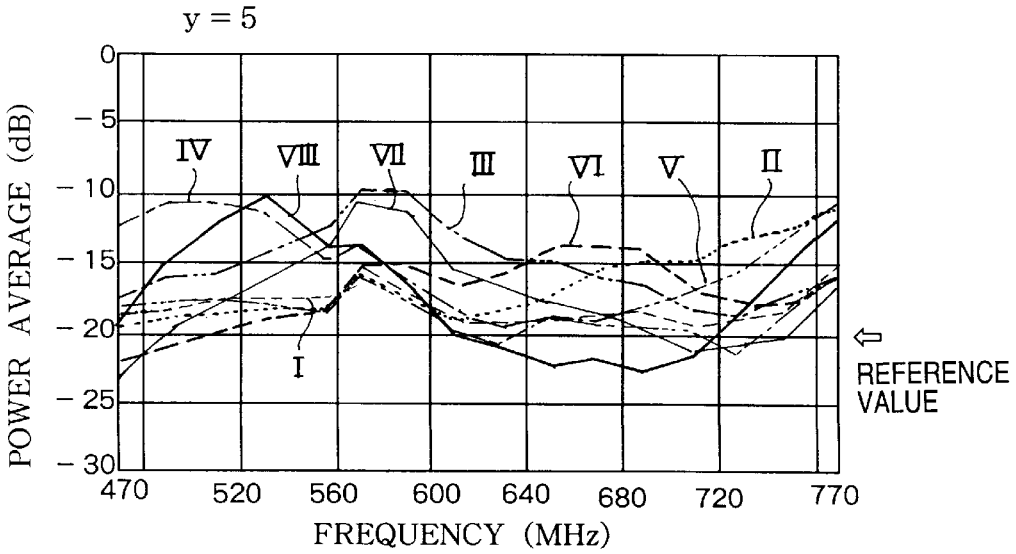
FIG. 52 is a table showing average UHF reception characteristics (average reception sensitivities in an evaluation frequency range) in the antenna system in FIG. 1 when y is 3 cm.
FIG. 53 is a graph showing UHF reception characteristics in the antenna system in FIG. 1 with respect to various x values when y is 5 cm.
Figures 54, 55:
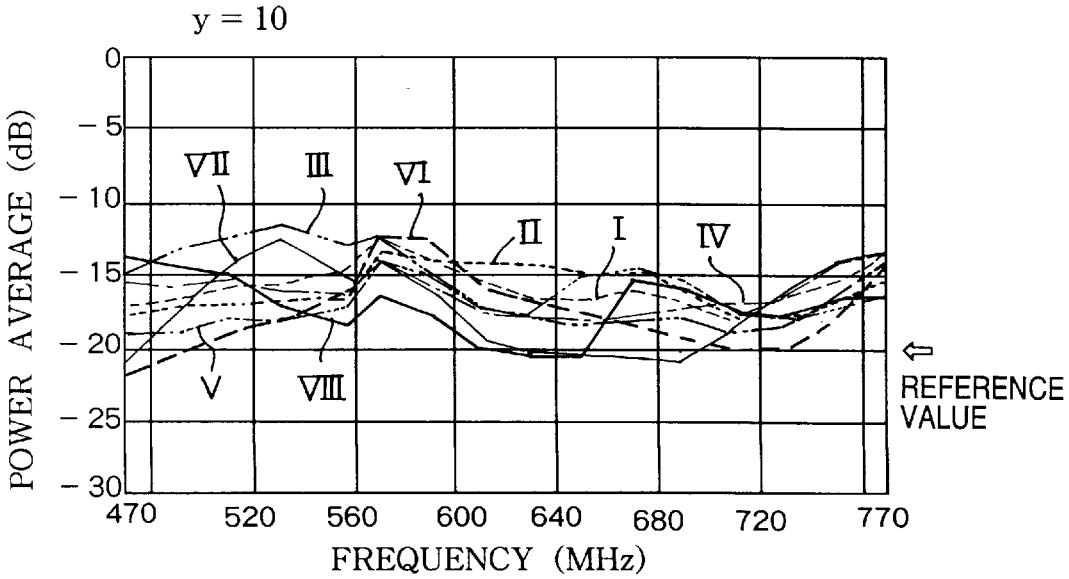
FIG. 54 is a table showing average UHF reception characteristics (average reception sensitivities in an evaluation frequency range) in the antenna system in FIG. 1 when y=5 cm holds.
FIG. 55 is a graph showing UHF reception characteristics in the antenna system in FIG. 1 with respect to various x values when y is 10 cm.

FIGS. 51, 53 and 55 are graphs showing reception sensitivities with respect to a reception radio wave in the UHF band when the height y is set to a fixed value while the width x is changed.

FIGS. 52, 54 and 56 are tables showing average reception sensitivities obtained from the above graphs.

FIGS. 51 to 56 indicate that where the reception radio wave is in the UHF band, if the antenna width is within 40 cm, −20 dB reception can be obtained. FIGS. 51 and 52 show the results of a test where the height y is set to 3 cm while the antenna width x is changed to 5 cm by curve I, to 10 cm by curve II, to 15 cm by curve III, to 20 cm by curve IV, to 25 cm by curve V, to 30 cm by curve VI, to 35 cm by curve VII, and to 40 cm by curve VIII.

FIGS. 53 and 54 show a case where y=5 cm holds, and FIGS. 55 and 56, a case where y=10 cm holds.

In the aforementioned expression (1), if the glass reduction ratio α is 0.6, to receive a UHF band radio wave, the height y is preferably within 10 cm (with respect to a radio wave of 450 MHz or higher). This height is convenient to place the antenna on the front window glass within an area which does not obstruct the driver's sight, i.e., within 10 cm from the end of the front window glass (reference base lines). Accordingly, as an antenna appropriate to the UHF band, the x and y values are preferably set within the following ranges:

$$5\text{ cm} \leqq x \leqq 40\text{ cm}$$

$$y \leqq 10\text{ cm}$$

Further, the lower bound of the y value to ensure a reception sensitivity is:

$$3\text{ cm} \leqq y \leqq 10\text{ cm}$$

Figure 30:
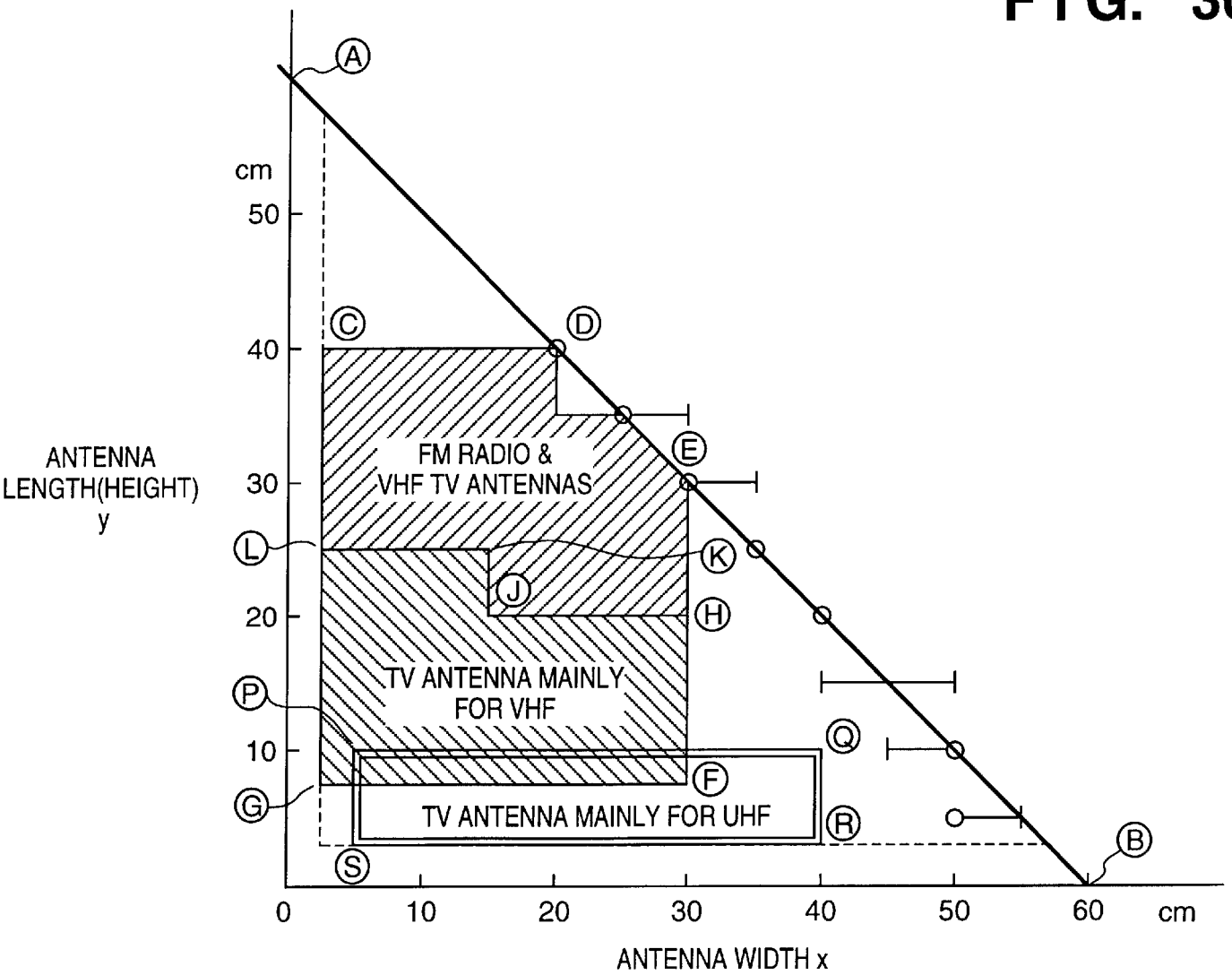
FIG. 30 is a graph showing the relation between the width x and the height y of the antenna system according to the first embodiment.
Figure 31:
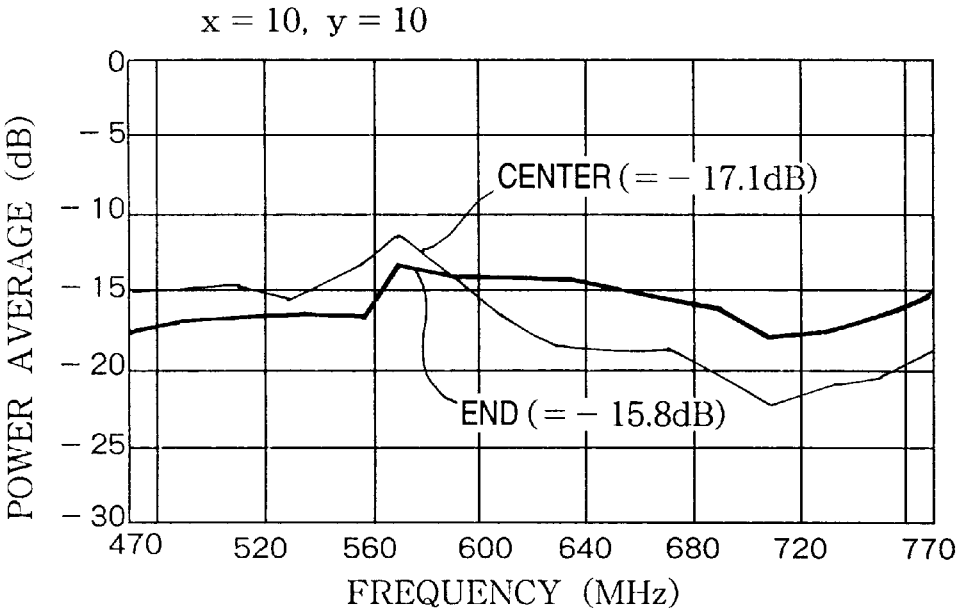
FIG. 31 is a graph showing reception sensitivities with respect to different feeding point positions when x is 10 cm and y is 10 cm.
Figure 32:
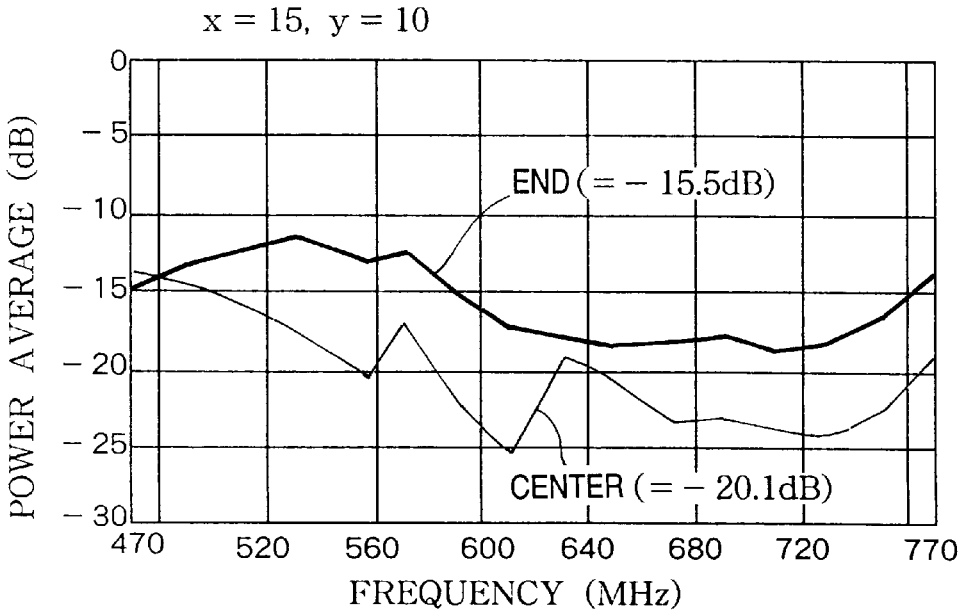
FIG. 32 is a graph showing reception sensitivities with respect to different feeding point positions when x is 15 cm and y is 10 cm.
Figure 33:
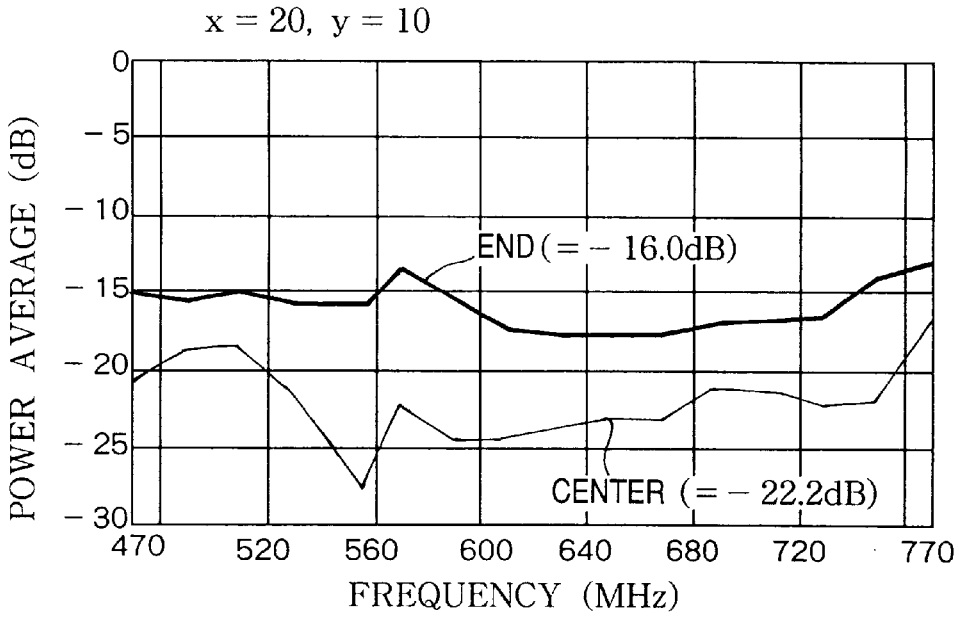
FIG. 33 is a graph showing reception sensitivities with respect to different feeding point positions when x is 20 cm and y is 10 cm.
Figure 34:
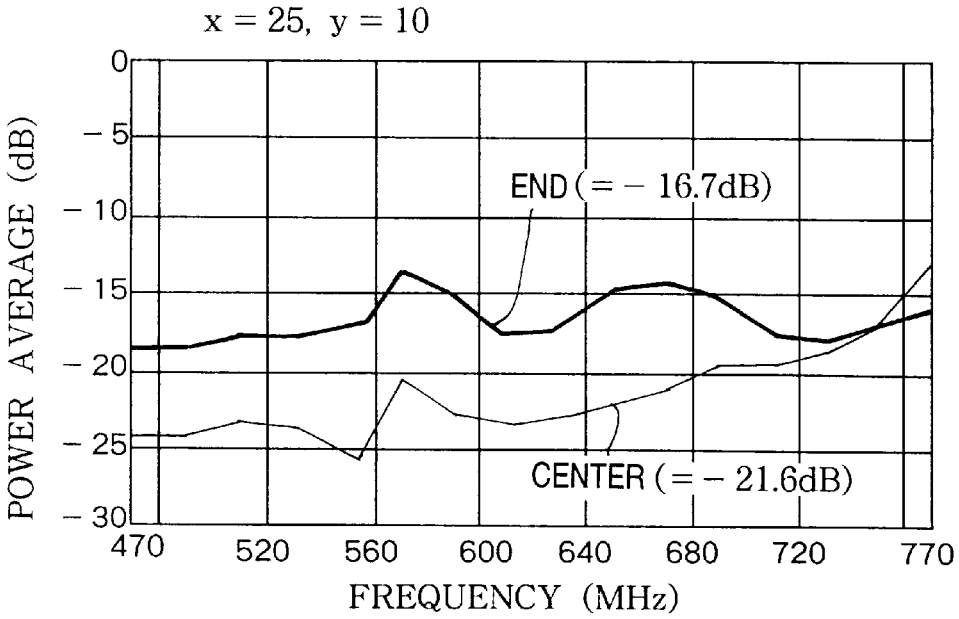
FIG. 34 is a graph showing reception sensitivities with respect to different feeding point positions when x is 25 cm and y is 10 cm.
Figure 35:
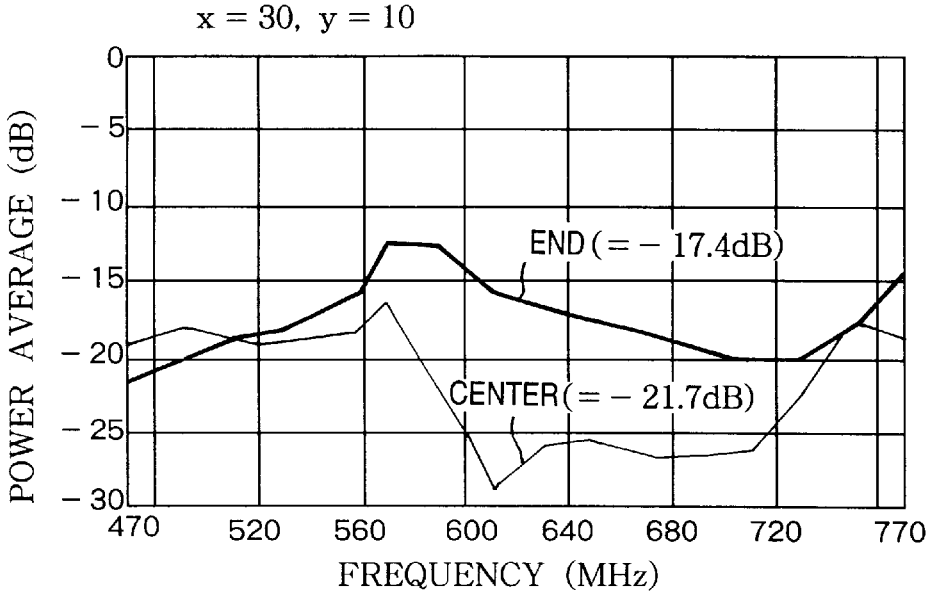
FIG. 35 is a graph showing reception sensitivities with respect to different feeding point positions when x is 30 cm and y is 10 cm.
Figure 36:
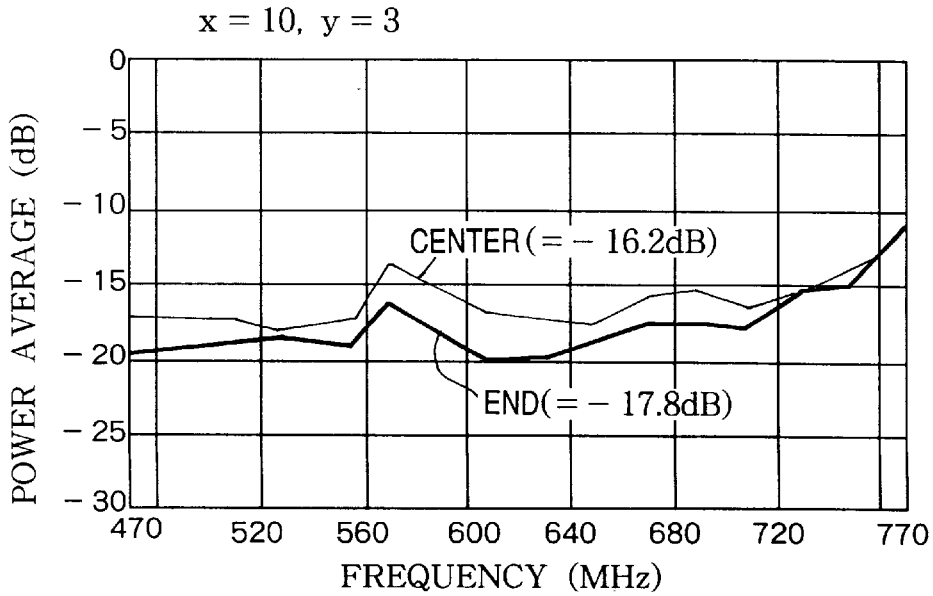
FIG. 36 is a graph showing reception sensitivities with respect to different feeding point positions when x is 10 cm and y is 3 cm.
Figure 37:
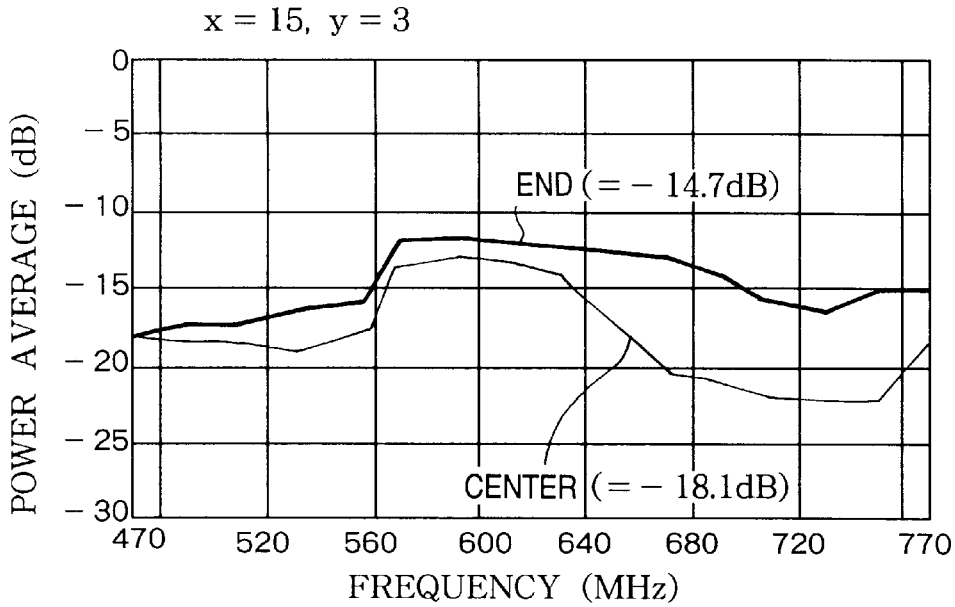
FIG. 37 is a graph showing reception sensitivities with respect to different feeding point positions when x is 15 cm and y is 3 cm.
Figure 38:
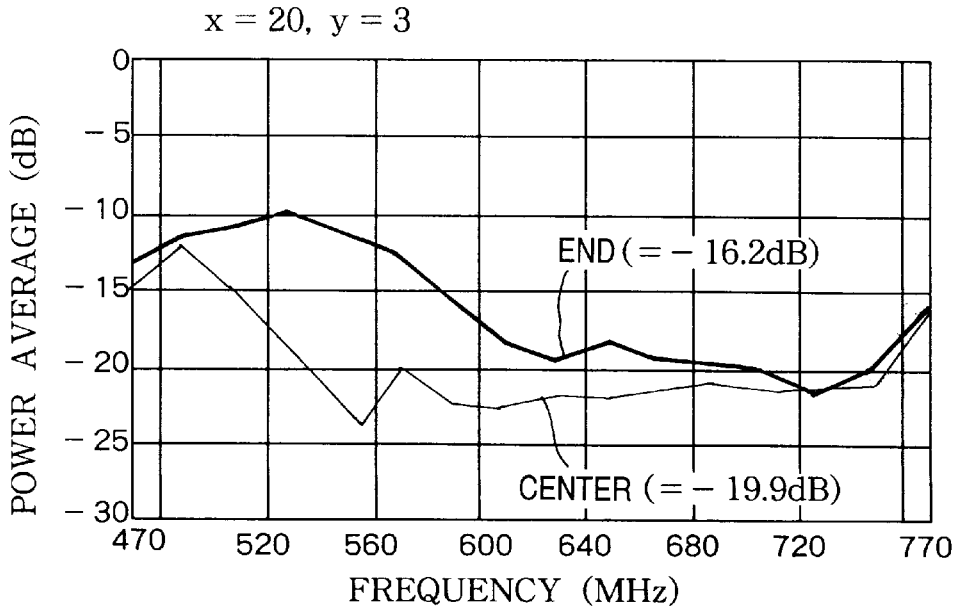
FIG. 38 is a graph showing reception sensitivities with respect to different feeding point positions when x is 20 cm and y is 3 cm.
Figure 39:
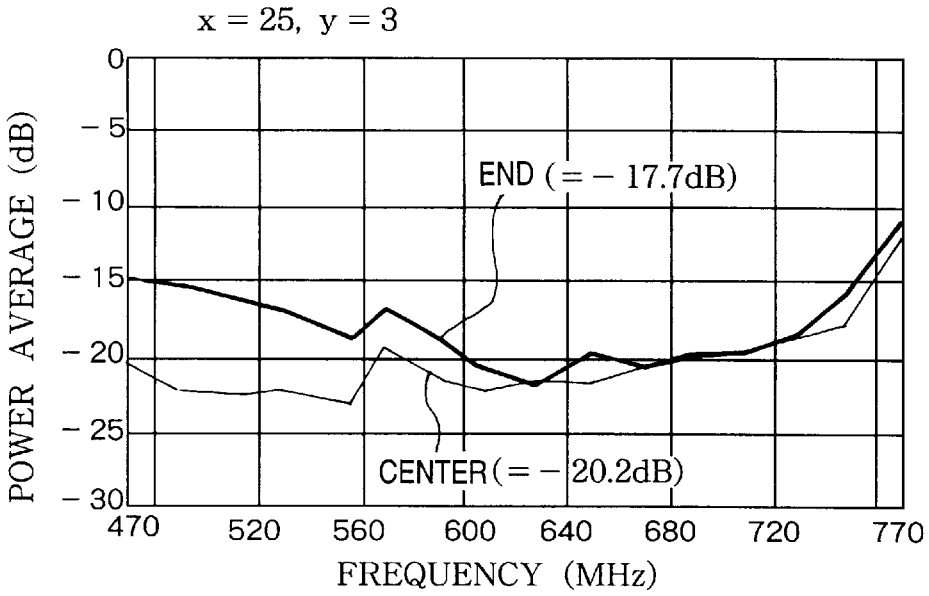
FIG. 39 is a graph showing reception sensitivities with respect to different feeding point positions when x is 25 cm and y is 3 cm.
Figure 40:
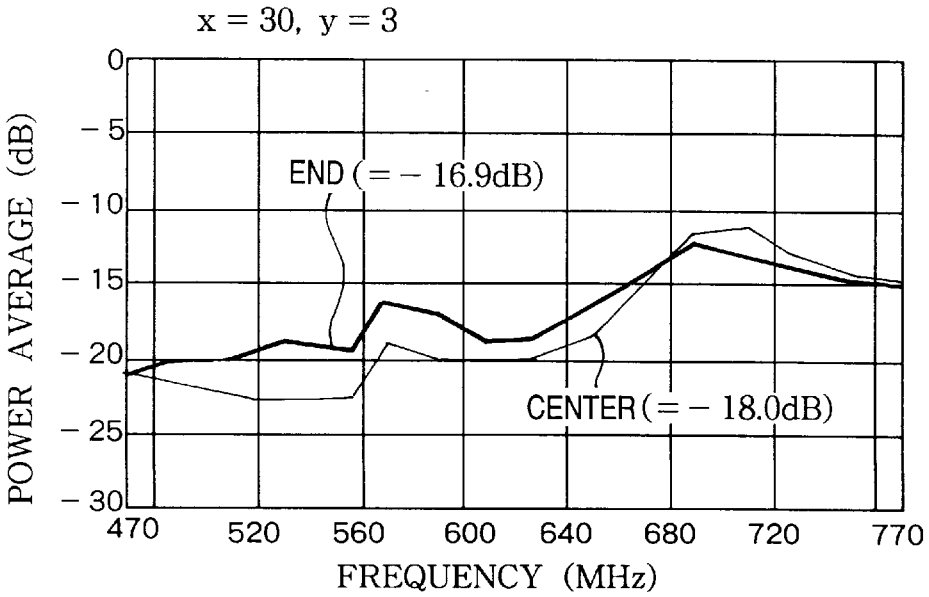
FIG. 40 is a graph showing reception sensitivities with respect to different feeding point positions when x is 30 cm and y is 3 cm.
Figure 41:
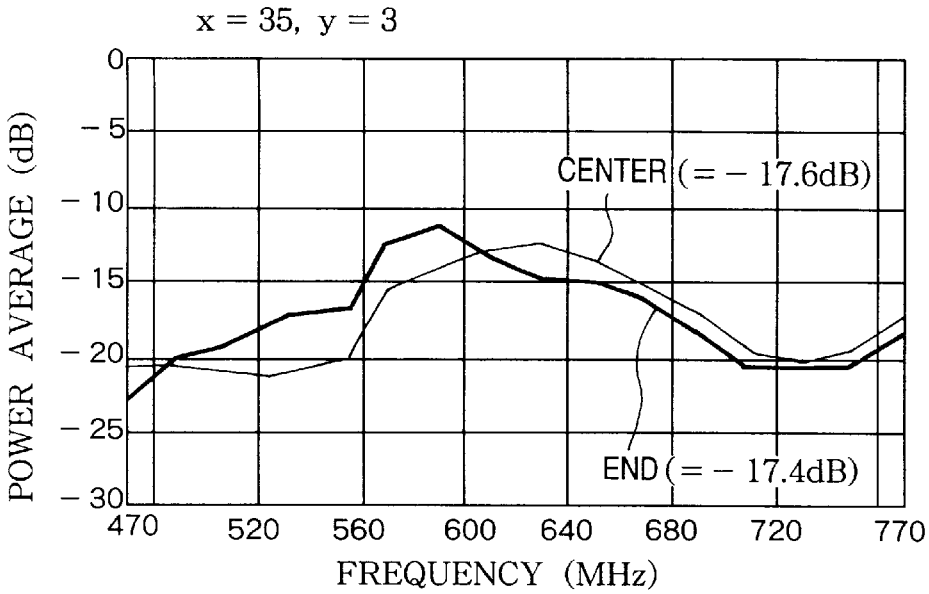
FIG. 41 is a graph showing reception sensitivities with respect to different feeding point positions when x is 35 cm and y is 3 cm.
Figure 42:
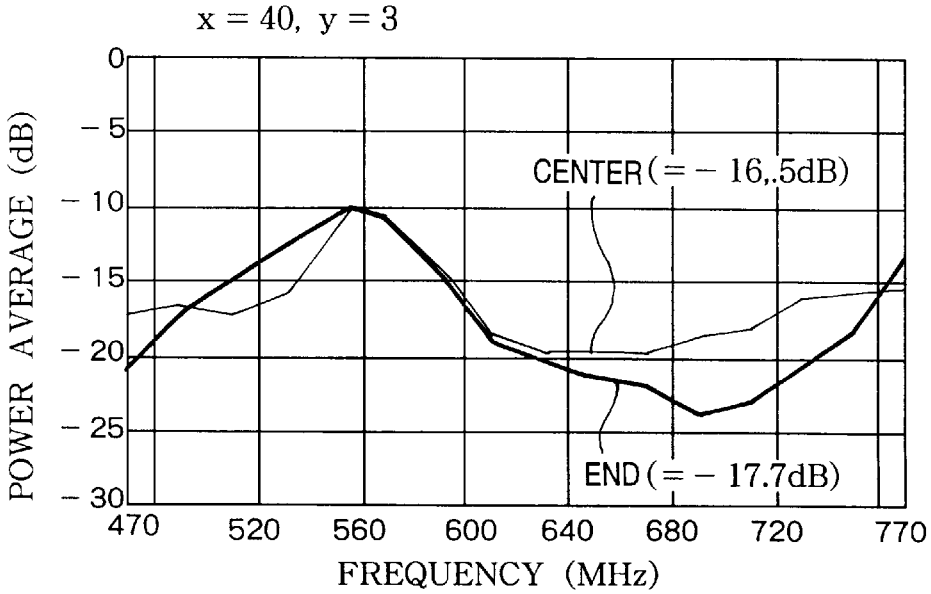
FIG. 42 is a graph showing reception sensitivities with respect to different feeding point positions when x is 40 cm and y is 3 cm.
Figure 43:
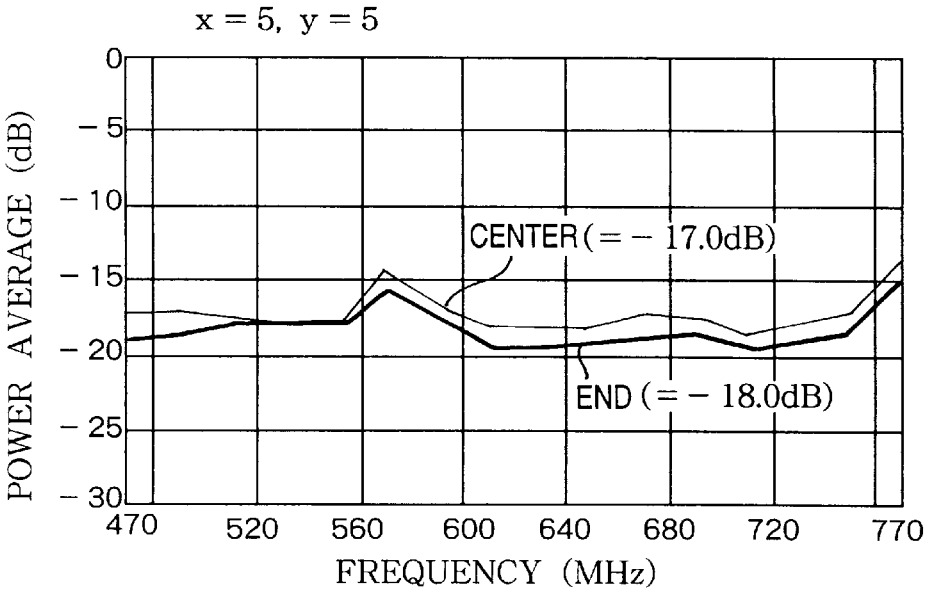
FIG. 43 is a graph showing reception sensitivities with respect to different feeding point positions when x is 5 cm and y is 5 cm.
Figure 44:
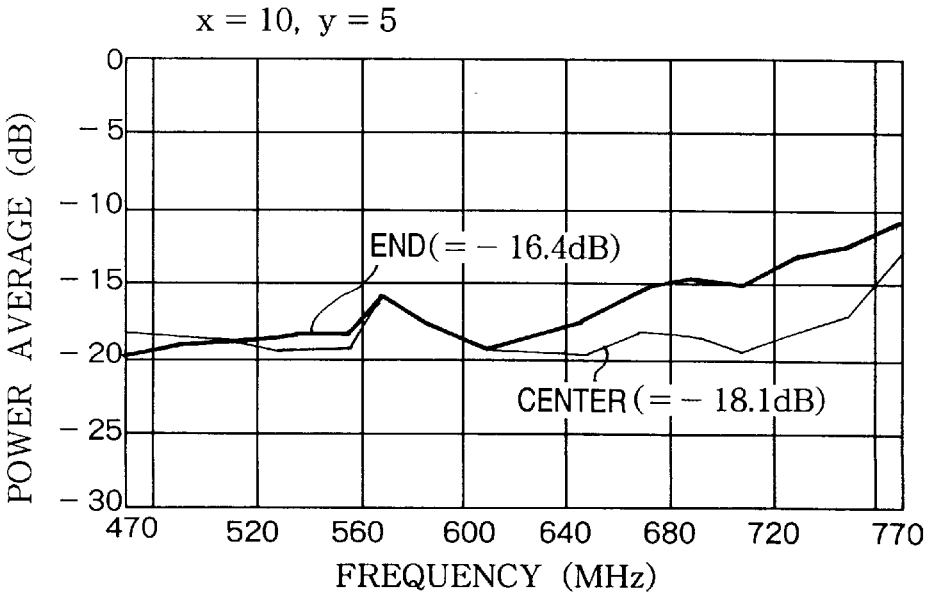
FIG. 44 is a graph showing reception sensitivities with respect to different feeding point positions when x is 10 cm and y is 5 cm.
Figure 45:
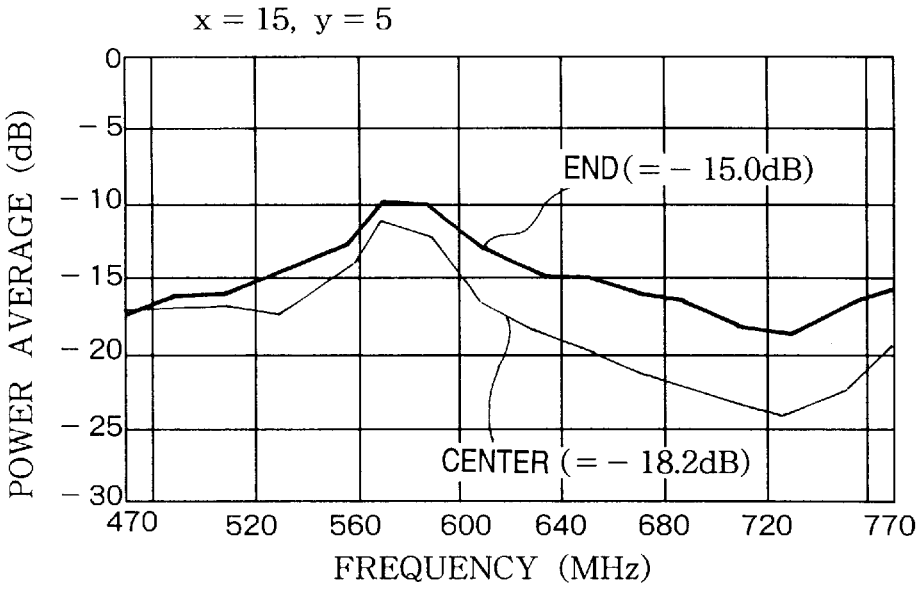
FIG. 45 is a graph showing reception sensitivities with respect to different feeding point positions when x is 15 cm and y is 5 cm.
Figure 46:
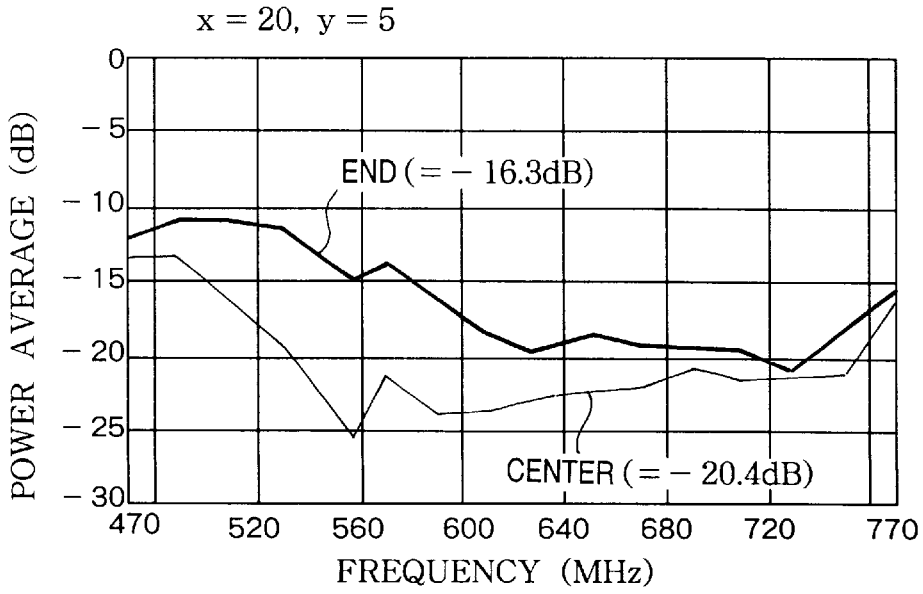
FIG. 46 is a graph showing reception sensitivities with respect to different feeding point positions when x is 20 cm and y is 5 cm.
Figure 47:
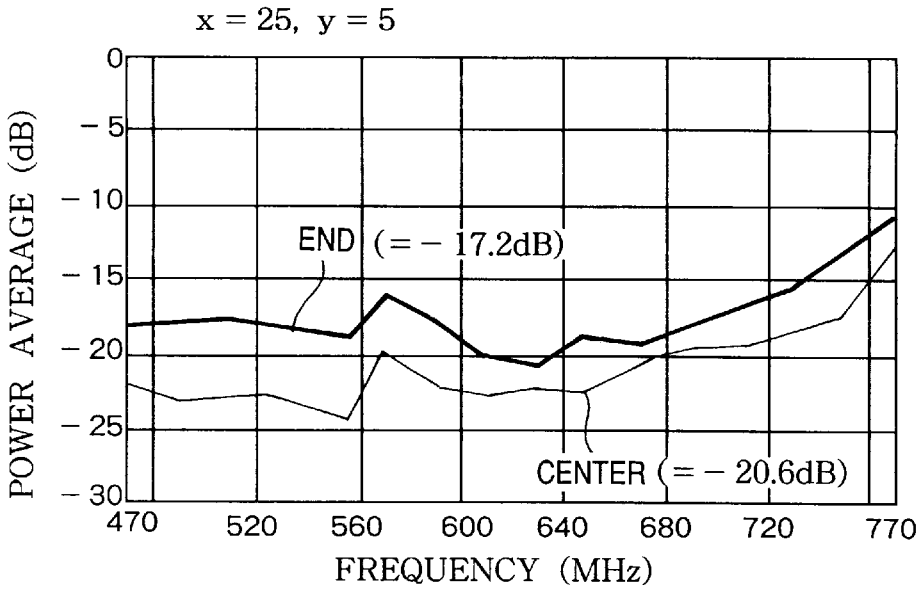
FIG. 47 is a graph showing reception sensitivities with respect to different feeding point positions when x is 25 cm and y is 5 cm.
Figure 48:
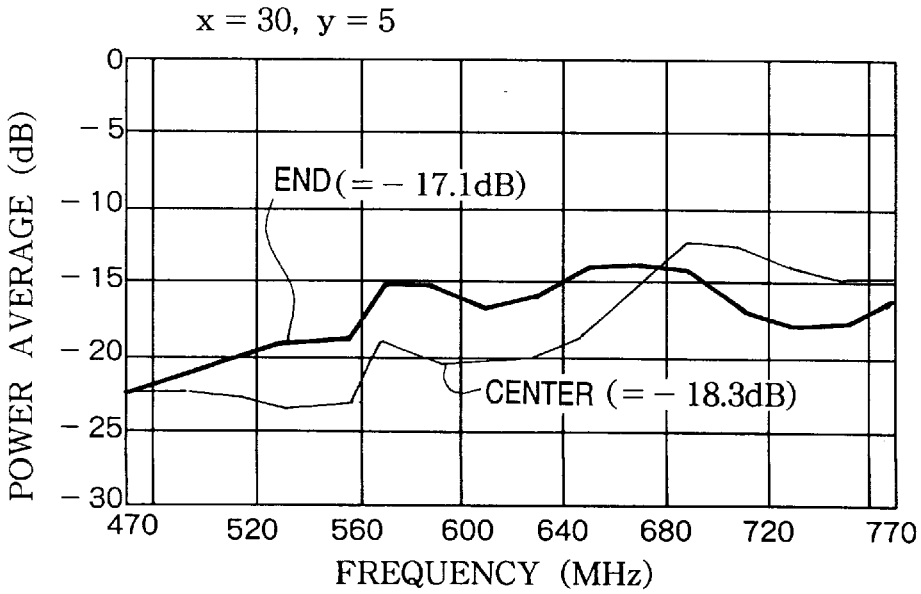
FIG. 48 is a graph showing reception sensitivities with respect to different feeding point positions when x is 30 cm and y is 5 cm.
Figure 49:
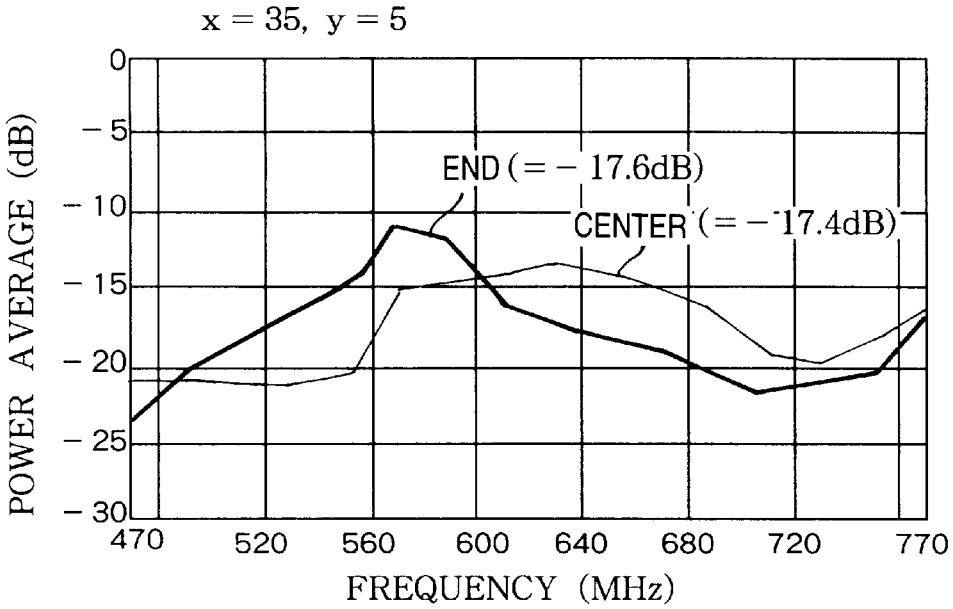
FIG. 49 is a graph showing reception sensitivities with respect to different feeding point positions when x is 35 cm and y is 5 cm.
Figure 50:
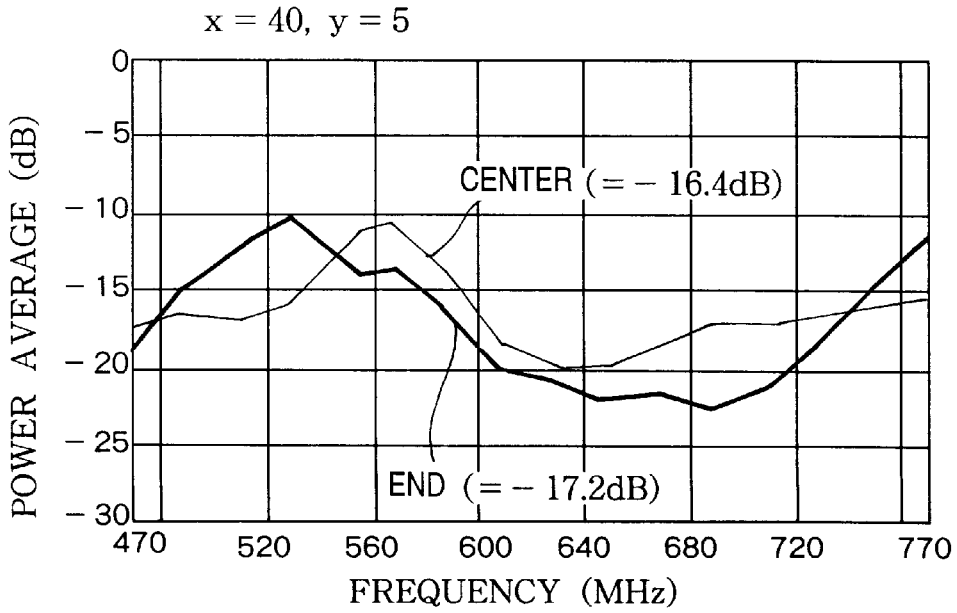
FIG. 50 is a graph showing reception sensitivities with respect to different feeding point positions when x is 40 cm and y is 5 cm.

FIG. 30 is a graph showing the relation between the x and y values, summarized from FIGS. 14 to 29 and FIGS. 51 to 56. In FIG. 30, a line AB denotes a simple equation $$x+y=60\text{ cm}$$

This indicates that the critical value of the sum of the width x and the height y is 60 cm. The area surrounded by line AB, an x axis and a y axis is expressed by:

$$x+y \leqq 60\text{ cm}$$

In a triangular area ABO of FIG. 30, the antenna system comprising of the antennas 10, 20 and 30 shows better performance than that of the conventional mono-pole antenna. In an area CDEHJKL, a practical high reception sensitivity can be obtained in the FM to VHF bands. In an area HFGLKJ, a practical high reception sensitivity can be obtained in the TV VHF band. In an area PQRS, a practical reception sensitivity can be obtained in the TV UHF band. Note that a line CG (x=2 cm) shows the minimum antenna width for obtaining a practical reception sensitivity. A line GF (y=8 cm) shows the minimum antenna height for obtaining a practical reception sensitivity as a TV antenna mainly in a VHF band.

<Influence of Feeding Point>

FIGS. 31 to 50 are graphs showing reception sensitivities with respect to different feeding point positions, i.e., a central position and an end position. In the graphs of FIGS. 31 to 50, the thick line represents a reception sensitivity when the feeding point is at the end position, and the thin line represents a reception sensitivity when the feeding point is at the central position. Values in the respective graphs indicate average sensitivities within an evaluation frequency range.

Note that feeding point in the present invention means a point of a portion which functions as an antenna that point is the closest to a receiver. In the frame-type antennas according to the first to third embodiments, a joint point connecting the loops and a conductive wire from the loop to a feeder operates as an antenna element, therefore, this joint is defined as feeding point in the embodiments.

The antenna system of the first embodiment attains the target −20 dB. Especially, the antenna where the x, y values are set so as to satisfy x>y, the reception sensitivity in the UHF band is improved.

<Setting Methods of Antenna>

Next, a designing method for placing the antenna of the first embodiment on a front window glass of a vehicle will be described. This designing method must satisfy the above-mentioned conditions to ensure the driver's sight and conditions to obtain reception sensitivity and a wide range of reception band.

First, the longitudinal length (height) y is substantially determined from $$\lambda/4\cdot\alpha$$

($\lambda$: reception frequency wavelength, $\alpha$: glass reduction ratio)

In the first embodiment, as the antennas 10, 20 and 30 are respectively set for receiving radio waves in different frequency bands. Assuming the $\alpha$=0.6 holds, the lengths y of the antennas 10, 20 and 30 are set, respectively, to 20 cm for a 225 MHz band; 8 cm for 562.5 MHz band; and 6.5 cm for a 692.3 MHz band (FIGS. 3 to 5).

Next, a transversal length (width) x is determined.

As described above, the width x influences the range of the reception frequency band where a reception sensitivity can be ensured. There is a tendency that as the width increases, the band widens, however, as the band becomes too wide, the reception sensitivity is degraded. The width x must be set within 60 cm as the sum of the height y and the width x (x+y=60 cm).

TV radio waves are in the wide frequency band (VHF 90 MHz to UHF 770 MHz), only one antenna cannot cover the frequency band. For this reason, the widths of the antennas 10, 20 and 30 are respectively set such that the antenna 10 covers mainly the TV VHF band ranging from 90 to 230 MHz; the antenna 20, a band ranging from 500 to 770 MHz; and the antenna 30, mainly the TV UHF band ranging from 470 to 600 MHz. The widths x of the antennas 10, 20 and 30 as shown in FIGS. 3 to 5 are respectively 10 cm, 15 cm and 8 cm. The frequency bands covered by the antennas 20 and 30 overlap with each other. Thus an effective diversity system can be constituted with these antennas.

The antenna 10 placed at the central portion of the front window glass has a T shape as shown in FIG. 3, since the width x in the lower rectangular part must be within 6.6 cm so as to ensure the driver's sight. The antenna 30 has a size to cover a periodic service sticker, i.e., 8 cm×8 cm. The reception band of the antenna 30 is determined by the maximum values of the longitudinal and transversal lengths. As the reception band does not depend on the antenna shape, the antenna 30 has a circular shape. The antenna 30 is placed on a position to cover the periodic service sticker.

The antenna 20 is placed between the antenna 10 and the antenna 30. To ensure the driver's sight, it is desirable to provide the antenna 20 within the peripheral 10 cm band area, avoiding further inside area from the peripheral 10 cm band area. The antenna 10 having a long height y for receiving relatively low frequency (VHF) radio waves is placed at the central portion of the front window glass, and the antennas 20 and 30 having a short heights y for receiving high frequency radio waves are placed except the central portion.

[Modification to First Embodiment]

Figure 57:
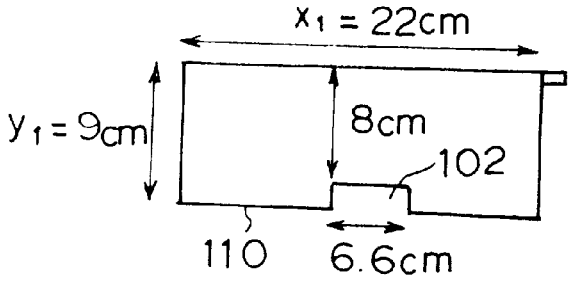
FIG. 57 is a schematic diagram showing the shape of the antenna as a first modification of the first embodiment.

The antenna 10 of the first embodiment, placed on the front window glass, has a T shape as shown in FIG. 3, for the purpose of reception in the VHF band. As a first modification to the first embodiment, an antenna 110 for the purpose of reception in the same frequency band has a U-shape, and is long sideways, as shown in FIG. 57. The measurements of the antenna 110 are as follows:

$x_1$=22 cm $y_1$=9 cm $L_y$=8 cm

Figure 58:
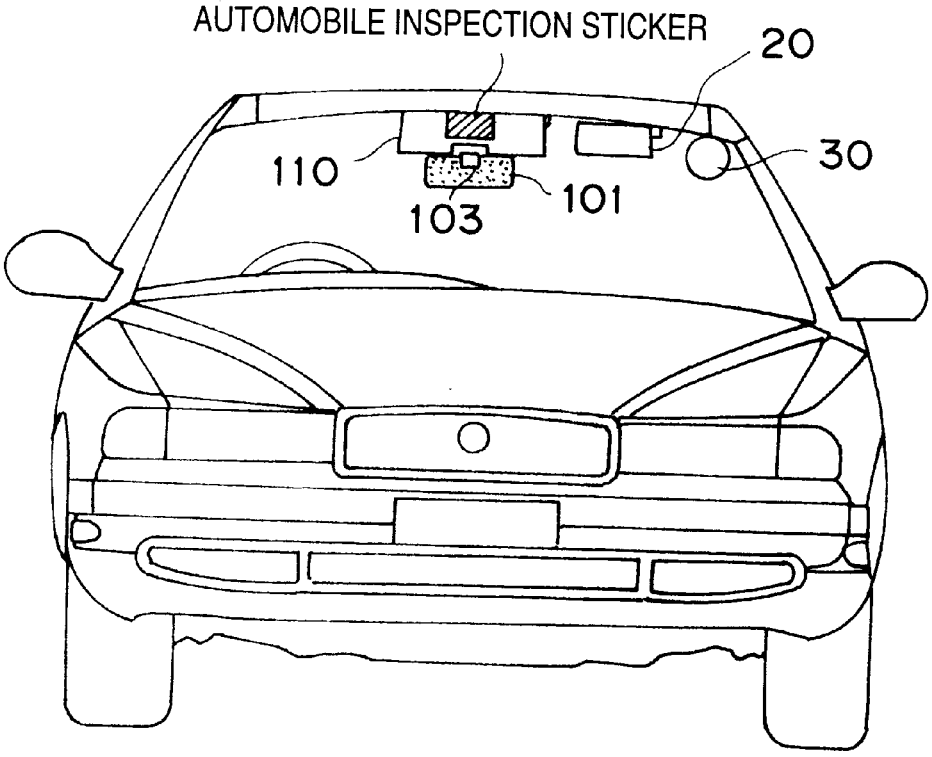
FIG. 58 is a front view of a vehicular front window glass to which the antenna according to the first modification of the first embodiment is applied.

As shown in FIG. 58, the antenna 110 is suitable for vehicles where an internal mirror 101 is attached on a base 103 directly placed on the front window glass. The longitudinal length (height) y, which must be over 7 cm and within 10 cm for the same reason as described in the first embodiment (i.e., to cover an automobile inspection sticker and to ensure visibility), is 9 cm. To prevent interference of an antenna wire with the base 103, a cut-out 102 (FIG. 57) is provided.

The basic designing is made on the requirement to ensure visibility and to cover the automobile inspection sticker. The height y is set within a range from 7 to 10 cm. When the height y is within this range, the frequency band $\lambda$ corresponding to the height y is expressed as follows;

$$\lambda = \frac{4y}{\alpha} \qquad (\alpha\text{: glass reduction ratio})$$

The wavelengths to be received are TV radio waves in the UHF band. The antenna of the first modification is a type of loop antenna having a characteristic that frequency band can be widened by prolonging the width x. Then the first modification sets the width x to fully long, e.g., 22 cm, so as to extend the reception band to the VHF band.

Figures 59, 60:
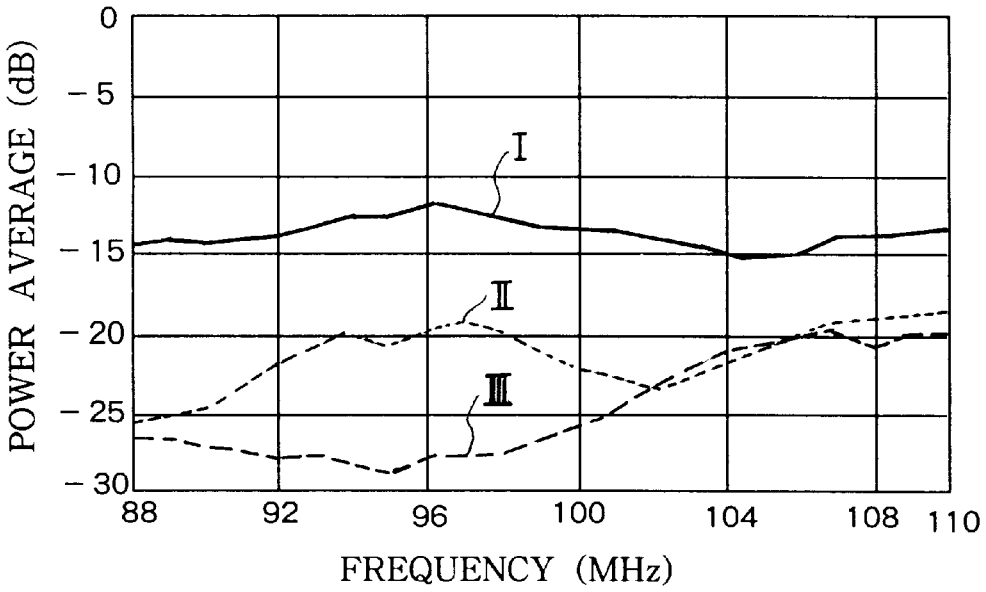
FIG. 59 is a graph showing reception characteristics of the antenna according to the first modification with respect to radio waves in a 88–110 MHz band.
FIG. 60 is a table showing averaged reception characteristics of the antenna according to the first modification with respect to radio waves in the 88–110 MHz band.
Figures 61, 62:
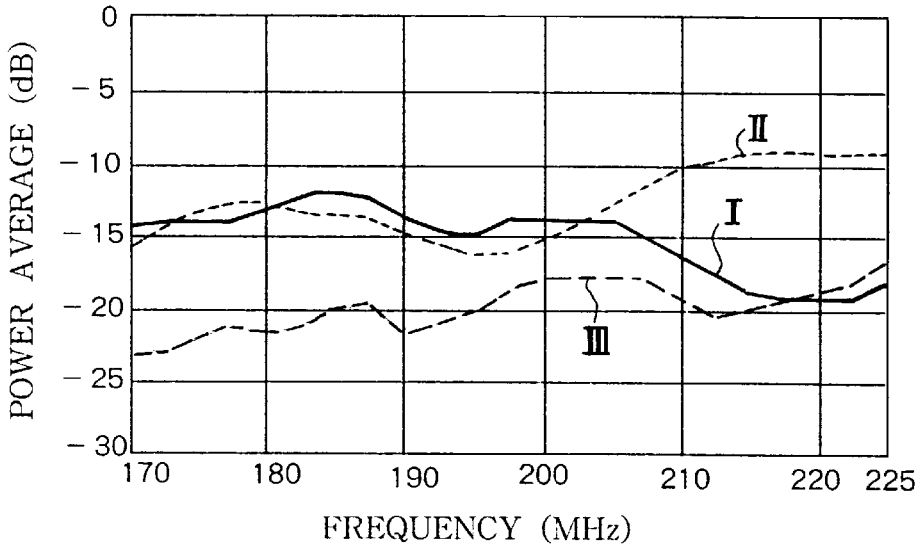
FIG. 61 is a graph showing reception characteristics of the antenna according to the first modification with respect to radio waves in a 170–225 MHz band.
FIG. 62 is a table showing averaged reception characteristics of the antenna according to the first modification with respect to radio waves in the 170–225 MHz frequency band.
Figures 63, 64:
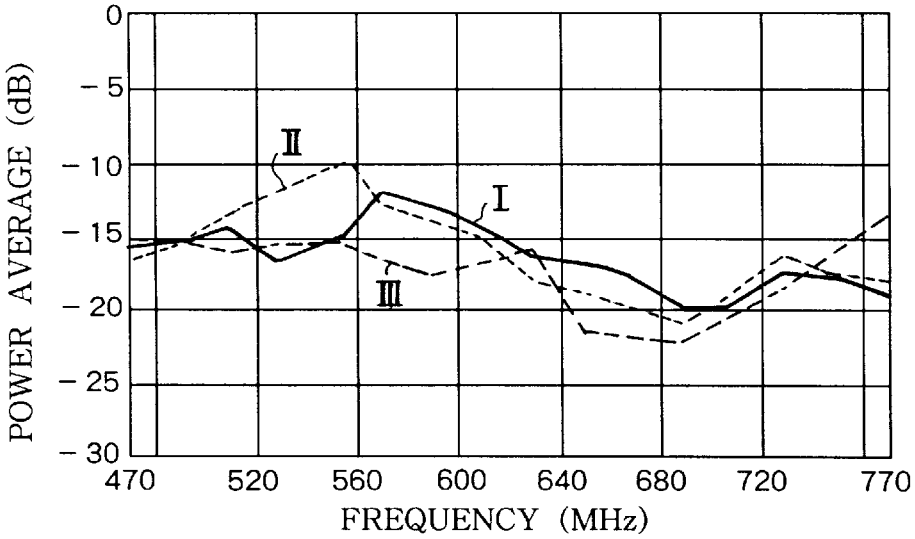
FIG. 63 is a graph showing reception characteristics of the antenna according to the first modification with respect to radio waves in a 470–770 MHz band.
FIG. 64 is a table showing averaged reception characteristics of the antenna according to the first modification with respect to radio waves in the 470–770 MHz band.

FIGS. 59, 61 and 63 are graphs showing reception characteristics (curve I) of the C-shape antenna of the first modification with respect to radio waves (horizontal polarization) respectively in the FM band (88 to 110 MHz), the VHF band (170 to 225 MHz), and the UHF band (470 to 770 MHz). In each graph, for the purpose of comparison with the reception sensitivity (curve I), the characteristics of the antenna 20 (having a rectangular shape which is long sideways) and the antenna 30 (having a circular shape) of the first embodiment are shown as curve II and curve III.

FIGS. 60, 62 and 64 are tables showing average reception characteristics obtained by averaging the above reception sensitivities (curves I to III) within an evaluation frequency range. It is understood from FIGS. 59 to 64 that the U-shape antenna of the first modification has a reception sensitivity −13.7 to −16.2 dB in the respective frequency bands, which is at a practical level.

Note that the test as shown in FIGS. 59 to 64 employs an "open-end type ground wire" to be described later, as the ground of the antennas. The length of the open-end type ground wire of the antenna 20 is 30 cm; and that of the antenna 30. 15 cm.

<Second Modification of First Embodiment>

A second modification of the first embodiment is an antenna 120 for the FM band. Different from the first embodiment providing the antenna 10 for both TV and FM bands, this modification has an object to receive FM radio waves and VICS (Vehicle Information and Communication System) radio waves by a diversity system.

Figure 65:
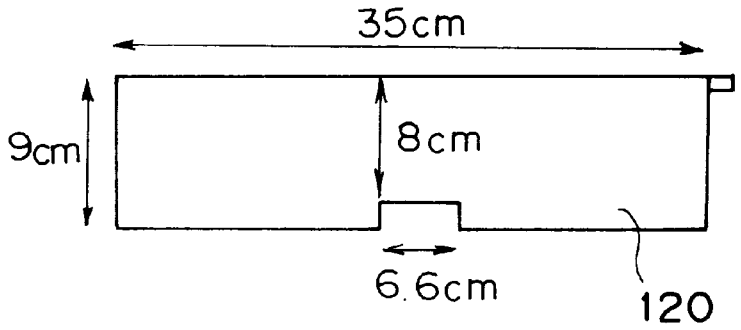
FIG. 65 is a schematic diagram showing the shape of the antenna of a second modification of the first embodiment of the present invention.
Figure 66:
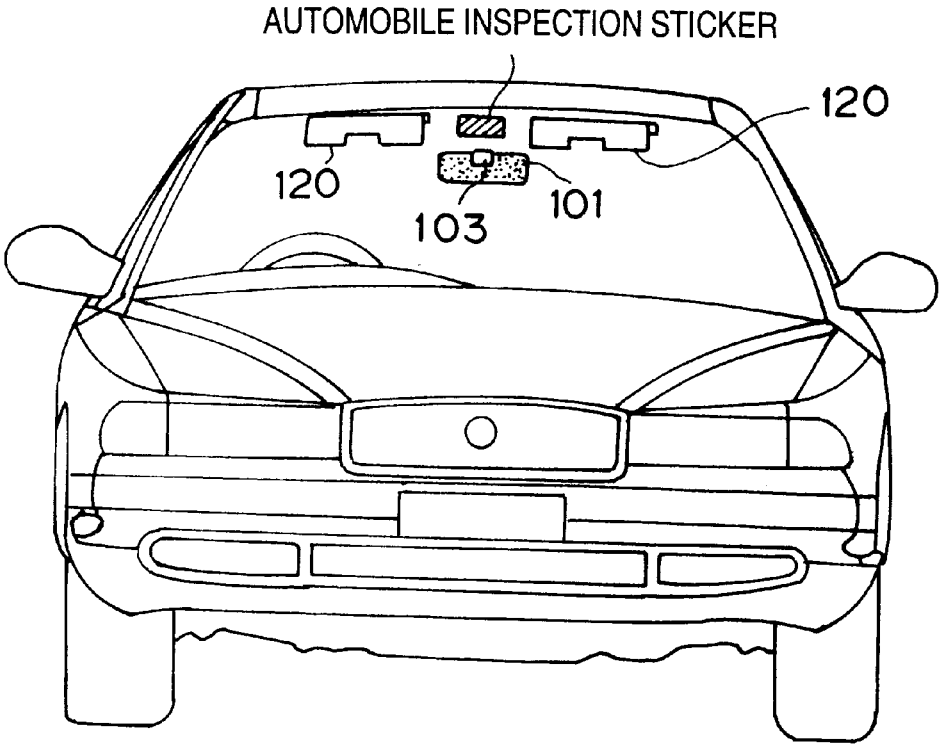
FIG. 66 is a front view of a vehicular front window glass to which the antenna according to the second modification of the first embodiment is applied.

FIG. 65 shows the antenna 120 of the second modification. To improve the reception sensitivity in the FM band, the width x is 35 cm longer than that of the first modification (x=22 cm). As shown in FIG. 66, a diversity system is constituted by providing two antennas 120.

The second modification is made based on a designing concept basically the same as that of the first modification. However, the second modification is mainly intended for FM band reception, the width x is set to the maximum within a range satisfying the above-described expressions (1) and (2) (plus condition x=7 to 10 cm).

As shown in FIG. 66, so far as the antenna 120 does not interfere with the base 103, this modification does not need the cut-out 102.

Figure 67:
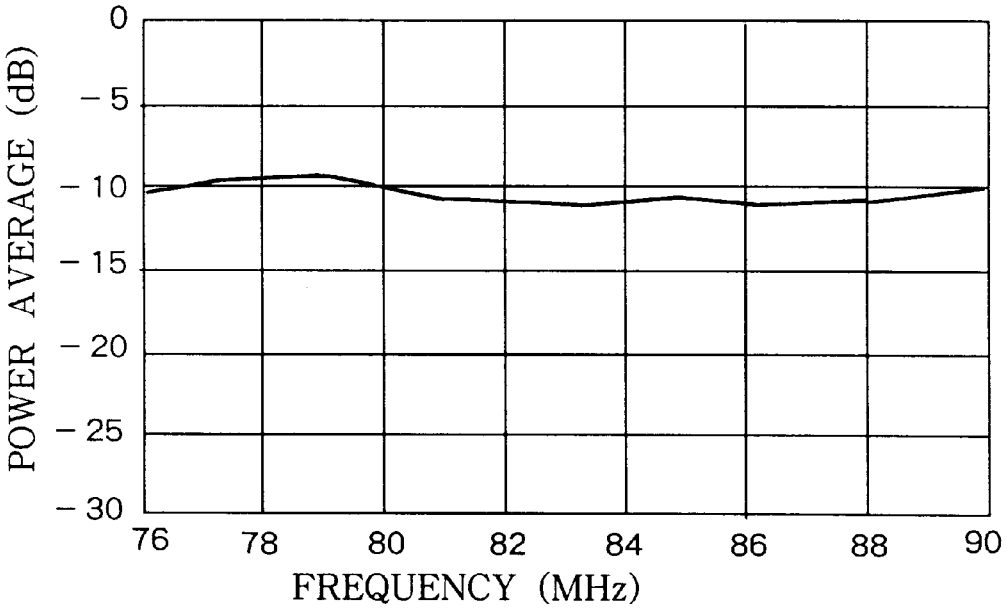
FIG. 67 is a graph showing a reception characteristic of the antenna according to the second modification with respect to an FM radio wave.

FIG. 67 shows a reception sensitivity of the antenna 120 in the FM radio wave band. In this case, the average sensitivity $P_w$-AV is −10.5 dB which indicates that the antenna 120 has a sufficient performance for VICS reception.

Note that preferable ranges of the x and y values are:

$x \geqq 30$ cm $7 \text{ cm} \leqq y \leqq 10$ cm

<Improvement of Ground Plate>

The ground plate of the first embodiment is connected with a clip, there is a problem that the clip is easily removed from the ground plate. As an improvement of this point, the ground plate as shown in FIG. 68 is weld-connected with the lead wire.

Figure 68:
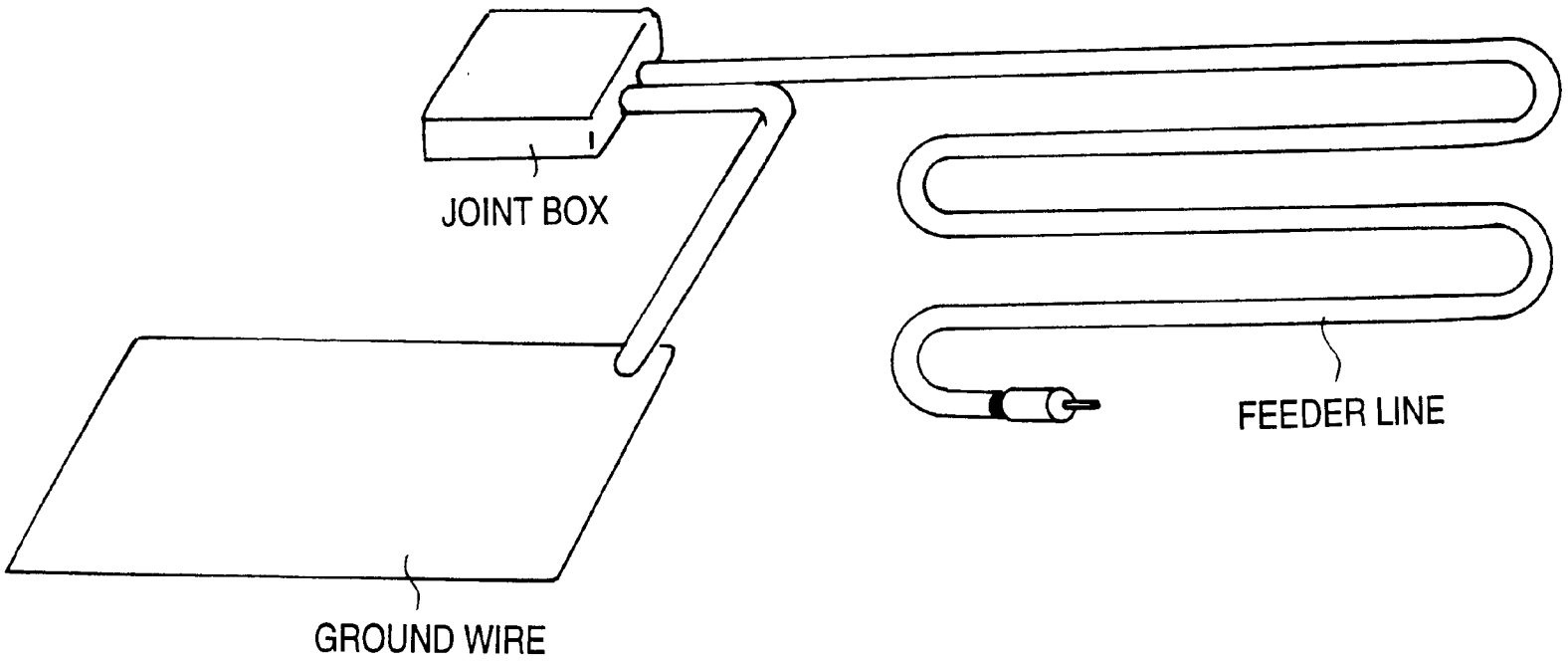
FIG. 68 is a perspective view showing a modification of a the ground plate used for the antenna according to the first embodiment.

The ground plate in FIG. 68 is applicable to the ground plate according to the following second and third embodiments, as well as the first embodiment, further, it is applicable to any type of grounded antenna.

<open-ended Type Ground Wire>. . . commonly applicable to first to third embodiments The antennas of the first embodiment employ the ground plate as shown in FIG. 7 or the ground plate in FIG. 68. These ground plates have an advantage that a user can easily attach the antenna onto the front window glass, however, they also have disadvantages that the attachment includes several steps and that they are not always applicable to every type of vehicle.

The open-end type ground wire to be described hereinbelow comprises, not a grounding plate or the like, but only a flexible conductive wire. This ground wire is applicable to every grounded antenna as well as the antenna of the embodiments.

Figure 69:
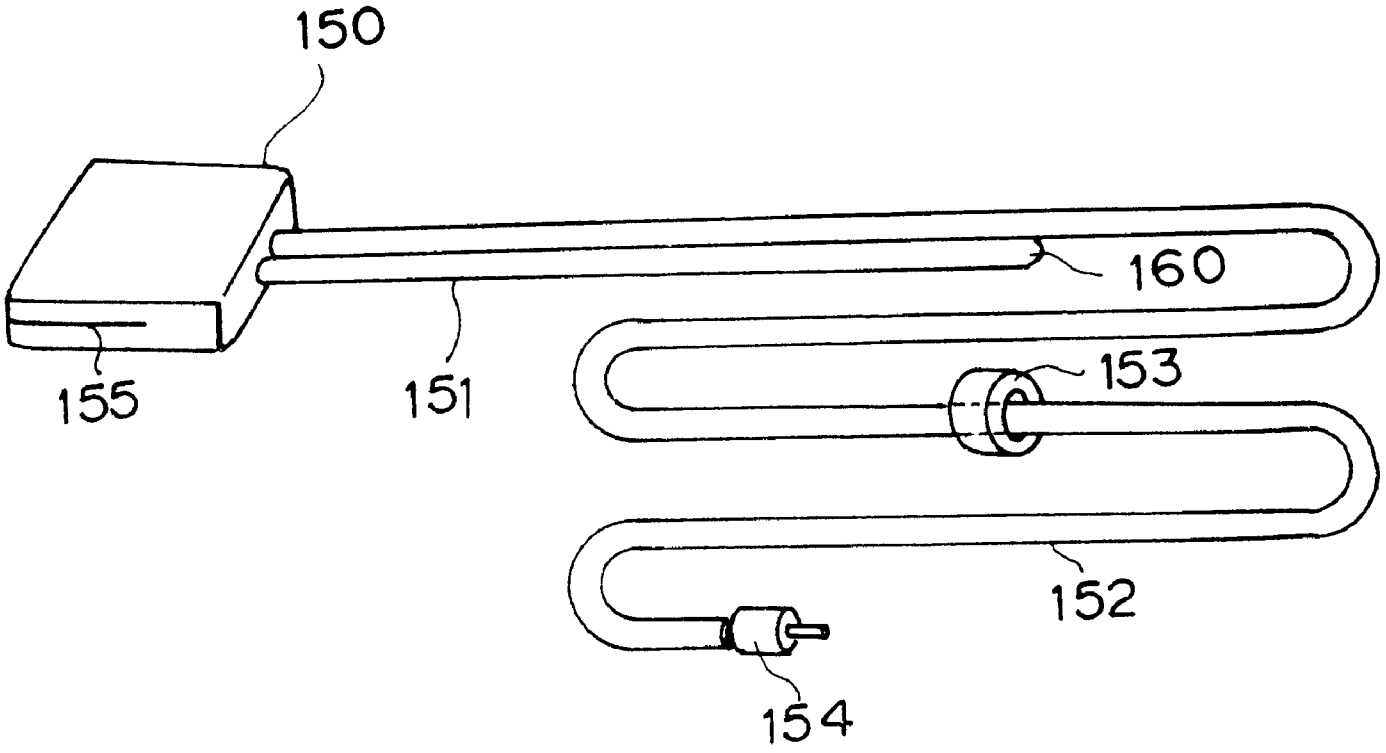
FIG. 69 is a perspective view showing a construction of an open-end type ground wire used for the antennas in the first to third embodiments of the present invention.

FIG. 69 shows the feeder assembly using the open-end type ground wire. In FIG. 69, numeral 150 denotes a joint box having a slit 155 in which the end portions 11, 21 and 31 of the antennas 10, 20 and 30 of the first embodiment are inserted. The joint box 150 is connected with a feeder cable 152 and a ground wire 151. For the purpose of noise elimination or the like, a ferrite core 153 and a connector 154 are attached to the feeder cable 152. The connector 154 is connected to an FM radio, a TV tuner or a VICS terminal (not shown) in accordance with purpose.

Figure 70:
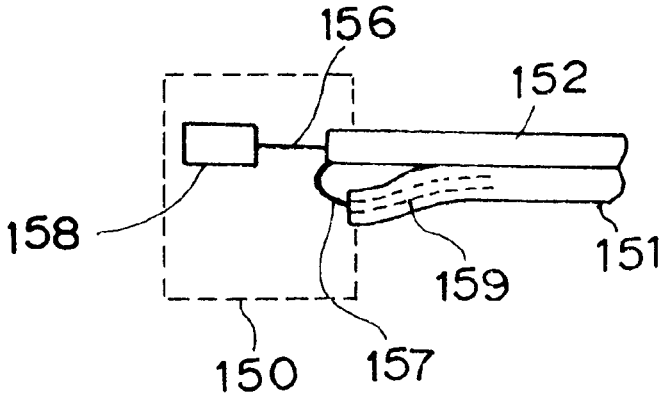
FIG. 70 is a cross-sectional view showing a part of the open-end type ground wire in FIG. 69 in detail.
Figure 71:
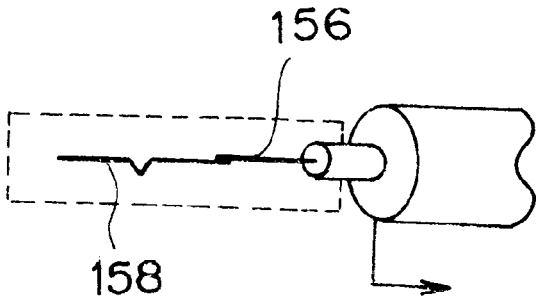
FIG. 71 is a perspective view showing a part of the open-end type ground wire in FIG. 69 in detail.

As shown in FIGS. 70 and 71, the feeder cable 152 comprises a core 156 for signal reception and a net type shield surrounding the core 156. In the joint box 150, a spring 158 having elasticity to hold the antenna end portion is provided, and the core 156 is connected to the spring 158. The net type shield is bundled into a ground lead 157, and the ground lead 157 is connected to a thicker ground core wire 159. The ground core wire 159 is covered with an insulating film, thus constituting the ground cable 151.

Figure 116:
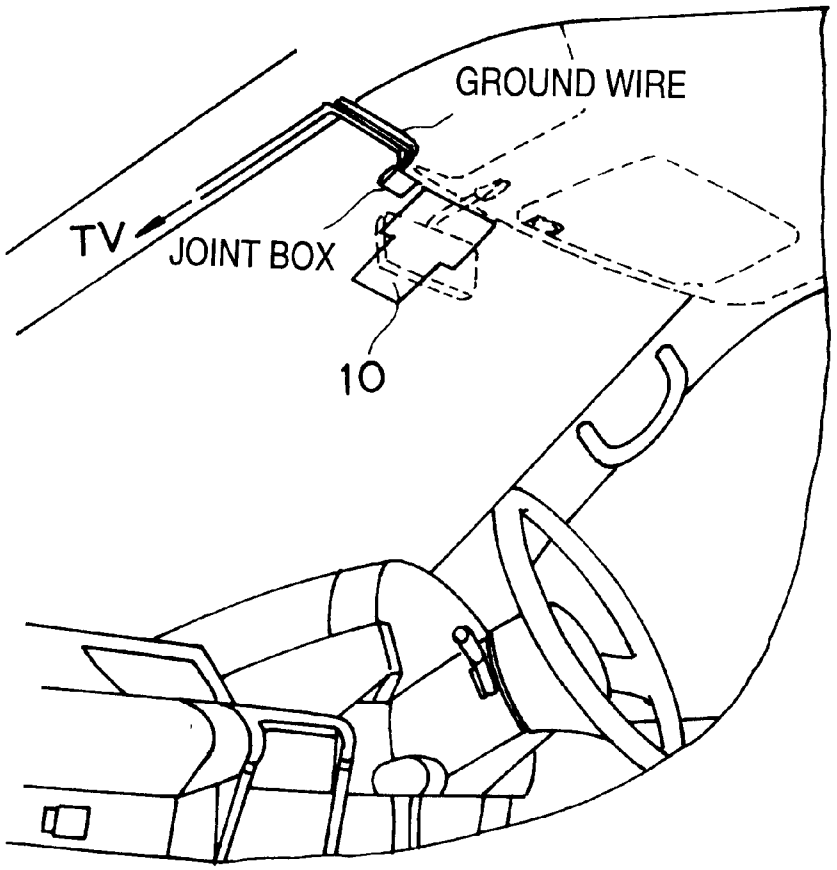
FIG. 116 is a perspective view showing a vehicular front window glass to which the antenna according to the first embodiment is attached with the open-end type ground wire.
Figure 117:
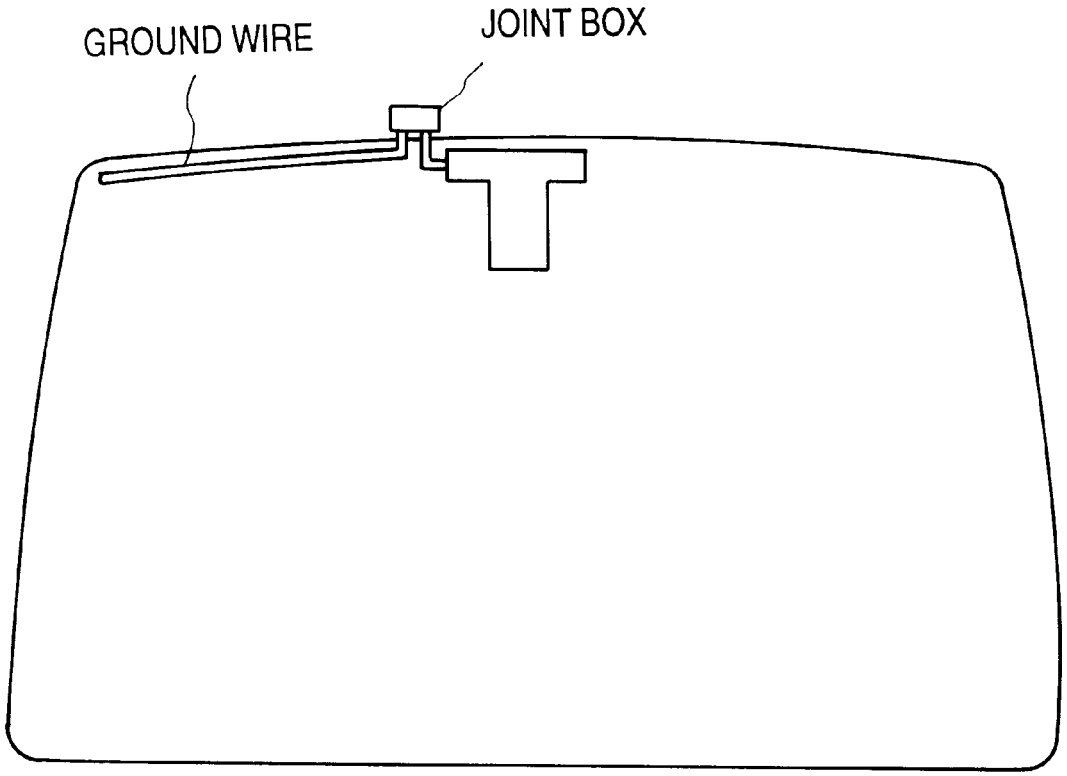
FIG. 117 is a schematic view showing a modification of the open-end type ground wire applicable to the antenna according to the first to third embodiments.

FIG. 116 shows the ground wire assembly having the above structure, connected to the antenna 10 attached onto the front window glass.

It is a feature of the open-end type ground wire that its end portion 160 (FIG. 69) is open and is not grounded to the vehicle body, i.e., this ground wire functions as a ground even if the end portion is open. This feature of this ground wire will be described with reference to FIGS. 72 to 75.

Figure 72:
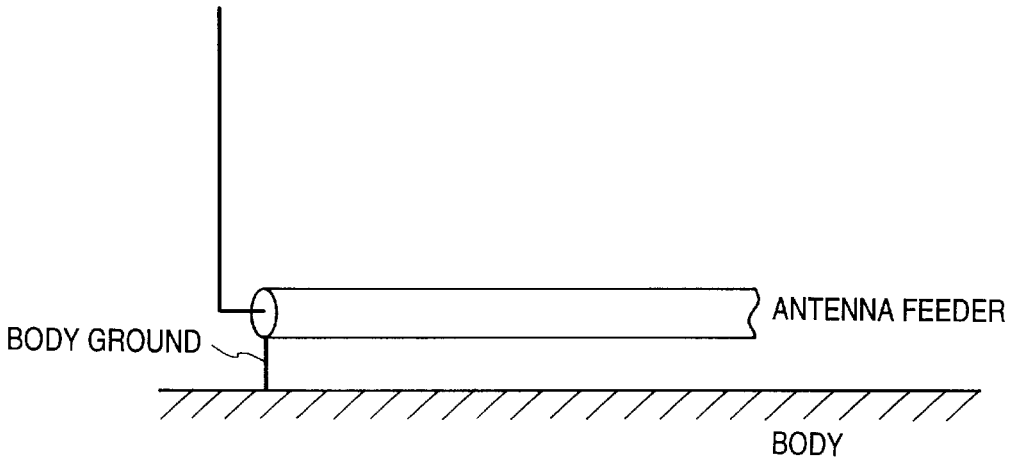
FIG. 72 is an explanatory view showing a body ground of a general grounded antenna.

FIG. 72 shows the structure of a conventional grounded antenna. In FIG. 72, a ground wire of a feeder cable is grounded to the vehicle body.

Figure 73:
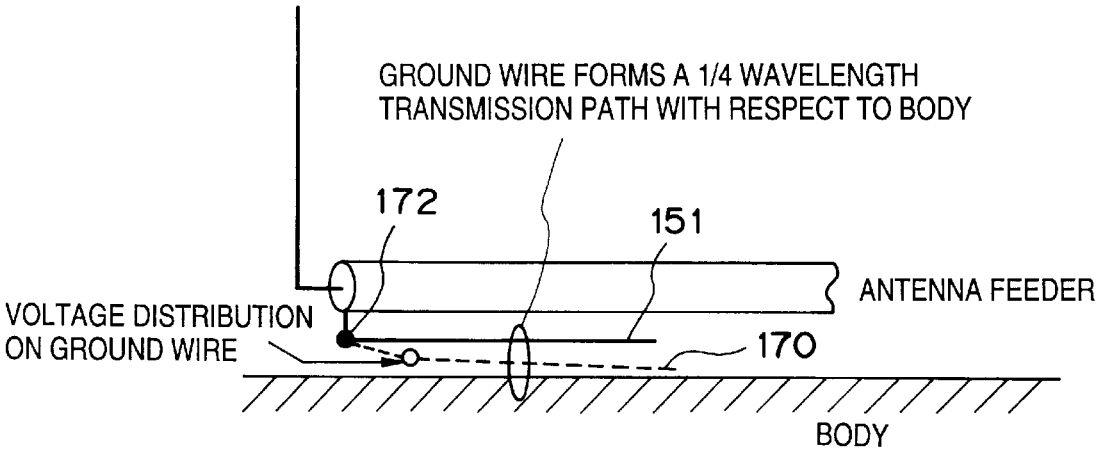
FIGS. 73 to 75 are explanatory views showing a principle of the open-end type ground wire of the embodiments.
Figure 74:
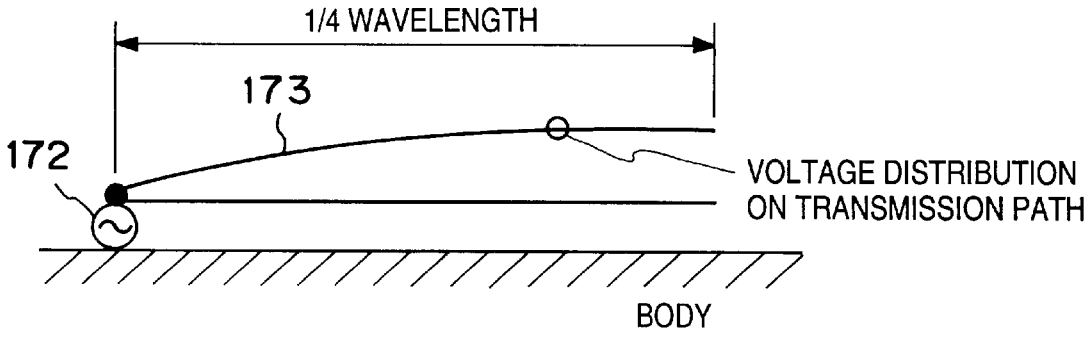
Figure 75:
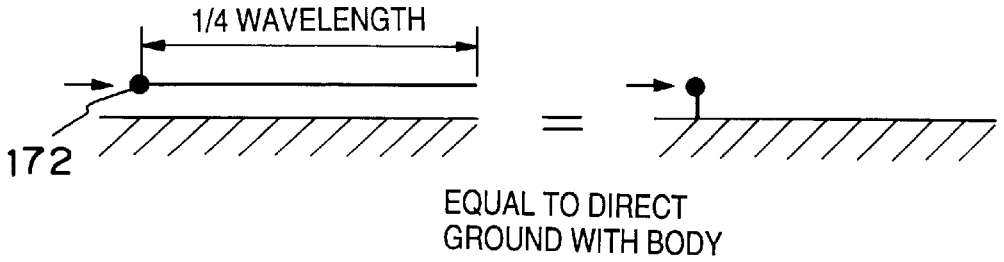
Figure 76:
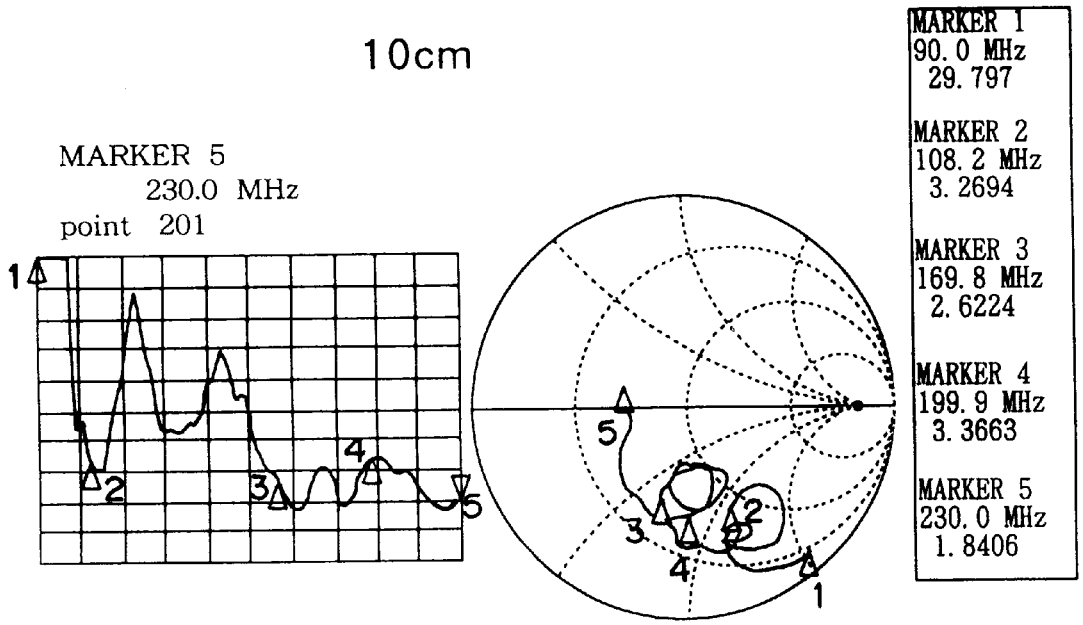
FIG. 76 is a set of graphs showing a VSWR (Voltage Standing Wave Ratio) characteristic of the T-shape framed antenna according to the first embodiment (ground wire length: 10 cm)
Figure 77:
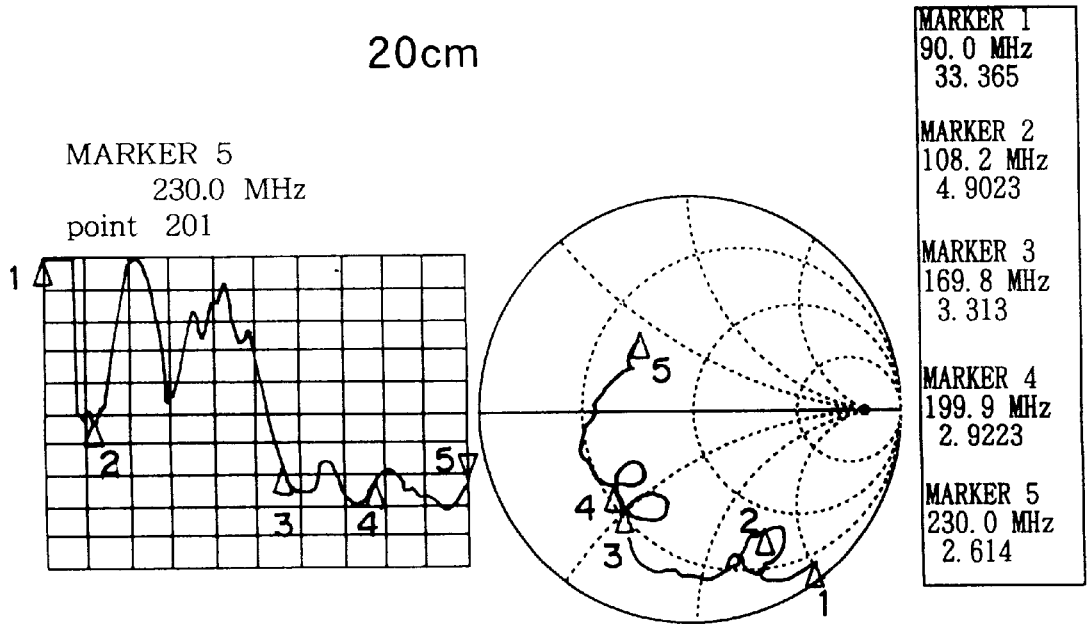
FIG. 77 is a set of graphs showing a VSWR characteristic of the T-shape antenna according to the first embodiment (ground wire length: 20 cm)
Figure 78:
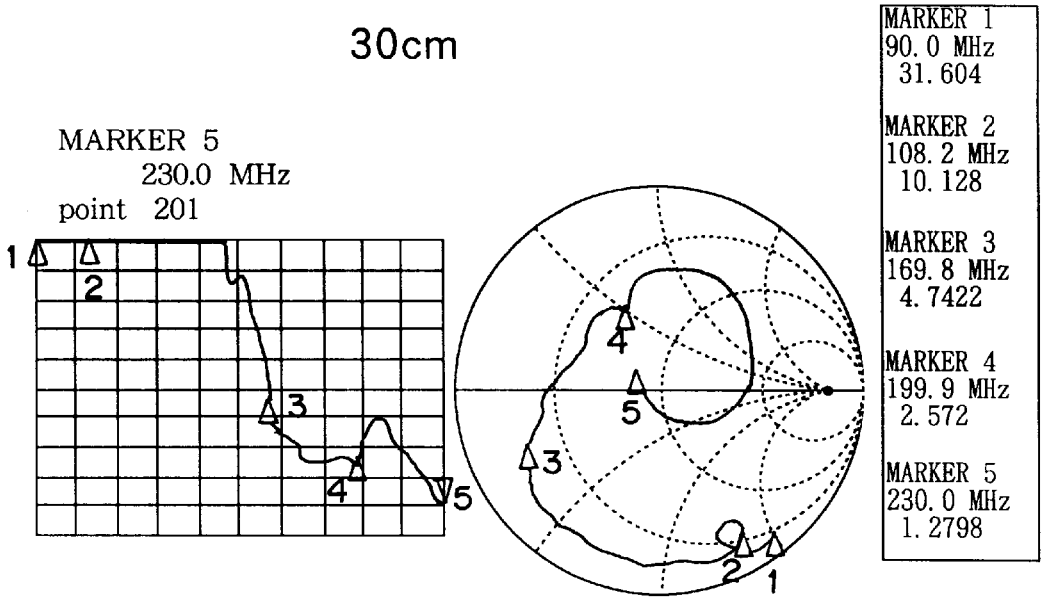
FIG. 78 is a set of graphs showing a VSWR characteristic of the T-shape antenna according to the first embodiment (ground wire length: 30 cm)
Figure 79:
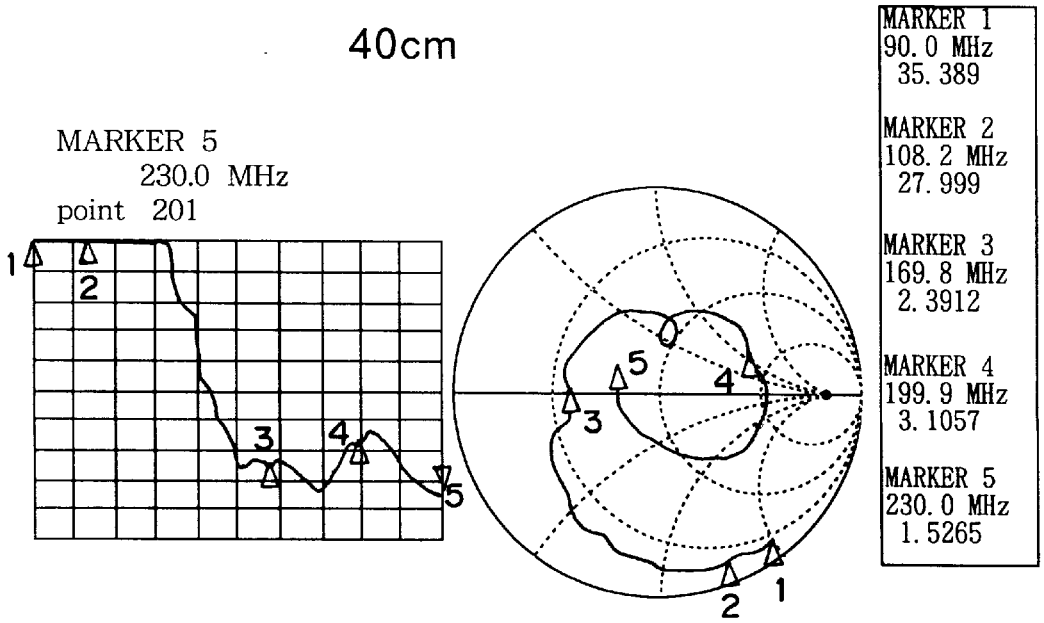
FIG. 79 is a set of graphs showing a VSWR characteristic of the T-shape antenna according to the first embodiment (ground wire length: 40 cm)

On the other hand, FIGS. 73 to 75 show the principle of the open-end type ground wire as the modification of the embodiments. As shown in FIG. 73, if one end of the open-end type ground wire having an arbitrary length is released, the ground wire 151 and the metal of the vehicle body form a transmission path. In this case, the voltage distribution on the ground wire has a curve as a curve 170 in FIG. 73, along the ground wire 151. That is, the potential on the ground wire has a tendency to gradually decrease. As shown in FIG. 74, if the length of the ground wire 151 to ¼ of the reception radio wavelength λ, the voltage distribution on the transmission path is as a curve 173 in FIG. 74, and an impedance of the transmission path taken from a point 172 in consideration of the characteristic of the transmission path is "0". At this time, the potential at the point 172 is equal to the potential of the vehicle body. That is, as shown in FIG. 75, the open-end type grounding wire 151 having the length λ/4 of the reception radio wavelength is equivalent to a ground wire directly grounded to the vehicle body at the point 172.

In the example in FIGS. 73 to 75, though there exists an air layer between the ground wire forming the transmission path and the vehicle body, if an insulating member of arbitrary material (path reduction ratio: δ) exists between the ground wire and the vehicle body, a preferable length of the open-end type ground wire is as follows:

$$\frac{\lambda}{4} \cdot \delta \tag{5}$$

Note that it is significant that the open-end type ground wire is not necessarily in parallel with the feeder cable. For the purpose of forming a transmission path with the vehicle body, if the ground wire is not in contact with the metal part of the vehicle body, so far as it is provided along the metal part. Further, it is preferable that the open-end type ground wire is a flexible conductive member to be curved along the vehicle body in a case where a position for setting the ground wire has a small space.

Further, in consideration of easiness of incorporating the open-end type ground wire into the vehicle body, it is preferable in FIG. 69 that the feeder cable 152 and the ground wire 151 are insulated from each other, and the both wire are covered with an insulating film to be insulated from the vehicle body.

Thus, the open-end type ground wire attains easy grounding in comparison with conventional grounding method or the ground plate (FIG. 11) of the present embodiment which requires any grounding structure such as screw-fixing, bonding and ground pattern.

Next, the performance of the open-end type ground wire having the above structure very advantageous in assembling will be described below.

Figure 80:
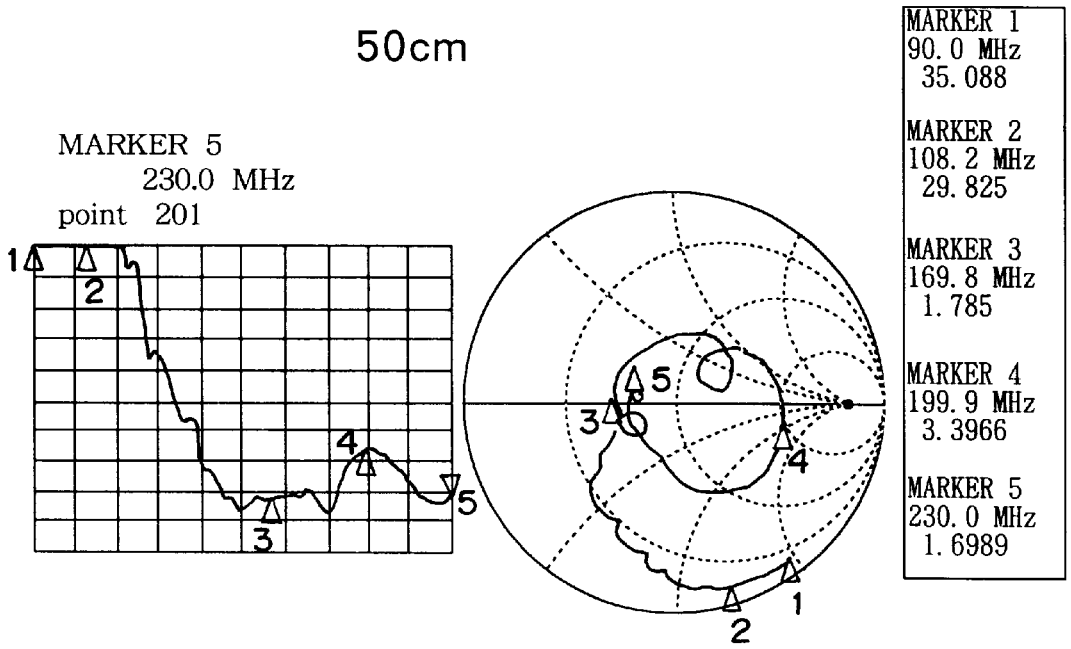
FIG. 80 is a set of graphs showing a VSWR characteristic of the T-shape antenna according to the first embodiment (ground wire length: 50 cm)
Figure 81:
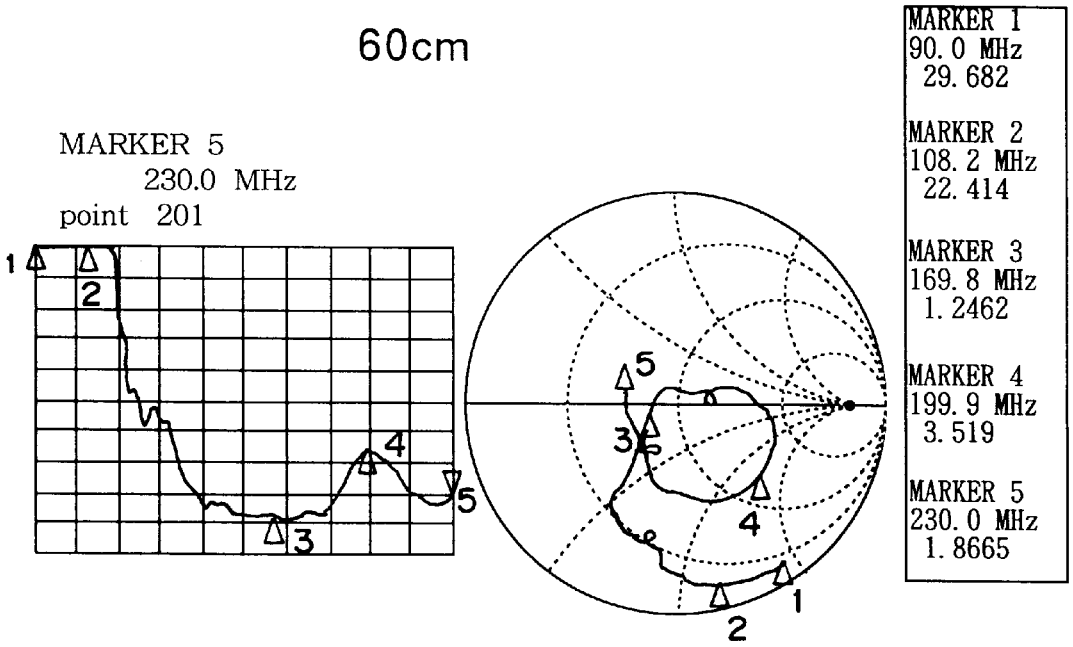
FIG. 81 is a set of graphs showing a VSWR characteristic of the T-shape antenna according to the first embodiment (ground wire length: 60 cm)
Figure 82:
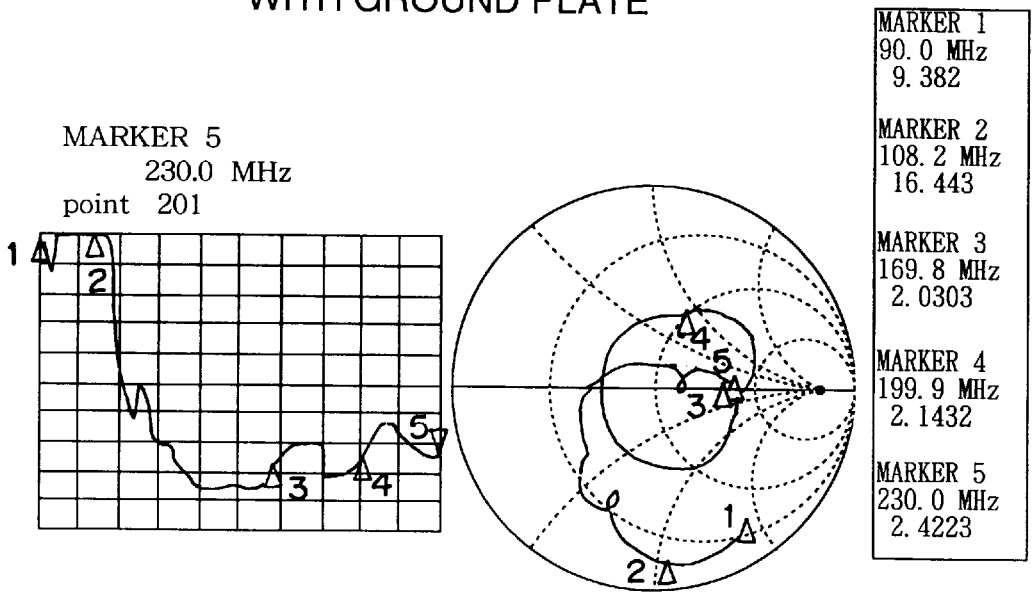
FIG. 82 is a set of graphs showing a VSWR characteristic of the T-shape antenna according to the first embodiment (with the grounding plate)
Figure 83:
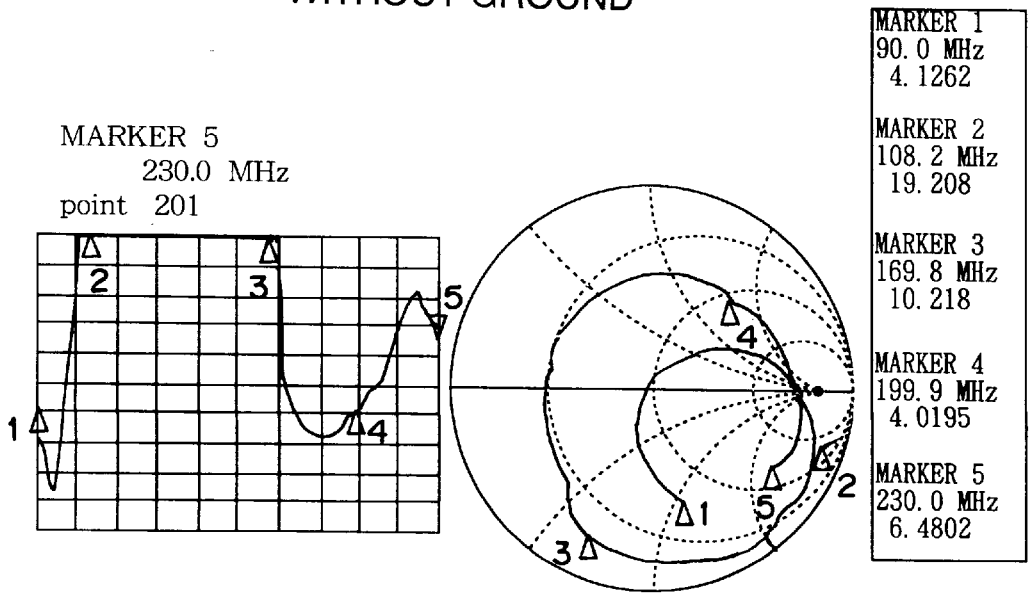
FIG. 83 is a set of graphs showing a VSWR characteristic of the T-shape antenna according to the first embodiment (without the grounding plate)
Figure 84:
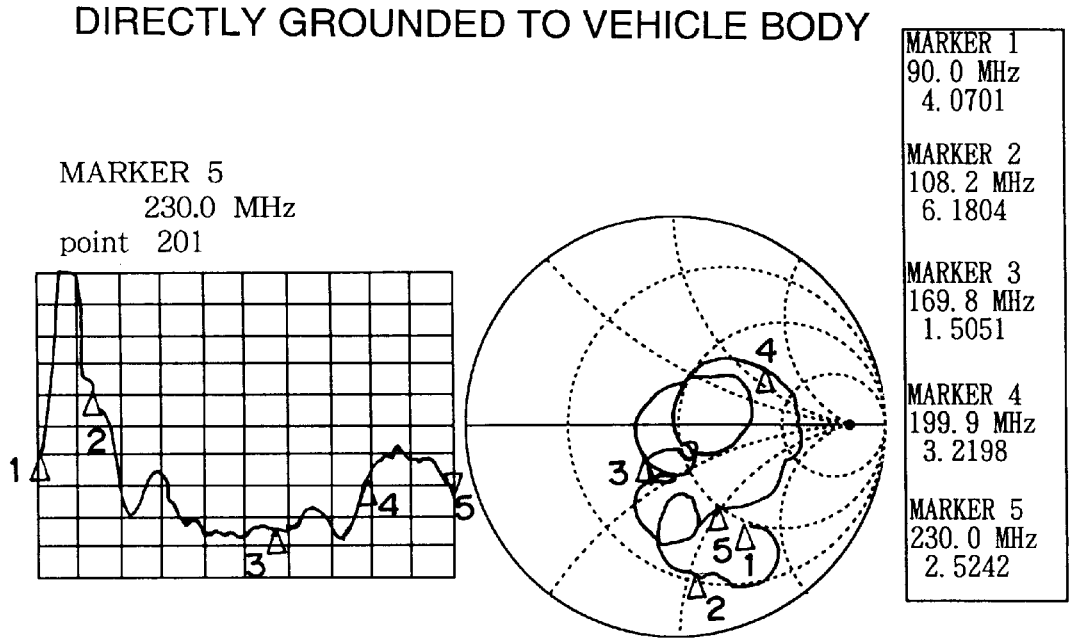
FIG. 84 is a set of graphs showing a VSWR characteristic of the T-shape antenna according to the first embodiment (the body is directly grounded)

FIGS. 76 to 81 are sets of graphs showing VSWR (Voltage Standing Wave Ratio) characteristics of the T-shape antenna 10 of the first embodiment connected with the open-end type ground wire with respect to a TV radio wave in a band from 90 to 230 MHz when the length of the open-end type ground wire is changed. For the purpose of comparison, FIG. 82 shows a VSWR characteristic of the antenna 10 with the ground plate in FIG. 11; FIG. 83, a VSWR characteristic of the antenna 10 without ground; and FIG. 84, a VSWR characteristic of the antenna 10 directly grounded to the vehicle body (the length of ground wire: about 15 cm). Assuming that it is most preferable to make direct grounding to a vehicle body or employ a ground plate for obtaining highest function of ground, the ground having the VSWR characteristic shown in FIG. 82 or 84 is ideal as a ground for the antenna 10 (FIG. 3). That is, an open-end type ground wire having a length from 50 to 60 cm, having a VSWR characteristic similar to that shown in FIG. 80 or 81 is preferable.

Thus, a ground wire which is easily set and which has an appropriate reception performance can be provided by setting the length of the ground wire so as to satisfy $\delta\cdot\lambda/4$ ($\delta$: transmission path reduction ratio of material existing between ground wire and vehicle body) in accordance with reception radio wavelength.

Next, influence of the open-end type ground wire on reception sensitivity will be described below.

Figure 85:
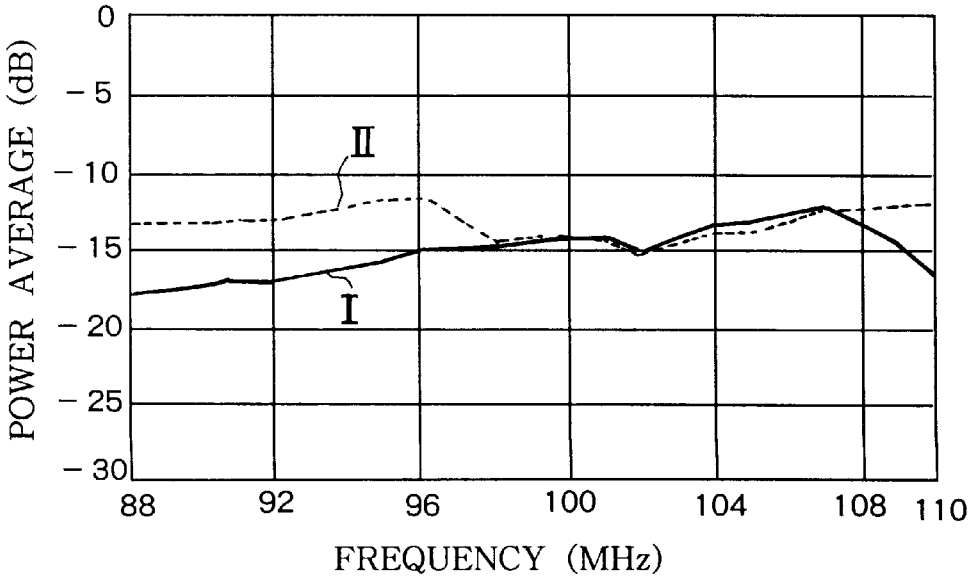
FIG. 85 is a graph showing reception characteristics of the T-shape antenna according to the first embodiment (reception band: 88–110 MHz)
Figures 86, 87:
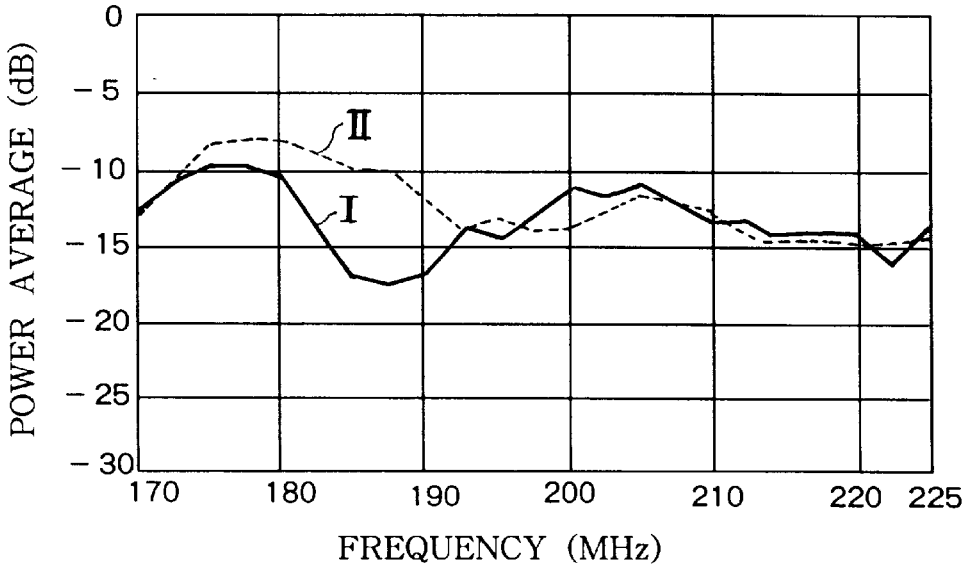
FIG. 86 is a table showing averaged reception characteristics of the T-shape antenna according to the first embodiment (reception band: 88–110 MHz)
FIG. 87 is a graph showing reception characteristics of the T-shape antenna according to the first embodiment (reception band: 170–225 MHz; ground length=53.5 cm)
Figures 88, 89:
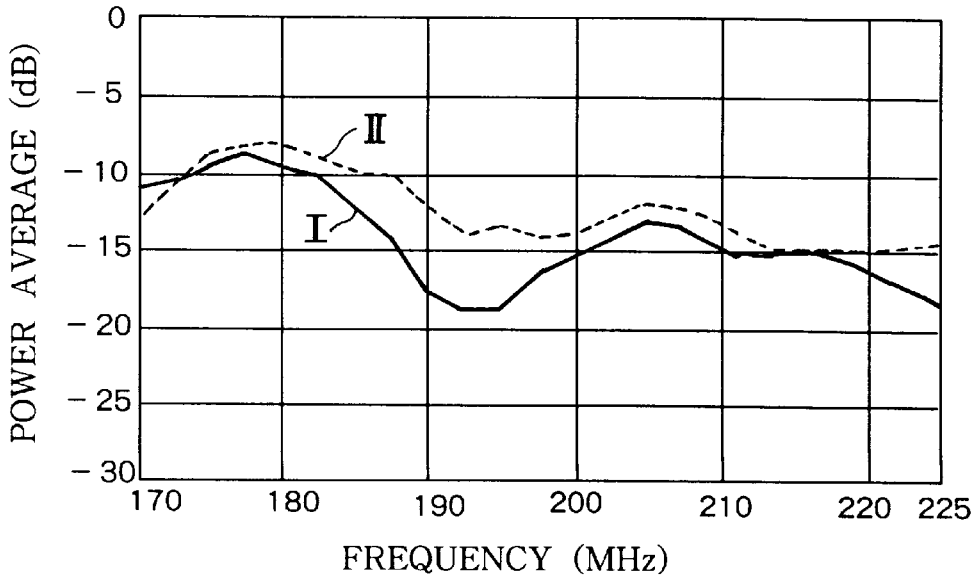
FIG. 88 is a table showing averaged reception characteristics of the T-shape antenna according to the first embodiment (reception band: 170–225 MHz; ground length=53.5 cm)
FIG. 89 is a graph showing reception characteristics of the T-shape antenna according to the first embodiment (reception band: 170–225 MHz; ground length=30 cm)
Figures 90, 91:
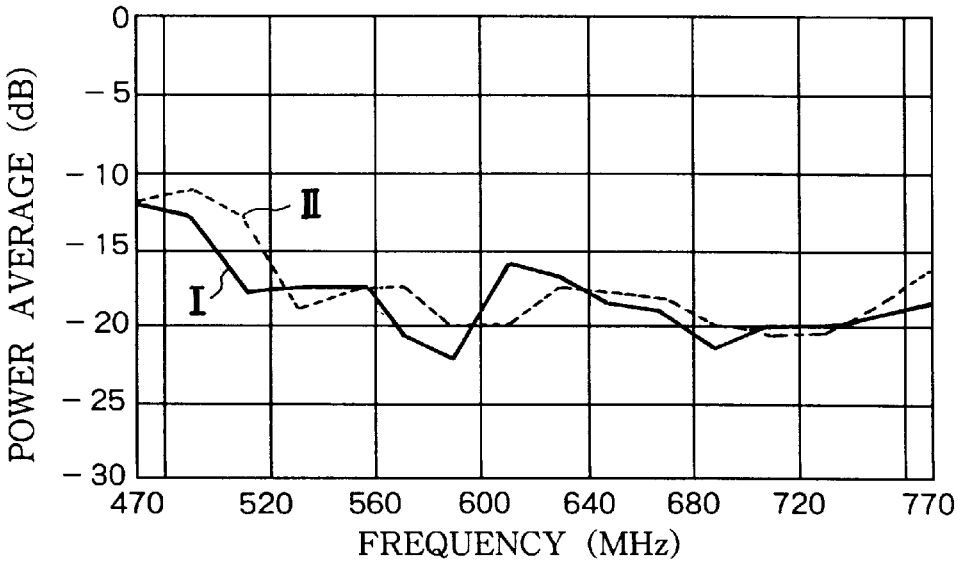
FIG. 90 is a table showing averaged reception characteristics of the T-shape antenna according to the first embodiment (reception band: 170–225 MHz; ground length=30 cm)
FIG. 91 is a graph showing reception characteristics of the T-shape antenna according to the first embodiment (reception band: 470–770 MHz; ground length=20 cm)
Figures 92, 93:
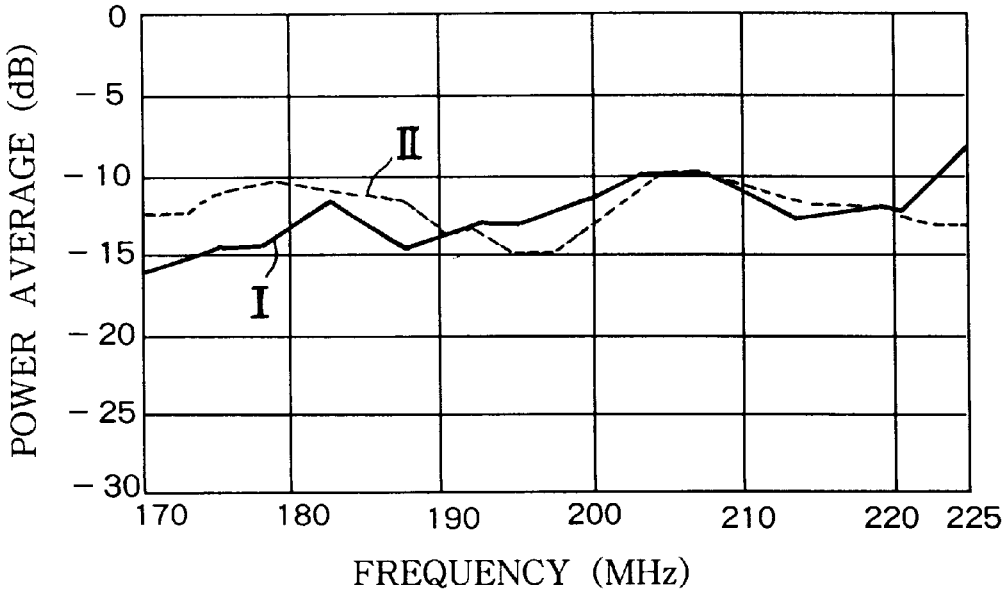
FIG. 92 is a table showing averaged reception characteristics of the T-shape antenna according to the first embodiment (reception band: 470–770 MHz; ground length=20 cm)
FIG. 93 is a graph showing reception characteristics of the rectangular antenna according to the first embodiment (reception band: 170–225 MHz; ground length=30 cm)

FIGS. 85, 87, 89 and 91 are graphs showing reception sensitivities of the T-shape antenna 10 in FIG. 3. FIG. 86, FIGS. 88, 90 and 92 are tables showing average reception sensitivities obtained from the above graphs. In FIGS. 85, 87, 89 and 91, a curve I shows a characteristic of the antenna 10 when it is connected to the open-end type ground wire; and a curve II, a characteristic of the antenna 10 when it is connected to the ground plate (FIG. 7) for the purpose of comparison. Especially FIGS. 85 and 88 show the reception sensitivities when the length of the open-end type ground wire is 90 cm for receiving radio waves in a band from 88 to 110 MHz. It is understood from FIG. 86 that a sufficient average sensitivity −15.1 dB is obtained. FIGS. 87 and 88 show the reception sensitivities when the length of the open-end type ground wire is 53.5 cm for receiving radio waves in a band from 170 to 225 MHz. It is understood from FIG. 88 that a sufficient average sensitivity −13.3 dB is obtained. FIGS. 89 and 90 show the reception sensitivities when the length of the open-end type ground wire is 30 cm for receiving radio waves in the 170 to 225 MHz band. It is understood from FIG. 90 that a sufficient average sensitivity −14.2 dB is obtained. FIGS. 91 and 92 show the reception sensitivities when the length of the open-end type ground wire is 20 cm for receiving radio waves in a band from 470 to 770 MHz. It is understood from FIG. 92 that a sufficient average sensitivity −18.1 dB is obtained.

Further, the graphs in FIGS. 85, 87, 89 and 91 indicate that reception characteristic as excellent as that of a ground plate can be obtained by appropriately setting the length of the open-end type ground wire.

Figures 94, 95:
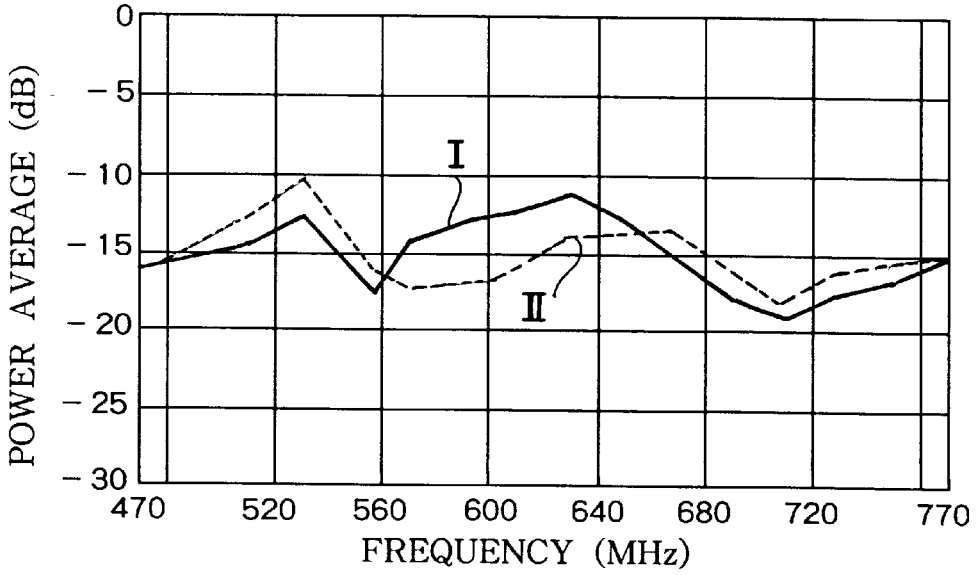
FIG. 94 is a table showing averaged reception characteristics of the rectangular antenna according to the first embodiment (reception band: 170–225 MHz; ground length=30 cm)
FIG. 95 is a graph showing reception characteristics of the rectangular antenna according to the first embodiment (reception band: 470–770 MHz; ground length=10 cm)

FIG. 93 is a graph showing reception sensitivities of the rectangular frame-type antenna 20 in FIG. 4 in receiving radio waves in a band from 170 to 225 MHz. In FIG. 93, a solid line I represents the reception characteristic of the antenna 20 when the length of the open-end type ground wire is set to 30 cm; and a broken line II, the reception characteristic when a ground plate is employed. FIG. 94 is a table showing average reception sensitivities obtained from FIG. 93.

FIG. 95 is a graph showing reception sensitivities of the rectangular antenna 20 in FIG. 4 in receiving radio waves in a band from 170 to 225 MHz when the length of the open-end type ground wire is set to 10 cm. FIG. 96 is a table showing average reception sensitivities obtained from FIG. 95.

From the above various tests, it is understood that when the open-end type ground wire is applied to a T-shape antenna like the antenna 10 in FIG. 3, if the maximum width x and the maximum height y are set so as to satisfy the following conditions $$y \leqq \alpha\cdot\lambda/4$$

$$x \leqq 60\text{ cm} - y$$

and the width of the part below the 10 cm range from the upper end of the front window glass (the above-described reference base line 100T) is set within 6.6 cm, a desirable antenna device can be made.

Further, it is understood that when the open-end type ground wire is applied to a frame shape antenna like the antenna 20 in FIG. 4, preferable results are obtained to set the maximum width x and the maximum height y so as to satisfy the following conditions:

$$5\text{ cm} \leqq x \leqq 40\text{ cm}$$

$$3\text{ cm} \leqq y \leqq 10\text{ cm}$$

Further, it is understood that when the open-end type ground wire is applied to a circular shape antenna having a diameter of 7 cm, like the antenna 30 in FIG. 5, preferable results are obtained to set the maximum width x and the maximum height y so as to satisfy the following conditions:

$$y \leqq \alpha\cdot\lambda/4$$

$$x < 60\text{ cm-y}$$

[Second Embodiment]

As a second embodiment, the glass antenna of the present invention is applied to a side window glass. Especially wagon type vehicles may have side windows which are not opened/closed, and in such case, it is convenient to place the glass antenna on the un-opened window glass. Further, considering that an antenna for the VICS band must be placed apart from an antenna for the TV broadcast band, if the VICS antenna is placed on the front window glass as in the first embodiment shown in FIG. 57, the front window glass is occupied with many antenna wires, which is undesirable for some type of vehicles. In view of this inconvenience, the second embodiment places the VICS antenna on the side window glass.

The glass antenna according to the second embodiment is a frame antenna to which the glass-antenna designing method of the first embodiment (expressions (1) and (2) and designing conditions in FIG. 30) is applied.

Figure 97:
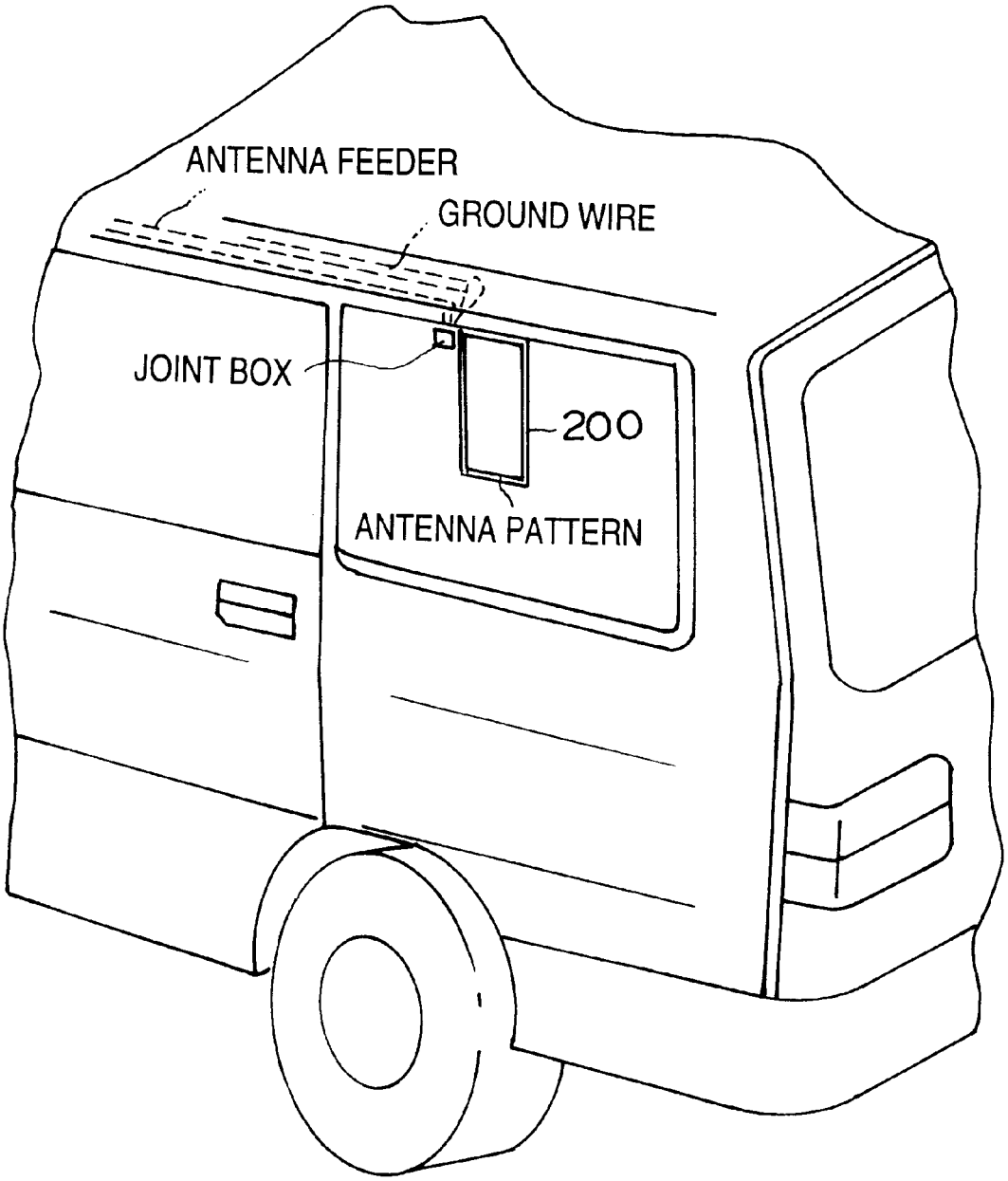
FIG. 97 is a perspective view showing a vehicular side window glass to which the glass antenna (with open-end type ground wire) according to a second embodiment of the present invention is attached.

FIG. 97 shows a frame antenna 200 according to the second embodiment attached onto a side window glass of a vehicle. In this figure, the antenna 200 is connected to the open-end type ground wire of the first embodiment (FIG. 69). The antenna 200 has all the features of the frame antenna according to the first embodiment. Further, since the antenna 200 is connected to the open-end type ground wire, the antenna set has all the features of the open-end type ground wire.

If the designing conditions in the above-described expressions (1), (2) and FIG. 30 are applied to the glass antenna 200, preferable measurements of the glass antenna 200 are as follows:

$$x \leqq 30\text{ cm}$$

$$20\text{ cm} \leqq y \leqq 40\text{ cm}$$

Figure 98:
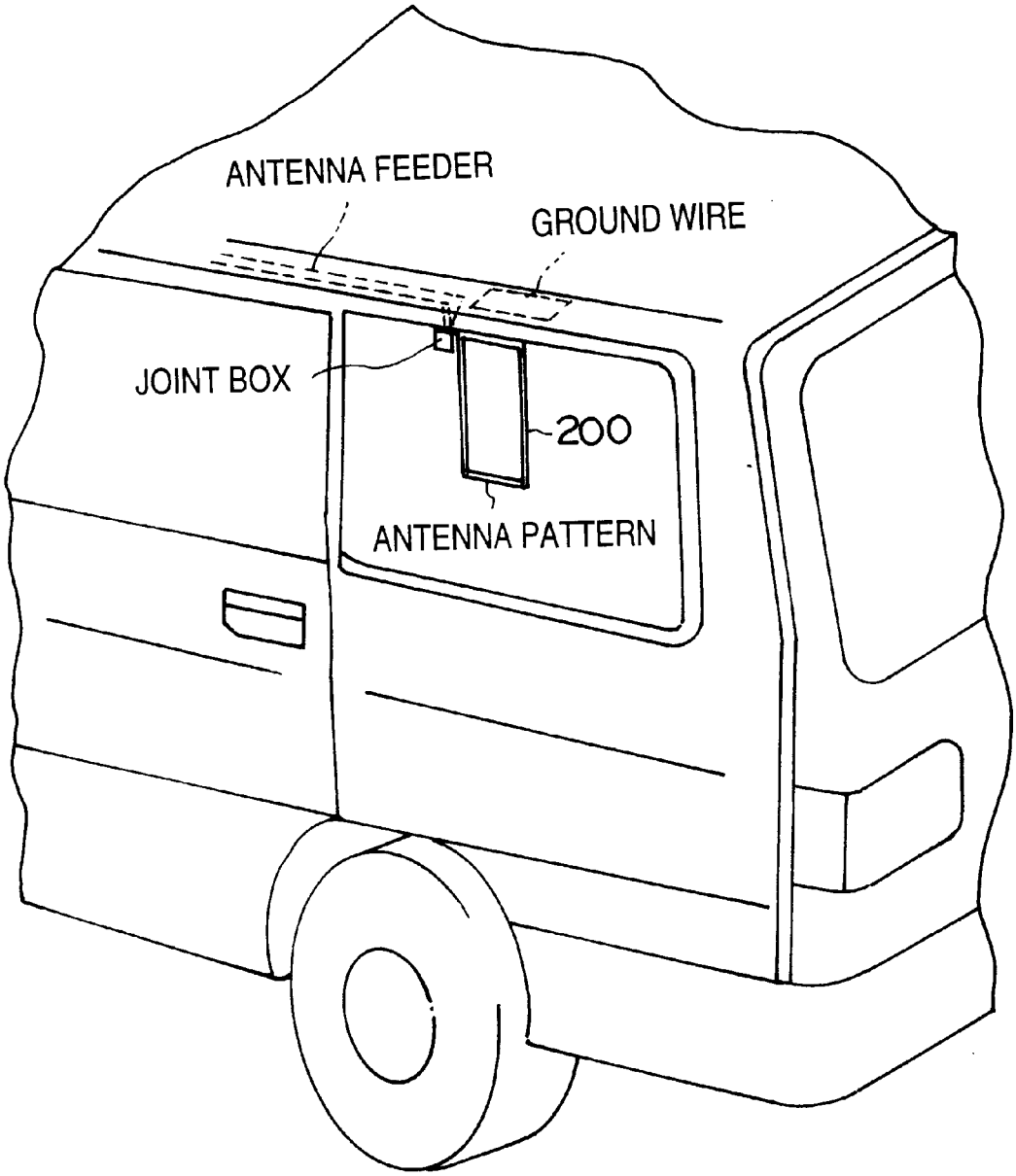
FIG. 98 is a perspective view showing a vehicular side window glass to which the glass antenna (with ground plate) according to the second embodiment is attached.

The ground of the glass antenna of the second embodiment is not limited to the open-end type ground wire so far as it satisfies the above designing conditions. FIG. 98 shows the antenna 200 connected to the ground plate. In this figure, the antenna 200 is placed on a side window glass.

Figure 99:
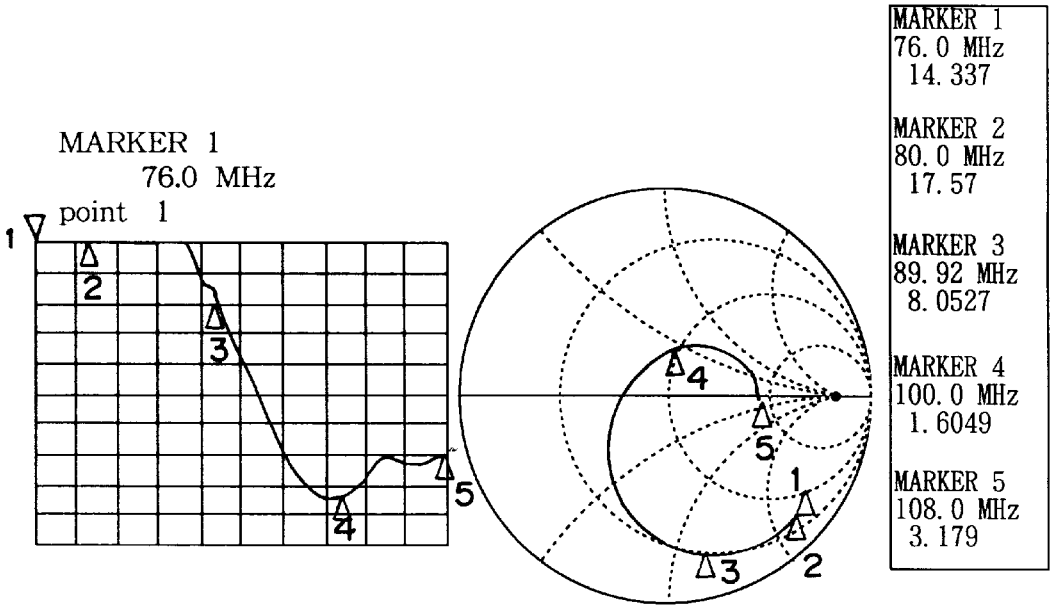
FIG. 99 is a set of graphs showing a VSWR characteristic of the antenna according to the second embodiment (without ground plate)
Figure 100:
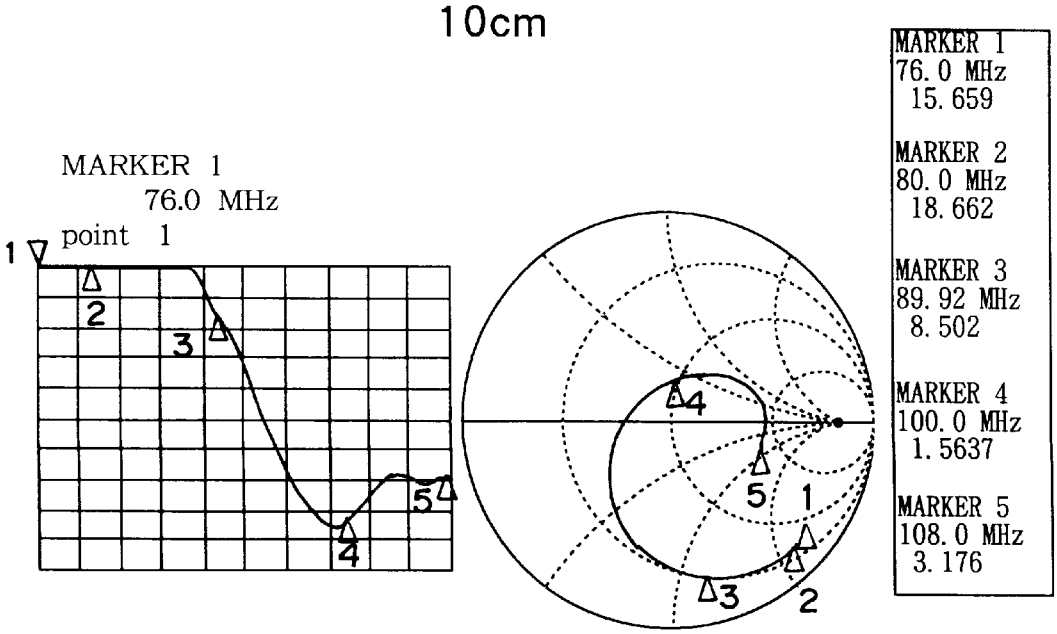
FIG. 100 is a set of graphs showing a VSWR characteristic of the antenna according to the second embodiment (ground wire length: 10 cm)
Figure 101:
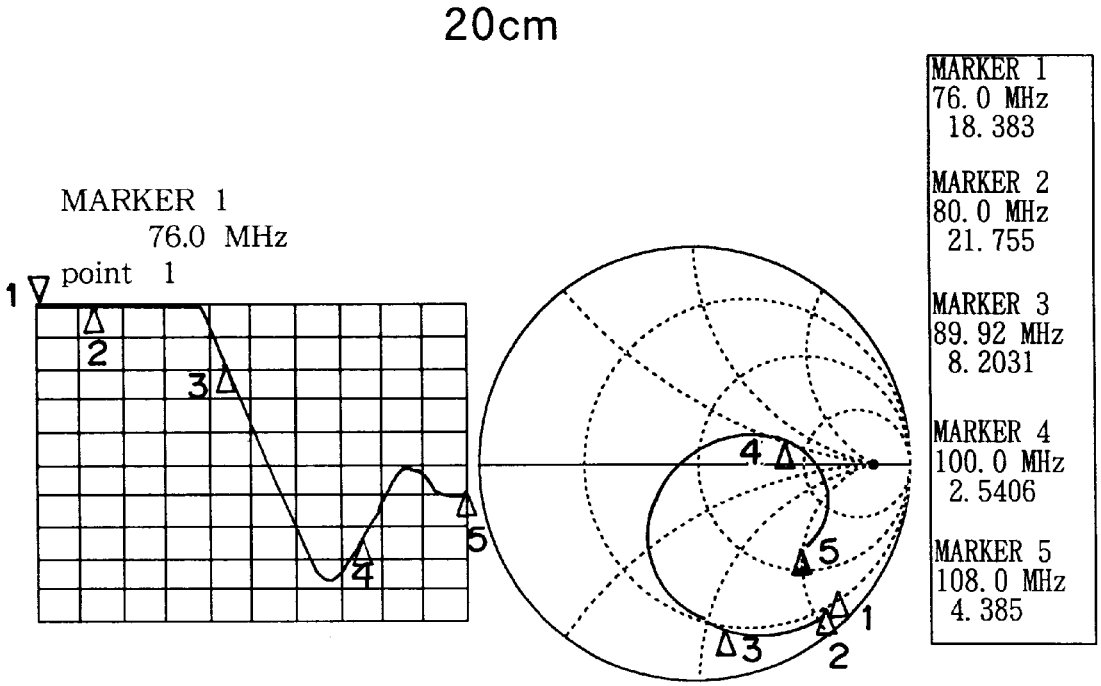
FIG. 101 is a set of graphs showing a VSWR characteristic of the antenna according to the second embodiment (ground wire length: 20 cm)
Figure 102:
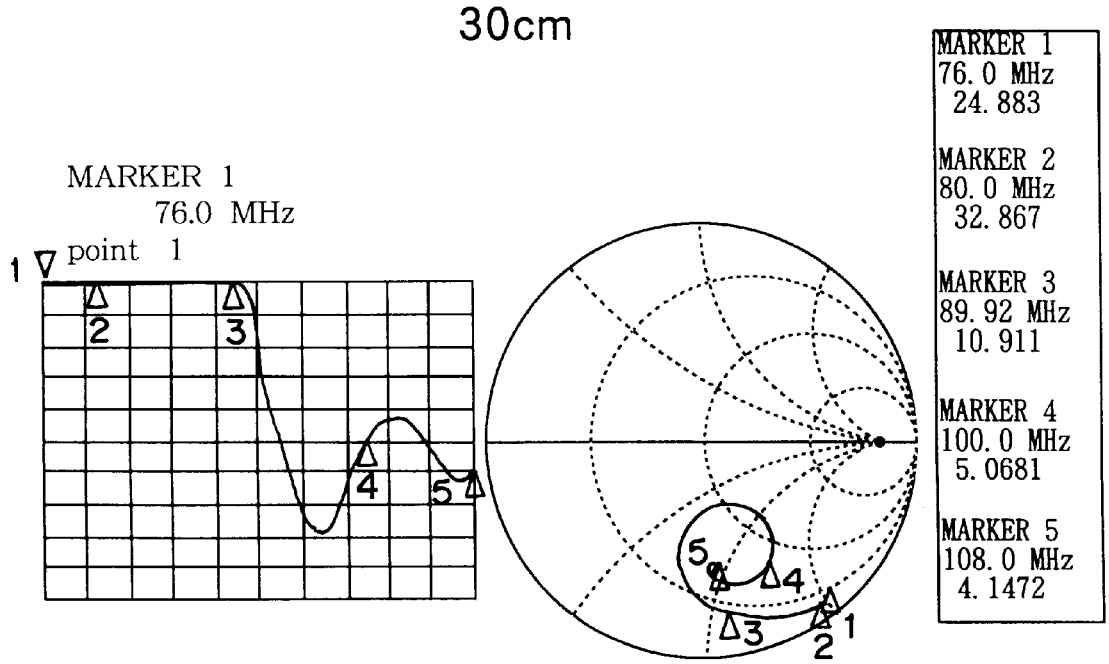
FIG. 102 is a set of graphs showing a VSWR characteristic of the antenna according to the second embodiment (ground wire length: 30 cm)
Figure 103:
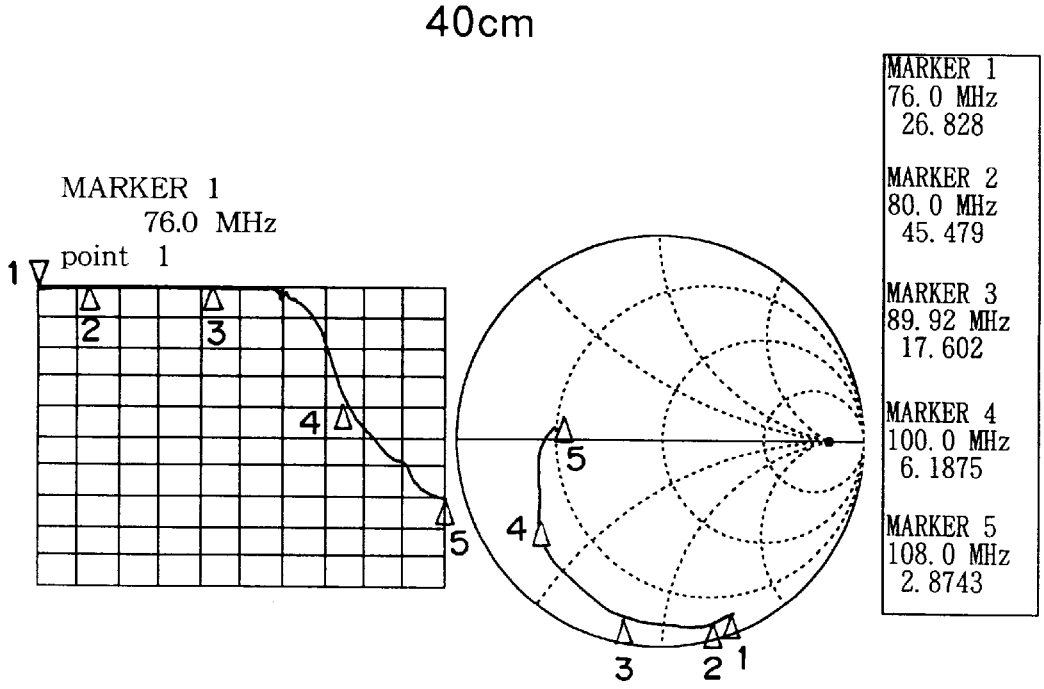
FIG. 103 is a set of graphs showing a VSWR characteristic of the antenna according to the second embodiment (ground wire length: 40 cm)
Figure 104:
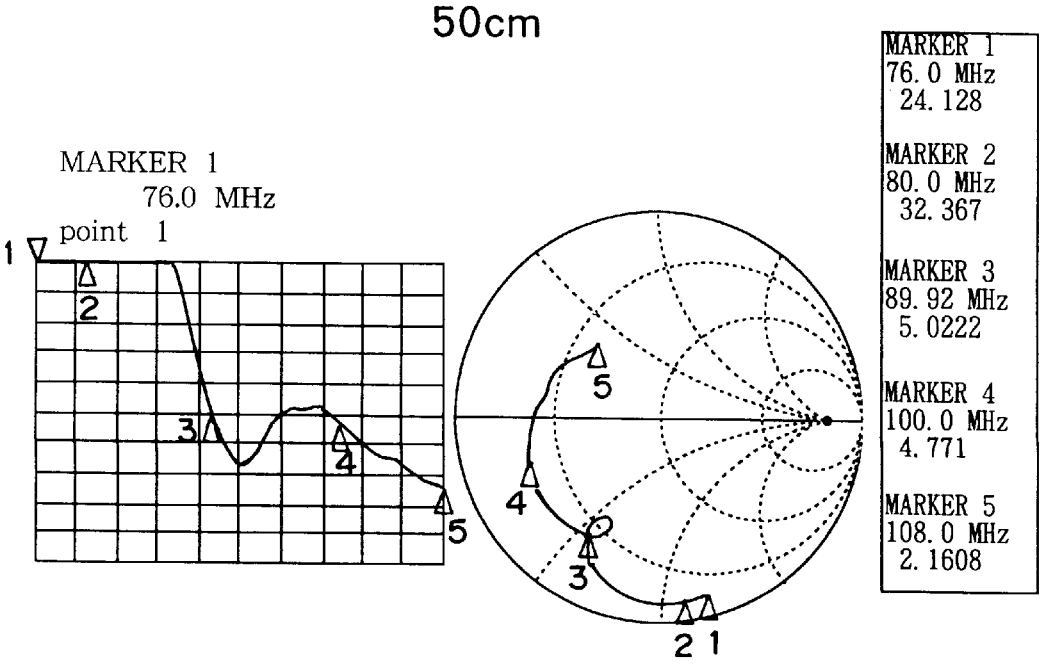
FIG. 104 is a set of graphs showing a VSWR characteristic of the antenna according to the second embodiment (ground wire length: 50 cm)
Figure 105:
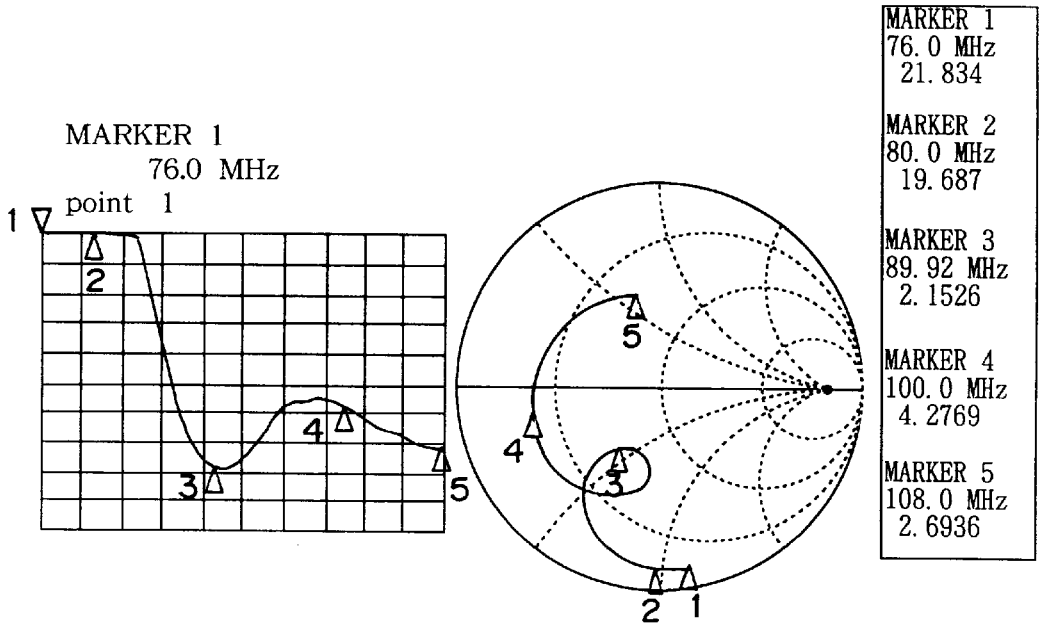
FIG. 105 is a set of graphs showing a VSWR characteristic of the antenna according to the second embodiment (ground wire length: 60 cm)
Figure 106:
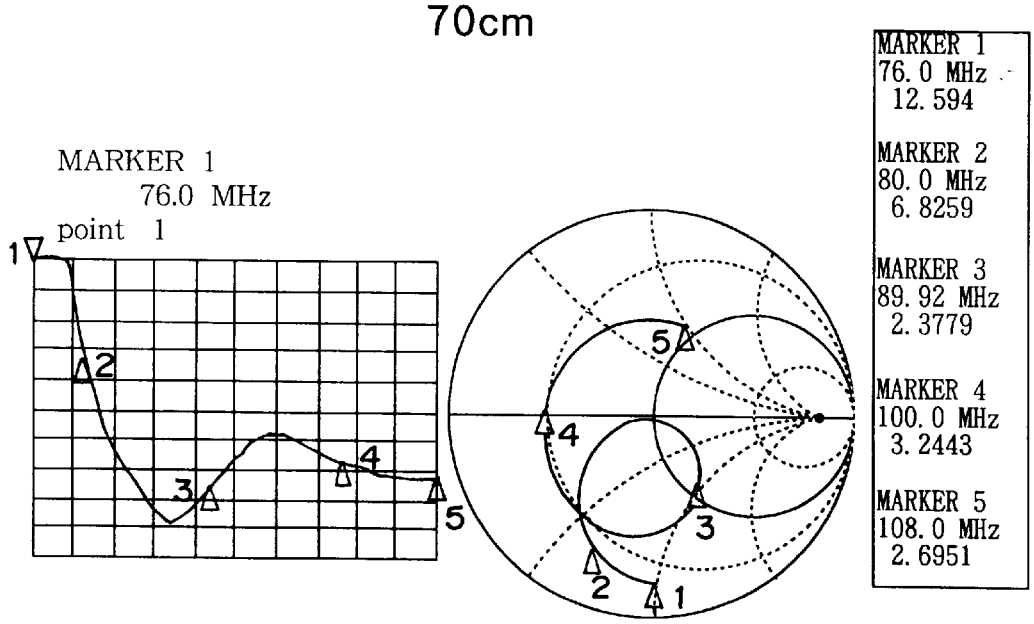
FIG. 106 is a set of graphs showing a VSWR characteristic of the antenna according to the second embodiment (ground wire length: 70 cm)
Figure 107:
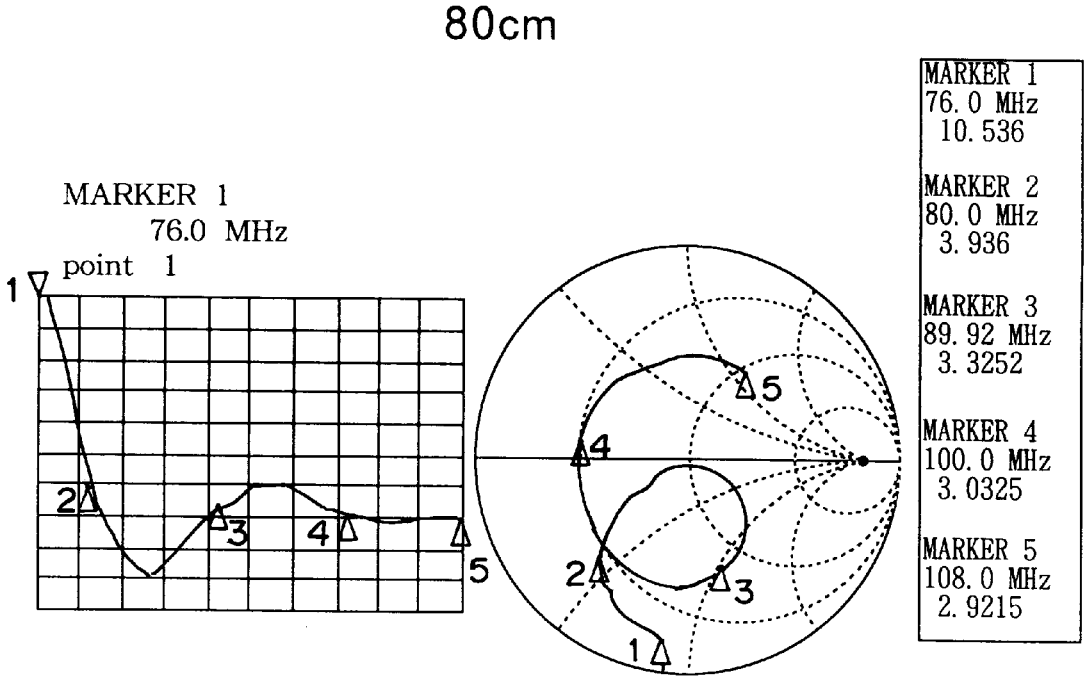
FIG. 107 is a set of graphs showing a VSWR characteristic of the antenna according to the second embodiment (ground wire length: 80 cm)
Figure 111:
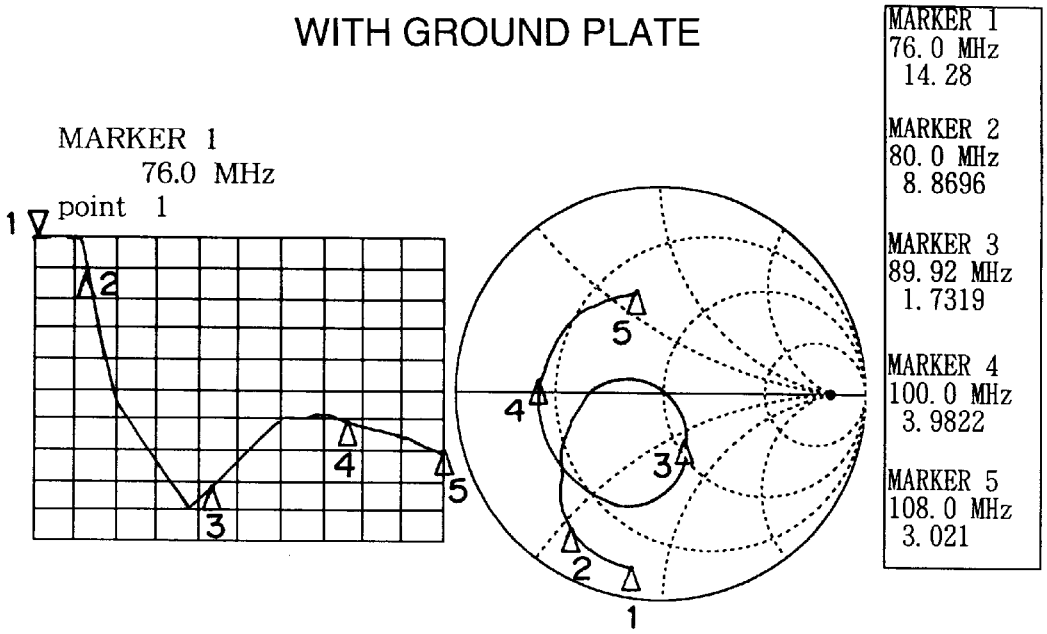
FIG. 111 is a set of graphs showing a VSWR characteristic of the antenna according to the second embodiment (with the ground plate)
Figure 112:
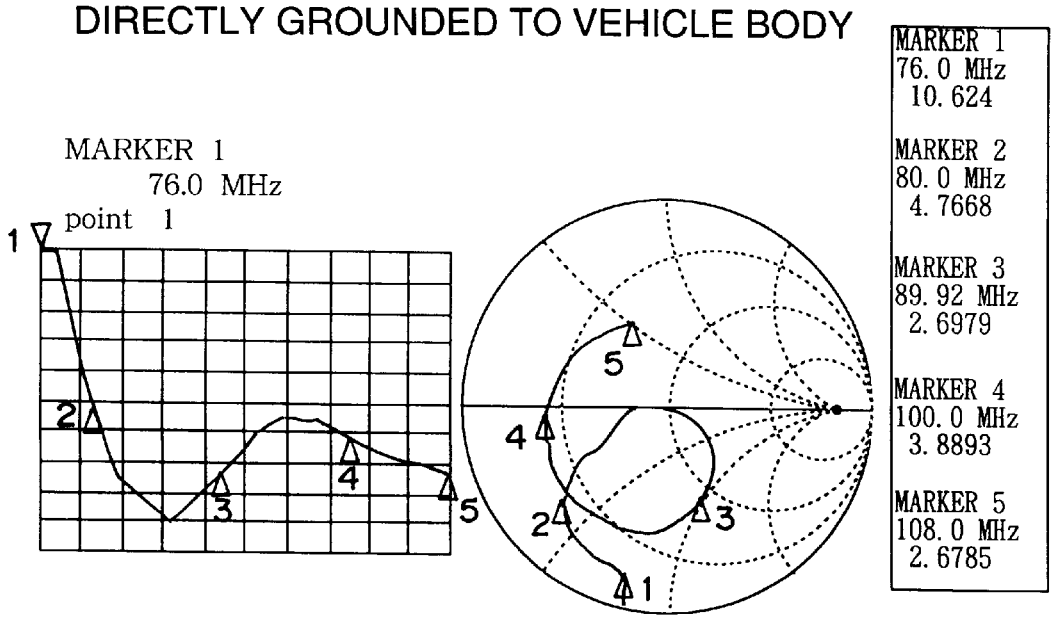
FIG. 112 is a set of graphs showing a VSWR characteristic of the antenna according to the second embodiment (the body is directly grounded)

FIGS. 100 to 110 are sets graphs showing VSWR characteristics of the VICS antenna 200 of the second embodiment, connected to the open-end type ground wire, in receiving TV radio waves in a band from 76 to 108 MHz, when the length of the open-end type ground wire is changed. For the purpose of comparison, FIG. 99 shows the VSWR characteristic of the antenna 200 without ground; FIG. 111, the VSWR characteristic of the antenna 200 with the ground plate; and FIG. 112, the VSWR characteristic of the antenna 200 directly grounded to the vehicle body.

It is apparent from the VSWR characteristic in FIG. 111 that the antenna 200 of the second embodiment with the ground plate is preferable for receiving FM radio waves in the VICS band.

Figure 108:
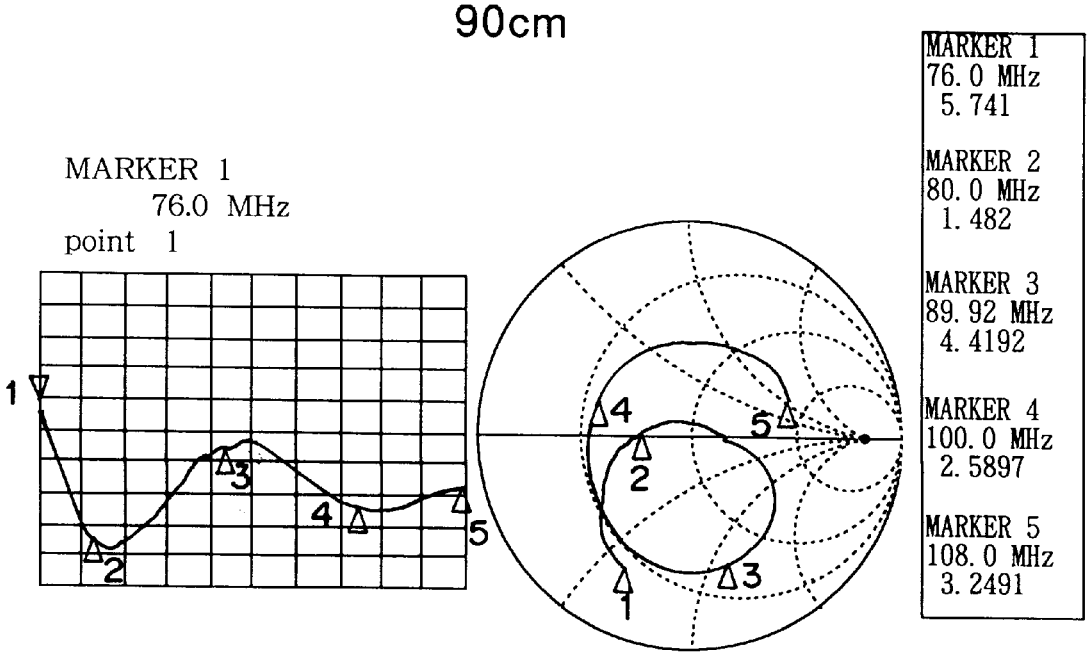
FIG. 108 is a set of graphs showing a VSWR characteristic of the antenna according to the second embodiment (ground wire length: 90 cm)
Figure 109:
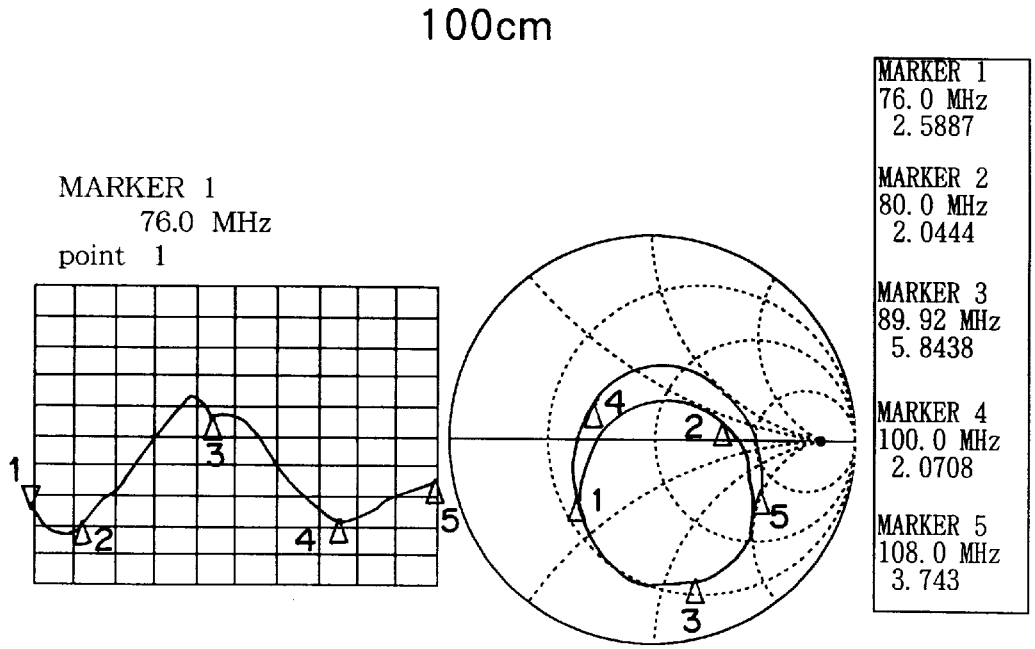
FIG. 109 is a set of graphs showing a VSWR characteristic of the antenna according to the second embodiment (ground wire length: 100 cm)
Figure 110:
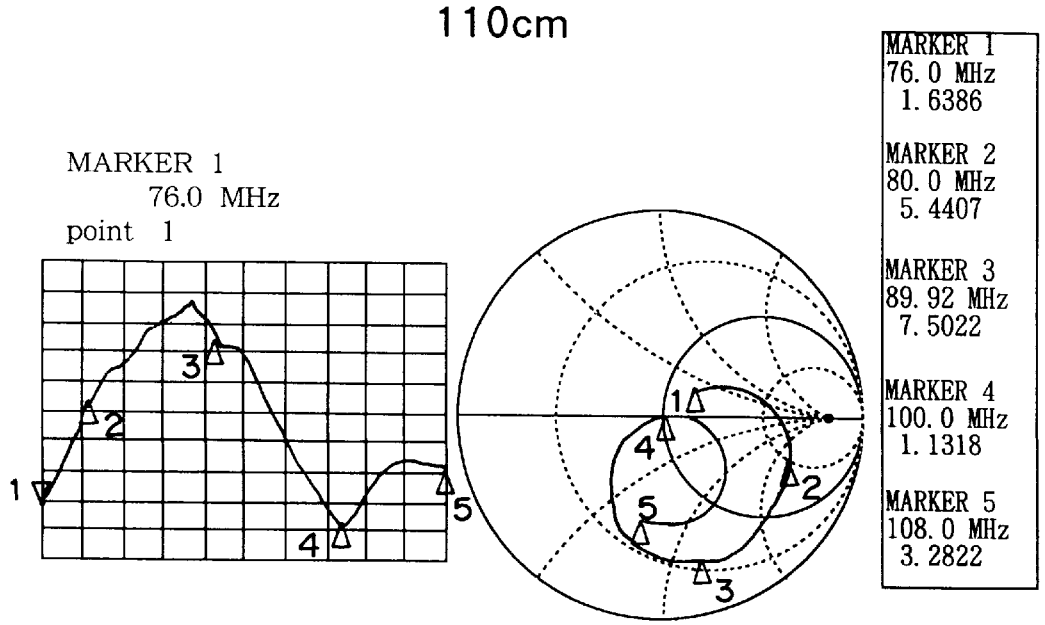
FIG. 110 is a set of graphs showing a VSWR characteristic of the antenna according to the second embodiment (ground wire length: 110 cm)

Further, it is understood from the graphs in FIGS. 100 to 110 that in a case where the antenna 200 of the second embodiment is used for receiving FM radio waves in the VICS band, it is preferable to set the length of the open-end type ground wire to 80 cm (FIG. 107) or 90 cm (FIG. 108).

Figures 113, 114:
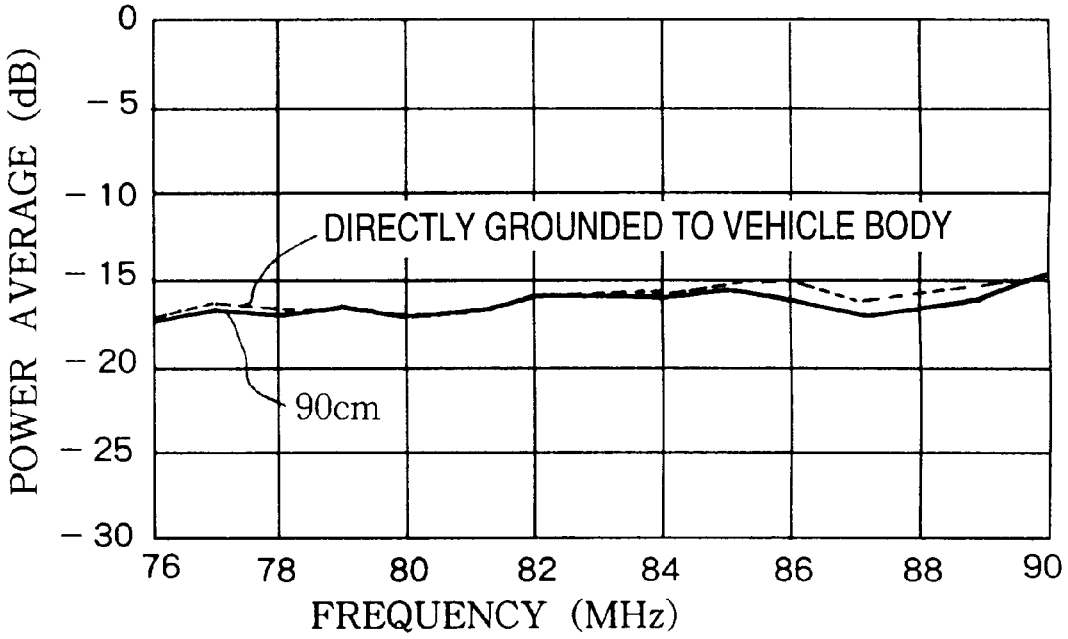
FIG. 113 is a graph showing reception characteristics of the antenna according to the second embodiment.
FIG. 114 is a table showing averaged reception characteristics of the antenna according to the second embodiment.

FIG. 113 is a graph showing a the reception sensitivities of the VICS antenna 200 with the open-end type ground wire having a length of 90 cm, placed on the side window glass. FIG. 114 is a table showing average reception sensitivities within an evaluation frequency range, obtained from FIG. 113. In FIG. 113, a broken line represents the reception characteristic when the antenna 200 is directly grounded to the vehicle body, given for the purpose of comparison.

[Third Embodiment]

As a third embodiment, the glass antenna of the present invention placed on a rear window glass will be proposed. The glass antenna of the third embodiment is the loop antenna employed in the first and second embodiment attached onto a rear window glass.

Figure 115:
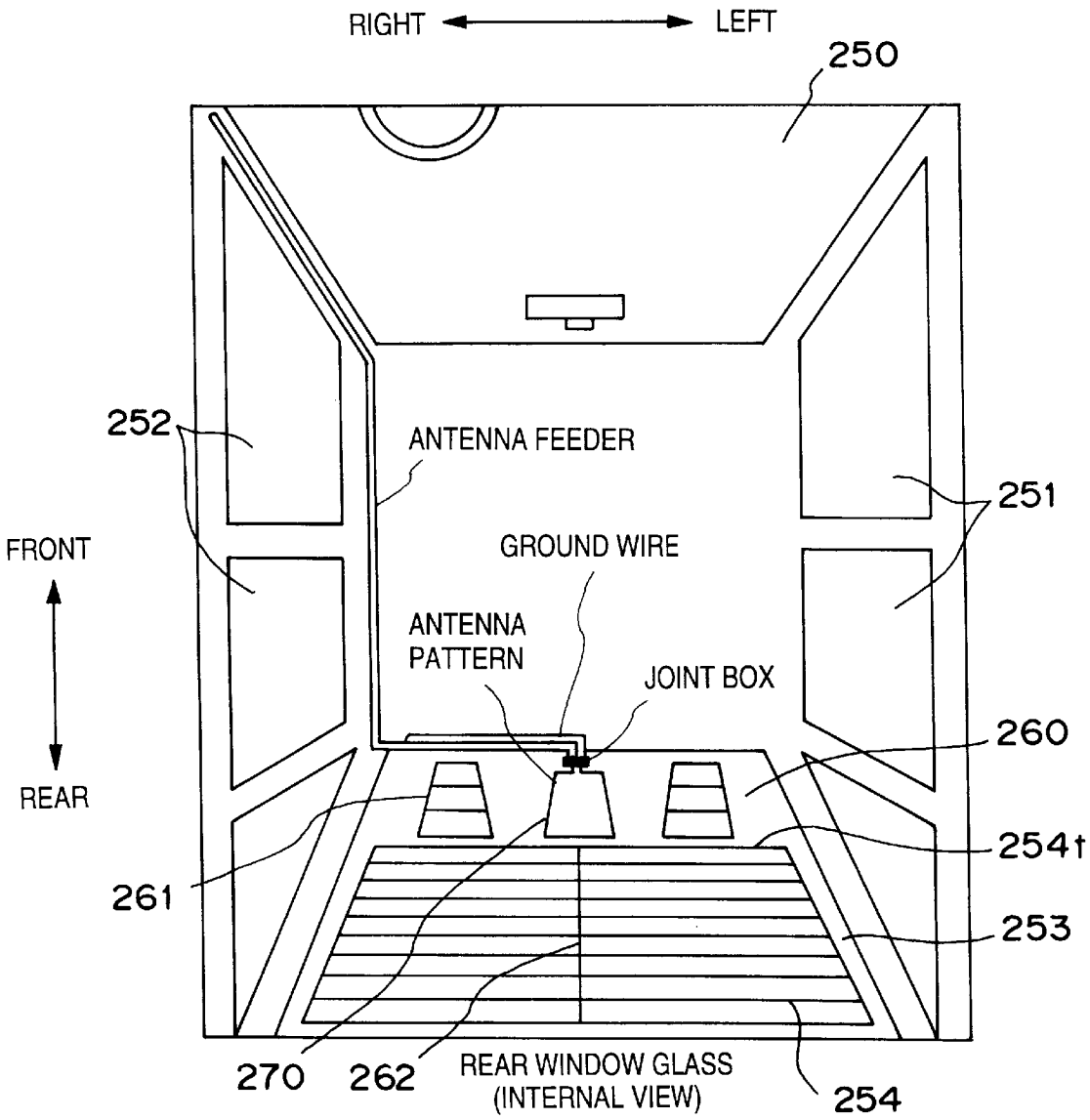
FIG. 115 is a perspective view showing a vehicular rear window glass to which the antenna according to a third embodiment is attached.

FIG. 115 is a perspective internal view of a vehicle body viewed from the bottom of the vehicle, where a glass antenna 270 according to the third embodiment is attached onto a rear window glass. In FIG. 115, numeral 250 denotes a front window glass; 251 and 252, side window glasses; and 253, the rear window glass.

A defogger 254 is placed on the rear window glass 253 where heating lines of the defogger are in parallel to a vehicular widthwise direction, and an antenna conductive wire 262 extends at the center of the defogger 254 vertically to the widthwise direction. The conductive wire 262 orthogonally intersects the heating lines of the defogger 254 and in direct-current connection with each of the heating lines.

At an upper part of the rear window glass 253, there is a blank area where the defogger heating line is not placed. Radio (or TV) antennas 260 and 261, and a VICS antenna 270 are placed in this area. Note that in FIG. 115, the antennas 260 and 261 have a ladder shape, and the VICS antenna 262, a frame shape.

Bottom conductive wires of the antennas 260 and 261 are adjacent to an uppermost heating line 254*t* of the defogger 254. Accordingly, the antennas 260 and 261 are respectively capacitively coupled, via the heating line 254*t*, with the conductive wire 262 vertically extending within the defogger 254.

Similarly, the VICS antenna 270 is capacitively coupled with the conductive wire 262.

For the capacitive coupling of the three antennas with the antenna conductive wire 262, the antennas are designed as follow.

That is, assuming that the length of the antennas 270, 260 and 261 in the vertical direction is y, the length of the antenna conductive wire 262 is L, and an antenna reduction ratio by the antenna conductive wire 262 is ω, the respective lengths y of the antennas are adjusted to satisfy:

$$20\text{ cm} \leqq y+\omega\cdot L \leqq 70\text{ cm}$$

Note that the open-end ground wire of capacitive coupling type is described in detail in Japanese Patent Application No. 6-205767 by the inventors of the present application.

Regarding the VICS antenna 270, it is necessary to satisfy the above-described expressions (1) and (2), and satisfy designing conditions shown in FIG. 30. That is, preferable measurements of the antenna 270 are:

$$x \leqq 30\text{ cm}$$

$$20\text{ cm} \leqq y+\omega L \leqq 40\text{ cm}$$

In the present embodiment, the VICS antenna 270 uses the above-described open-end type ground wire.

According to the antenna system of the third embodiment, a diversity system which receives radio waves in radio and TV broadcast bands and a VICS broadcast band can be provided.

The antenna system has the advantage of the antenna system of the first embodiment, and all the features of the open-end type ground wire.

[Further Modifications]

Various modifications can be made to the first to third embodiments within the scope of the present invention:

I: The antenna shapes of the glass antenna of the first to third embodiments are T-shape, rectangular and a circular shapes; the present invention can be any shape of antenna so far as it is a loop antenna and the loop is close to a feeding point.

II: In the expression (2) applied to the glass antenna of the first to third embodiments, the critical value is 60 cm since the antenna base is glass material; if the base is any other material than glass (with transmission path reduction ratio: γ), the critical value 60 cm can be generally predetermined 100×γ cm. If the reduction ratio γ of the base is smaller than the glass reduction ratio (α≈0.6), 100×γ cm is smaller than the critical value 60 cm. In this case, the size of the antenna can be minimized.

III: The open-end type ground wire employed in the first to third embodiments is used with the feeder cable; the ground wire applied to the present invention is not limited to this use. For example, a thin and slender sheet conductor can be arranged on a glass surface as the open-end type ground wire, separated from the feeder cable. Note that the shield of the feeder cable and the conductor is connected within the joint box. In this case, as the glass (reduction ratio: α) exists between the ground wire and the vehicle body, an appropriate length of the open-end type ground wire is (λ/4)·α from the expression (5).

IV: The antenna of the embodiments has a specific shape in consideration of a sticker such as an automobile inspection sticker or a periodic service sticker, which must be stuck on a front window glass in conformity to the Japanese law; however, in the United States, for example, it is not necessary to stick such stickers on a front widow glass. Accordingly, in a country or state where a sticker like the above-mentioned automobile inspection sticker must be stuck on a window glass to observe the law or regulation, the shape of the glass antenna of the present invention should be changed in accordance with the shape of the sticker.

V: The regulations, made on attachments to a window glass which obstruct a driver's sight, for the purpose of ensuring the driver's sight, are different depending upon country, state or area. Accordingly, similar to the case of inspection sticker, the shape of the glass antenna of the present invention should be changed in accordance with the law or regulations thereof.

As described above, in accordance with the present invention, a glass antenna having high performance while ensuring visibility can be provided, and the glass antenna can be easily designed.

Further, the size of the antenna can be controlled by selecting antenna base material.

Further, antennas for various frequency bands can be designed by utilizing a rear defogger.

As many apparently widely different embodiments of the present invention can be made without departing from the spirit and scope thereof, it is to be understood that the invention is not limited to the specific embodiments thereof except as defined in the appended claims.

What is claimed is:

1. A glass antenna for a vehicle having a reception frequency band of 90 MHz to 225 MHz, comprising:

an antenna pattern, placed on an upper area of a front window glass of a vehicle, the front window glass not including a defogger, said antenna pattern having, a length y, being a maximum longitudinal length of said antenna pattern of said glass antenna, measured from a feeding unit substantially functioning as a feeding point, set so as to satisfy $$y \leqq \lambda/4 \cdot \alpha$$

with a reception frequency wavelength as $\lambda$ and a glass reduction ratio as $\alpha$; and a length x, being a maximum transversal length of said antenna pattern of said glass antenna, set so as to satisfy $$60\ \text{cm} - y \geqq x.$$

2. The glass antenna according to claim 1, wherein said lengths x and y are respectively set so as to satisfy 8 cm$\leqq y \leqq$40 cm, and $x \leqq$30 cm.

3. The glass antenna according to claim 1, wherein the window glass is a vehicular front window glass, and wherein said antenna pattern of said antenna has a portion extending downward whose maximum length x in a width direction is 6.6 cm said portion of the pattern extending downward from a point on the lass lower by a predetermined distance than an upper end of an area of the window glass which does not intercept a driver's sight when the glass window is installed in a vehicle.

4. The glass antenna according to claim 3, wherein said antenna pattern of said glass antenna is larger than an internal mirror of the vehicle.

5. The glass antenna according to claim 1, wherein the window glass is a vehicular front window glass, and wherein said antenna pattern of said glass antenna has a portion extending downward whose maximum length x in a width direction is 6.6 cm. said portion of the pattern extending upward from a point on the glass by a predetermined distance than a lower end of an area of the window glass which does not intercept a driver's sight when the glass window is installed in a vehicle.

6. The glass antenna according to claim 1, wherein said antenna pattern of said glass antenna is a rectangular shape where said lengths x and y are in a relation of x>y, and wherein the feeding point of said glass antenna is placed at an upper end or a lower end of the rectangular shape.

7. The glass antenna according to claim 6, wherein the lengths x and y are set so as to respectively satisfy $$5\ \text{cm} \leqq x \leqq 40\ \text{cm and}$$

$$3\ \text{cm} \leqq y \leqq 10\ \text{cm}$$

and wherein a reception frequency band is a UHF band.

8. The glass antenna according to claim 1, wherein said glass antenna is a grounded antenna, and wherein a ground member connecting with said glass antenna is capacitively coupled with a metal part of a vehicle body.

9. The glass antenna according to claim 8, wherein said ground member has a magnetized portion which attracts the metal part of the vehicle body, thus obtaining a predetermined gap between said ground member and the metal part of the vehicle body.

10. The glass antenna according to claim 8, wherein said glass antenna is capacitively coupled with the metal part of the vehicle body.

11. The glass antenna according to claim 1, wherein said glass antenna is stuck on a surface of the glass window with an adhesive layer provided on a surface of said glass antenna.

12. The glass antenna according to claim 1, wherein said glass antenna is placed on a vehicular side window glass.

13. The glass antenna according to claim 1, wherein said feeding unit is placed on an upper portion or a lower portion of the window glass, and wherein the lengths x and y are respectively set so as to satisfy $$7\ \text{cm} \leqq x \leqq 30\ \text{cm and}$$

$$7\ \text{cm} \leqq y \leqq 10\ \text{cm}.$$

14. The glass antenna according to claim 13, wherein said antenna pattern is placed on the upper area of the front window glass, within a predetermined distance from an upper end of an area which does not intercept a driver's sight.

15. A method of designing a glass antenna on a window glass of a vehicle, the window glass not having a defogger, and which is suitable to receive a radio wave in a reception frequency band of 90 MHz to 225 MHz, comprising the steps of:

determining a length y, being a maximum longitudinal length of an antenna pattern of said glass antenna, measured from a feeding unit substantially functioning as a feeding point, set so as to satisfy $$y \leqq \lambda/4 \cdot \alpha$$

with a reception frequency wavelength as $\lambda$ and a glass reduction ratio as $\alpha$, allowing to shift a reception frequency band of said glass antenna from said reception frequency wavelength $\lambda$.;

adjusting a length x, being a maximum transversal length of said antenna pattern of said glass antenna so that the lengths x and y satisfy:

$$60\ \text{cm} - y \geqq x;\ \text{and}$$

placing said antenna pattern of said glass antenna on an upper area of said front window glass.

16. The method according to claim 15, wherein the window glass is a vehicular front window glass, and wherein said antenna pattern of said glass antenna is designed to have a portion extending downward whose maximum length x in a width direction is 6.6 cm, said portion of the pattern extending downward from a point on the glass lower by a predetermined distance than an upper end of an area of the window glass as which does not intercept a driver's sight when the glass window is installed in a vehicle.

17. The method according to claim 16, wherein the predetermined distance is 10 cm.

18. The method according to claim 15, wherein the window glass is a vehicular front window glass, and wherein said antenna pattern of said antenna is designed to have a portion extending downward whose maximum length x in a width direction is 6.6 cm, said portion of the pattern extending upward from a point on the glass upper by a predetermined distance than a lower end of an area of the window glass which does not intercept a driver's sight when the glass window is installed in a vehicle.

19. The method according to claim 18, wherein the predetermined distance is 10 cm.

20. The method according to claim 15, wherein the lengths x and y are determined so as to respectively satisfy $$5\text{ cm} \leqq x \leqq 40\text{ cm and}$$

$$3\text{ cm} \leqq y \leqq 10\text{ cm},$$

whereby the reception frequency band is adjusted to a UHF band.

21. A glass antenna for a vehicle having a reception frequency band of 76 MHz to 108 MHz, comprising:

an antenna pattern placed on an upper area of a front window glass of a vehicle, the front window glass not including a defogger, said antenna pattern having, a length y, being a maximum longitudinal length of said antenna pattern of said glass antenna, measured from a feeding unit substantially functioning as a feeding point, set so as to satisfy $$y \leqq \lambda/4 \cdot \alpha$$

with a reception frequency wavelength as $\lambda$ and a glass reduction ratio as $\alpha$; and a length x being a maximum transversal length of said antenna pattern of said glass antenna, wherein said feeding unit is placed on an upper portion or a lower portion of the window glass, and wherein the lengths x and y are respectively set so as to satisfy $$60\text{ cm} - y \geqq x,$$

$$x \leqq 30\text{ cm and}$$

$$7\text{ cm} \leqq y \leqq 10\text{ cm}.$$

22. The glass antenna according to claim 21, wherein said antenna pattern is placed on a vehicular window glass, within a predetermined distance from an upper end of an area which does not intercept a driver's sight.

23. The glass antenna according to claim 22, wherein said antenna pattern includes a plurality of independent antenna wires constituting a diversity system.

* * * * *

UNITED STATES PATENT AND TRADEMARK OFFICE

CERTIFICATE OF CORRECTION

PATENT NO.: 6,008,767
DATED : December 28, 1999
INVENTOR(S): Tatsuaki Taniguchi, et al.

It is certified that error appears in the above-identified patent and that said Letters Patent is hereby corrected as shown below:

On the title page: ITEM [56]

OTHER REFERENCES, ADD
Michiaki ITO, et al., "DISC SHAPED MONO-POLE ANTENNA WITH WIDE RANGE AND DIRECTIVITY-LESS RECEPTION PERFORMANCE", Nagaoka University of Technology

[56] FOREIGN PATENT DOCUMENTS, ADD
3-74845 11/1991 Japan
3-1703 01/1991 Japan

Column 2, line 67, change "x<y" to --x>y--.

Column 9, line 66, "The" begins new line.

UNITED STATES PATENT AND TRADEMARK OFFICE

CERTIFICATE OF CORRECTION

PATENT NO.: 6,008,767
DATED : December 28, 1999
INVENTOR(S): Tatsuaki Taniguchi, et al.

It is certified that error appears in the above-identified patent and that said Letters Patent is hereby corrected as shown below:

Column 13, line 32, change "x=y" to --x≒y--.

Column 16, line 58, change "." to --,-- (first occurrence).

Column 22, line 40, change "α=0.6" to --α≒0.6--

Column 23, line 46, change, "lass" to --glass--.

Column 25, line 6, delete "as".

Signed and Sealed this

Seventh Day of November, 2000

*Attest:*

Q. TODD DICKINSON

*Attesting Officer*

*Director of Patents and Trademarks*